US009551170B1

(12) United States Patent
Kovac

(10) Patent No.: US 9,551,170 B1
(45) Date of Patent: Jan. 24, 2017

(54) HANDCUFF APPARATUS

(71) Applicant: Creative Law Enforcement Resources, Inc., South Pasadena, CA (US)

(72) Inventor: Kresimir Kovac, Fountain Valley, CA (US)

(73) Assignee: Creative Law Enforcement Resources, Inc., South Pasadena, CA (US)

( * ) Notice: Subject to any disclaimer, the term of this patent is extended or adjusted under 35 U.S.C. 154(b) by 0 days.

(21) Appl. No.: 14/919,200

(22) Filed: Oct. 21, 2015

(51) Int. Cl.
*E05B 75/00* (2006.01)
*E05B 35/00* (2006.01)
*E05B 27/00* (2006.01)

(52) U.S. Cl.
CPC ..... *E05B 75/00* (2013.01); *E05B 27/0003* (2013.01); *E05B 35/008* (2013.01)

(58) Field of Classification Search
CPC ..... E05B 75/00
See application file for complete search history.

(56) References Cited

U.S. PATENT DOCUMENTS 1,900,242 A * 3/1933 Latou ..... E05B 75/00 70/16
4,314,466 A * 2/1982 Harris ..... E05B 75/00 70/16
4,509,346 A * 4/1985 Szczepanek ..... E05B 75/00 70/16
5,463,884 A * 11/1995 Woo ..... E05B 75/00 70/16
5,660,064 A * 8/1997 Ecker ..... E05B 75/00 70/14
5,743,117 A * 4/1998 Woo ..... E05B 75/00 70/16
8,210,006 B2 * 7/2012 Huang ..... E05B 75/00 70/16
8,336,345 B2 * 12/2012 Burgoon ..... E05B 75/00 128/846

(Continued)

FOREIGN PATENT DOCUMENTS

GB 2439088 12/2007

OTHER PUBLICATIONS

James E. Harris, "A Study of Handcuff Improvements", 1980, USA.
Jie Zhang, Bi Lingxia, "Creative Thinking in Product Innovative Design: A Handcuff Case Study" 2014, China.

*Primary Examiner* — Christopher Boswell
(74) *Attorney, Agent, or Firm* — Smyrski Law Group, A P.C.

(57) ABSTRACT

A set of handcuffs utilizing a conventional single strand and double strand system with ratchet teeth to prevent opening by virtue of one or more pawls is provided. The handcuffs may be connected via chain or similar device. Standard handcuffs may be unlocked by use of a universal key thereby creating safety and security issues. This design incorporates secondary security features which require that a handcuff be manipulated in some additional manner simultaneously while a handcuff key is utilized. This system requires two sets of hands to be used simultaneously to disengage the locking system. One hand of a person wearing the handcuffs is unable to manipulate the handcuff on which it is worn. As a result, it is virtually impossible for the wearer of the handcuffs to unlock the handcuffs/restraining device even if the person is in possession of the required key.

30 Claims, 85 Drawing Sheets

(56) References Cited

U.S. PATENT DOCUMENTS

| | | | | |
|---|---|---|---|---|
| 8,353,183 | B1 * | 1/2013 | Lofgren | E05B 75/00 70/16 |
| 8,769,998 | B1 | 7/2014 | MacConnell | |
| 8,776,555 | B1 | 7/2014 | Lofgren | |
| 2012/0085135 | A1 * | 4/2012 | Louden | E05B 75/00 70/16 |
| 2013/0192314 | A1 * | 8/2013 | Cheng | E05B 75/00 70/16 |

* cited by examiner

HANDCUFF APPARATUS

BACKGROUND

I. Field

The present disclosure relates generally to the field of personal restraint and securing of individuals, and more specifically to handcuffs used in various scenarios, such as law enforcement, military, corrections or private security, wherein enhanced features make removing the handcuffs more difficult for the restrained individual.

II. Background

Handcuffs have been used for centuries to restrain individuals in various scenarios, including but not limited to prison or correctional facility situations. Use and construction of handcuffs and similar restraints are well known, and handcuffs are generally accepted as an effective restraint system for use by law enforcement, military personnel, security officers and various other entities worldwide. Handcuffs are a standard issued item of police equipment utilized by every major law enforcement agency in the world, and handcuffs and/or related restraints are currently in use by police officers, corrections officers, private security officers, military personnel, and so forth. The same may be said for other restraining devices, including but not limited to handcuffs, leg chains, waist chains, finger cuffs, and any manner of mechanisms used to restrain a person's wrists, hands, arms, ankles, legs, feet, or any or other body part. As used herein, all these restraining devices will be generally referred to as "handcuffs" and the teachings herein may apply to other restraining devices while illustrated for use in, for example, restraining an individual by his or her wrists.

Handcuffs have for decades employed a standard ratchet teeth type locking system wherein a standard universal handcuff key is needed to unlock them. The basic design of handcuffs has been virtually unchanged for more than a century. Handcuffs are a critical piece of law enforcement equipment and very few viable alternatives to standard handcuffs exist. Although many manufacturers have attempted to create a more secure handcuff, these have largely been commercially unsuccessful and thus the same traditional handcuff style used decades ago is still in use today.

The standard handcuff in use by law enforcement today utilizes a bracelet type design placed around a wrist and secured via a ratchet which is then locked into place. The teeth of the ratchet engage the teeth of the spring-loaded pawl located inside the bracelet and when the pawl is forced against the ratchet, the two sets of teeth are locked together. To release the handcuffs, the pawl must be disengaged from the ratchet teeth, which is accomplished with the use of a universal handcuff key. The handcuff key is rotated to disengage the primary lock. The design of the ratchet teeth and pawl allows for free movement of a piece called a strand when tightening the handcuffs, but prevents the single strand from loosening unless the pawl is depressed so that it may no longer engage the ratchet teeth.

Each wrist of the wearer is secured with an individual handcuff connected to another handcuff via a small chain, hinge, solid locking component, or other method. This assembly is commonly referred to as a set of handcuffs, a pair of handcuffs, "handcuffs" or any other derivative phrase indicating two or more handcuff portions secured together to form a unit capable of securing two or more appendages of a wearer.

A universal handcuff key is used to manipulate a double lock bar mechanism, which moves laterally under the pawl.

The double lock bar can be set to prevent the pawl from being depressed thereby locking the single strand into place. Handcuffs with double lock bars have a detent, which when engaged, stops the cuff from ratcheting tighter and prevents the wearer from over-tightening the cuffs. Tightening the handcuff ratchets could be intentional or may occur unintentionally when pressure is applied to the single strand ratchet. As a result, handcuffs may cause nerve damage or loss of circulation in a wearer's hands due to over-tightening. Additionally, some wearers may tighten the handcuffs in order to attempt an escape by utilizing lock picking tools or have an officer loosen the handcuffs where the wearer subsequently attempts to escape while the handcuffs are loosened. Double locking the handcuffs make picking handcuff locks more difficult.

These traditional and current handcuff designs are extremely susceptible to countermeasures and escape attempts such as lock picking. Lock picking is the practice of unlocking a lock by manipulating various components of the locking device without the use of the original key. For purposes of this document, the term "lock picking" will broadly be used to describe various countermeasures utilized in an attempt to defeat the security capabilities of handcuffs or related restraints.

Handcuffs may be opened in four general ways: utilizing a handcuff key or lock pick, slipping the hands out of the handcuffs when the hands are smaller than the ratchet openings, releasing the pawl with a shim, or breaking the handcuff chain commonly known as "handcuff breaking."

A significant issue with commercial handcuffs today is the ability to unlock the cuffs using a single commonly available universal handcuff key. The universal handcuff key is simple in its design and encompasses a shaft, a bow which is used to grip the key, a single bit which engages the pawl of the handcuffs to release the single strand and a peg used to engage the double locking mechanism. Due to the simple design of the key and corresponding locking mechanism inside the common handcuff, significant vulnerabilities exist in the design.

Many law enforcement officers utilize handcuffs designed for use with a universal handcuff key due to needs for operational and field expediency. Handcuffs are often placed on suspects and physical custody of the individual(s) is transferred to other law enforcement personnel. The need to have a common key is important to ensure efficiency when cuffing, uncuffing or transporting a prisoner whether it is in a patrol environment, the courts, a jail system, prisons or any other setting. Further, emergency situations can sometimes arise when releasing the individual is required for the individual's safety, and an unusual or remote key could potentially result in harm to the individual.

Due to this commonality of the universal handcuff key design, suspects and other non-law enforcement related personnel sometimes carry handcuff keys on their person in anticipation of defeating handcuff locking mechanisms. Variations of the universal handcuff key are often hidden and kept by criminals and inmates on their person with the intent to escape and/or assault someone. Handcuff keys have been known to be built into devices and/or attached to designs to be worn on a person's clothing or body wherein they are not readily recognized as a handcuff key. These surreptitious handcuff keys can then be quickly deployed and utilized to escape or attack an officer or other individual nearby.

Additionally, a simple pin or piece of metal (or similar object) can be utilized to pick the primary handcuff locking mechanism, or a shim can be forced between the single strand ratchet teeth and the pawl, thereby releasing the handcuffs. Books and instructional videos are readily available demonstrating various ways to open handcuffs—even by the wearer. These methods for picking standard handcuffs can be learned and completed with the use of a single hand by individuals even while handcuffed with their hands behind their backs.

Lock breaking refers to a method whereby the handcuffs are twisted in such a manner as to cause undue torsion on the small chain connecting the two handcuff assemblies. Additional tension is then exerted with force by the wearer so that the chain breaks thereby freeing a suspect's hands. Such a vulnerability is also undesirable.

There is a need for enhanced security handcuffs which provides substantially greater security and an inability for them to be opened by the wearer. Security handcuffs should be simple to operate, should preferably have a generally similar form factor as current designs, and still utilize a universal handcuff key. Handcuffs should be extremely difficult, if not impossible, to open by the wearer of the handcuffs even if they are in possession of the handcuff key or other lock picking device. Handcuffs should nevertheless be capable of easily being unlocked by an officer, utilizing a universal handcuff key, while at the same time avoiding the design limitations and vulnerabilities associated with earlier designs.

SUMMARY

According to one embodiment, there is provided a set of handcuffs comprising a handcuff strand comprising ratchet teeth, a universal handcuff key locking mechanism configured to receive a universal handcuff key to unlock the handcuffs, and locking means provided on one handcuff of the set of handcuffs requiring more than one hand to manipulate in addition to employing the universal handcuff key to release the ratchet teeth and unlock the set of handcuffs. Locking means may comprise a variety of arrangements, including but not limited to a multiple tab spring, a sliding mechanism, a design wherein the handcuff strand comprises a plurality of openings configured to receive teeth engageable by depressing a plurality of buttons, a chain tension lock bar, a multiple element spring and a multiple element key pawl, a double lock chain hinge, a two button arrangement comprising a spring positioned between two buttons, a double lock and spring-plunger arrangement, a hook component configured to engage a key pawl to keep the key pawl from moving, an opposing two button arrangement configured to lock and release a key pawl, a double lock with sliders on both sides of one handcuff, as well as numerous other embodiments of the design.

According to a further embodiment, there is provided a restraining arrangement comprising a releasable strand comprising ratchet teeth, the releasable strand configured to tighten and loosen about a wearer, a universal key locking mechanism configured to receive a universal key to unlock the restraining arrangement, and locking means provided in the restraining arrangement requiring more than one hand to manipulate in addition to employing the universal handcuff key to release the ratchet teeth and unlock the restraining device from the wearer.

According to a third embodiment of the present design, there is provided a set of handcuffs comprising a releasable handcuff strand comprising ratchet teeth, the releasable handcuff strand configured to tighten and loosen about a wearer, a universal key locking mechanism configured to receive a universal key to unlock the set of handcuffs, and locking means provided on a single handcuff of the set of handcuffs, the locking means requiring more than one hand to manipulate in addition to employing the universal key to release the ratchet teeth and releasable handcuff strand and unlock the restraining device from the wearer.

Various aspects and features of the disclosure are described in further detail below.

DETAILED DESCRIPTION

Figure 1A:
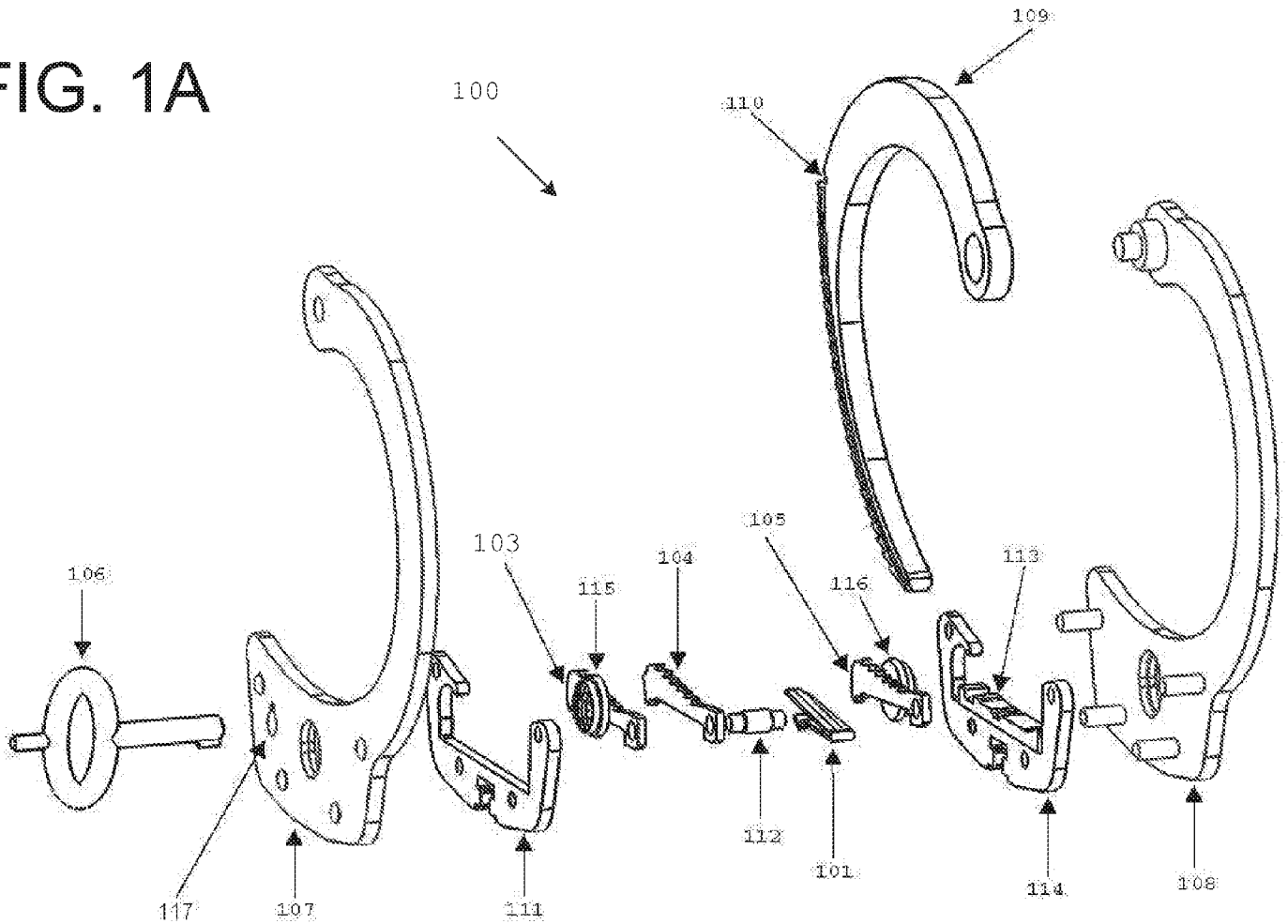
FIG. 1A shows an exploded view of the handcuffs of the first embodiment.

The present design is related to enhanced security handcuffs requiring more than a single handed manipulation to open the handcuffs while using a standard handcuff key. In certain instances two or even three hands are required to open the cuffs, typically including one hand that turns a standard handcuff key and at least one other hand that releases mechanical components on the handcuffs. Multiple and simultaneous processes may be necessary to unlock the handcuffs according to the current design.

Millions of people are arrested or detained by law enforcement agencies and related entities each year and are subsequently handcuffed in order to restrain their limbs to prevent escape and/or attack. The use of handcuffs is accepted as an effective restraint system and they are used by every major law enforcement agency in the world. The standard handcuff ratcheting design utilizing a universal handcuff key has been virtually unchanged for more than 100 years and is still in use around the world today. Handcuffs are a critical piece of law enforcement equipment and very few effective alternatives to standard handcuffs exist. Most law enforcement agencies purchase and utilize handcuffs which are similar in design and capability regardless of the manufacturer.

Law enforcement officers are typically trained in one-handed techniques to place handcuffs on a suspect's wrists and a two-handed operation to uncuff a suspect. A standard key is used for almost all handcuffs and is universal in that the same key can be used to open almost all sets of handcuffs regardless of manufacturer. Because handcuff keys are universal and millions exist, they are readily accessible to suspects and inmates restrained by handcuffs, creating a tremendous liability to law enforcement officers. This condition is exemplified in the event those under arrest or being detained are able to obtain or conceal a handcuff key and uncuff themselves. This danger extends to members of the public, and in some cases, prison inmates. A simple design enhancement can make standard handcuffs substantially more effective in their capability to restrain a wearer even if the wearer is in possession of a handcuff key, and such an improvement is the subject of the present design.

The enhanced security handcuffs according to the present design address a need for a more secure, "unpickable" handcuff. Over the years, manufacturers have attempted to improve upon the traditional handcuff design, typically seeking to create a more advanced key and corresponding locking mechanism. This route, however, has been largely unsuccessful. Rather than creating an improved key design, the Enhanced Security Handcuff concept requires a dual operation to simultaneously manipulate an enhanced locking mechanism while turning the universal handcuff key. This unique combination of locking mechanisms and process(es) adds increased security to the traditional design.

Although many of the variations herein discuss the use of a standard universal handcuff key, it should be noted the designs incorporated herein also apply to handcuffs and restraints employing specialized, propriety and high security keys and locking mechanisms. Such specialized locking mechanisms may also be utilized to employ the designs described herein.

The present design allows for handcuffs to be applied to a suspect with the use of only one hand; however, one aspect of the present design requires simultaneously employing two hands with opposable digits to unlock or open the handcuffs, often while additionally manipulating a handcuff key. This requirement makes it extremely unlikely for an individual who is wearing the handcuffs to unlock and/or open them. This is largely because the wearer of the handcuff has one hand locked in a position where it cannot be used to manipulate that handcuff in any way. As a result, this design, requiring that two free hands act separately and simultaneously to unlock the handcuffs, makes it extremely unlikely an individual will be able to unlock the handcuffs even if he or she is in possession of a handcuff key, shim, or other lock picking device.

This disclosure provides numerous disparate designs which increase the security level of the handcuffs and make it extremely difficult for a wearer to remove the restraints even if he or she is in possession of a handcuff key. These different designs can be incorporated into handcuffs as a single enhancement or, in certain instances, multiple design concepts can be combined together to increase security of the handcuffs even further. A handcuff design according to the present teachings can incorporate any combination of features and capabilities discussed herein in a set of handcuffs or in any other similar restraint systems.

As used herein, various terms are employed and are intended to be used in the broadest sense possible. For example, the present application uses the term "officer" or "law enforcement officer" or otherwise to indicate the individual employing the handcuffs or similar restraints, and as such the term is meant to broadly encompass any individual who may have use for such a device or system, including but not limited to police officers, military personnel, corrections officers, security personnel, or other interested individuals.

Additionally, the design of the handcuffs may differ from the exact configuration(s) described herein. With respect to restraints, the term "handcuffs" is intended broadly to mean any type of handcuffs, thumb cuffs, waist chains, leg irons and/or any other type of restraint designed to restrain a person's body part(s) to include but not limited to his or her hands, wrists, fingers, arms, legs, ankles, feet, waist, shoulders, neck or any other body part. These are collectively referred to henceforth as "handcuffs".

Further, certain designs and capabilities are described herein as being a single variation or capability while others are described as having multiple capabilities. It is understood that the invention is not limited solely to the configurations described but single or multiple configurations may be employed in a single restraint or handcuff respectively, as long as the functionality described is fully or in part incorporated. The foregoing and other concepts disclosed herein are intended to be interpreted broadly and not limit the scope of the present invention.

As used herein, the term "wearer" is synonymous with the term "suspect" or "individual" or any other similar term to convey someone to whom the handcuffs have been applied or a person whom the device is intended to restrain.

In the past, handcuff manufacturers have created handcuffs with different designs to enhance security. The predominant method has been to redesign the locking mechanism to use a more complicated and/or different key. Invariably, each system has been unsuccessful without significant acceptance or use. The requirement to utilize a "standard" universal handcuff key is critical from an operational effectiveness perspective. The use of a universal handcuff key enables peace officers, security officers and correctional officers to unlock handcuffs without having to identify which keys belong to which handcuff. Additionally, officers are thereby only required to carry one handcuff key, as opposed to multiple keys belonging to various disparate restraint systems.

Each of the variations described below utilize a traditional handcuff key, which is universally available and standardized. In certain instances, if desired, the handcuffs of the present design may employ specialized and proprietary key and locking systems to increase their effectiveness. Such handcuffs may also incorporate multiple design features discussed herein.

Each variation of the handcuff design herein incorporates the ability of the handcuffs to be "double locked", similar to a traditional handcuff, as an option to the officer or other law enforcement professional. The "double lock" feature enables the law enforcement officer to set a detent in the double lock bar of the handcuff preventing the single strand from ratcheting further between the double strands and tightening the handcuffs. A suspect wearing handcuffs that have not been double locked may inadvertently tighten the handcuffs leading to pain and discomfort. Worse, a suspect may intentionally attempt to tighten the handcuffs in order to facilitate some means of escape, or to persuade the law enforcement professional to loosen the cuffs or uncuff the suspect, thereby forcing a potential situation posing high risk and potentially high liability.

All drawings, schematics or other visual depictions in these designs encompass a set of handcuffs working in unison to secure one or more appendages of a wearer. In some drawings, only a single unconnected handcuff is depicted. A second handcuff is not depicted in some drawings for clarity and simplicity reasons. Actual designs will normally encompass at least two separate handcuffs connected via one or more of several available methods such as a metal chain, links, roller chain, clasps, hinges, solid bar or any other method. At least one, or in many cases, both of the individual cuffs employ the designs depicted herein.

Figure 1B:
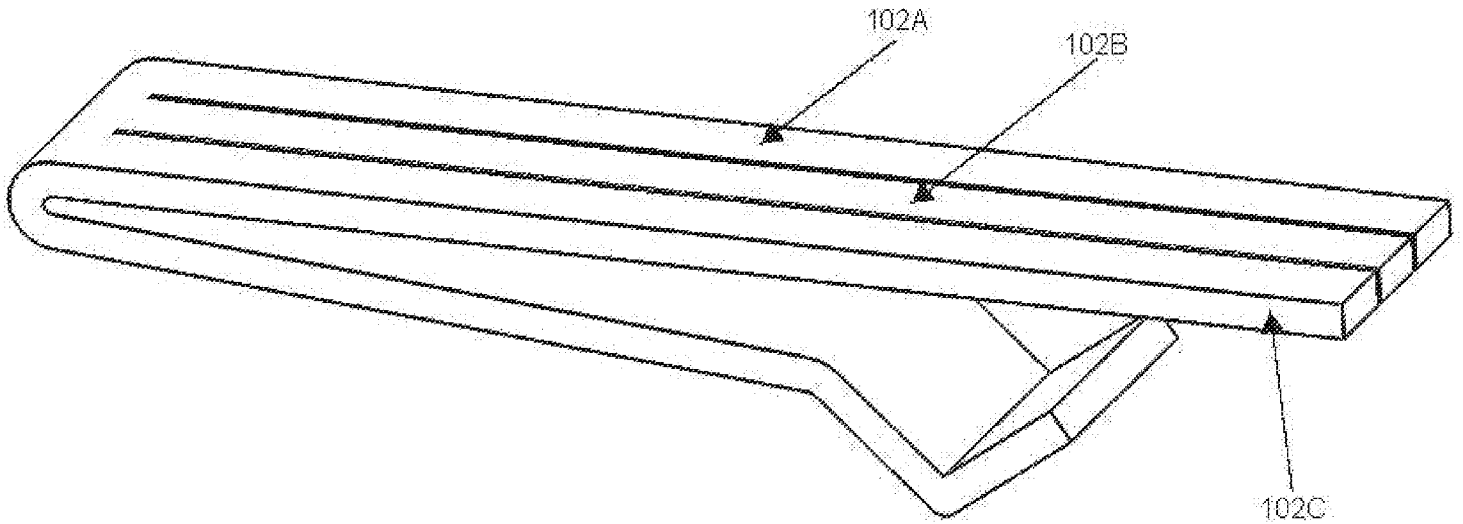
FIG. 1B illustrates the triple tang spring.

A first variation of the present design is illustrated in FIG. 1A. From FIG. 1A, the handcuffs 100 may utilize a triple tab spring 101. FIG. 1B shows the triple tab spring 101 in detail, with three individual portions 102A, 102B, and 102C on the upper part of triple tab spring 101. Each of the three portions of the segmented triple tab spring 101 engage with three individual pawls positioned next to each other, shown as first lock bar button pawl 103, lock bar key pawl 104, and second lock bar button pawl 105. The triple tab spring 101 exerts pressure upwards individually into each of the lock bar pawls which lock into ratchet teeth 110 of single strand bow 109.

Also shown in FIG. 1A are various handcuff components, including the universal handcuff key 106, first double strand 107, second double strand 108, single strand bow 109, bow track 110, mid plate 111, pawl pivot pin 112, keyhole 117 and double lock bar 113 sitting within mid plate 114.

Each of the outer lock bar pawls, first lock bar button pawl 103 and second lock bar button pawl 105, has a button attached to the center outer portion of the outer bar pawl. First button 115 and second button 116 are shown on first lock bar button pawl 103 and second lock bar button pawl 105, respectively. The buttons may be affixed to the outer bar pawls via any number of methods, including glue, welding, screws, pins, and so forth. In another iteration of the design, the lock bar pawl or pawls, such as lock bar key pawl 104, may be manufactured with a button. In such a case, the pawl with incorporated button may be one solid piece of metal or other material thus providing rigidity and increased strength.

The outer lock bar pawls 103 and 105 in this embodiment incorporate a set of recessed/concaved pull down buttons 115 and 116 that require a two handed manipulation to release the cuffs. In this variation of the design, two button pawls 103 and 105 are added to traditional single key pawl 104, all positioned on a triple tab spring 101, requiring that all three pawls 103, 104, and 105 be disengaged simultaneously from the teeth 110 of the first strand 109 in order to release the handcuff.

Figure 1C:
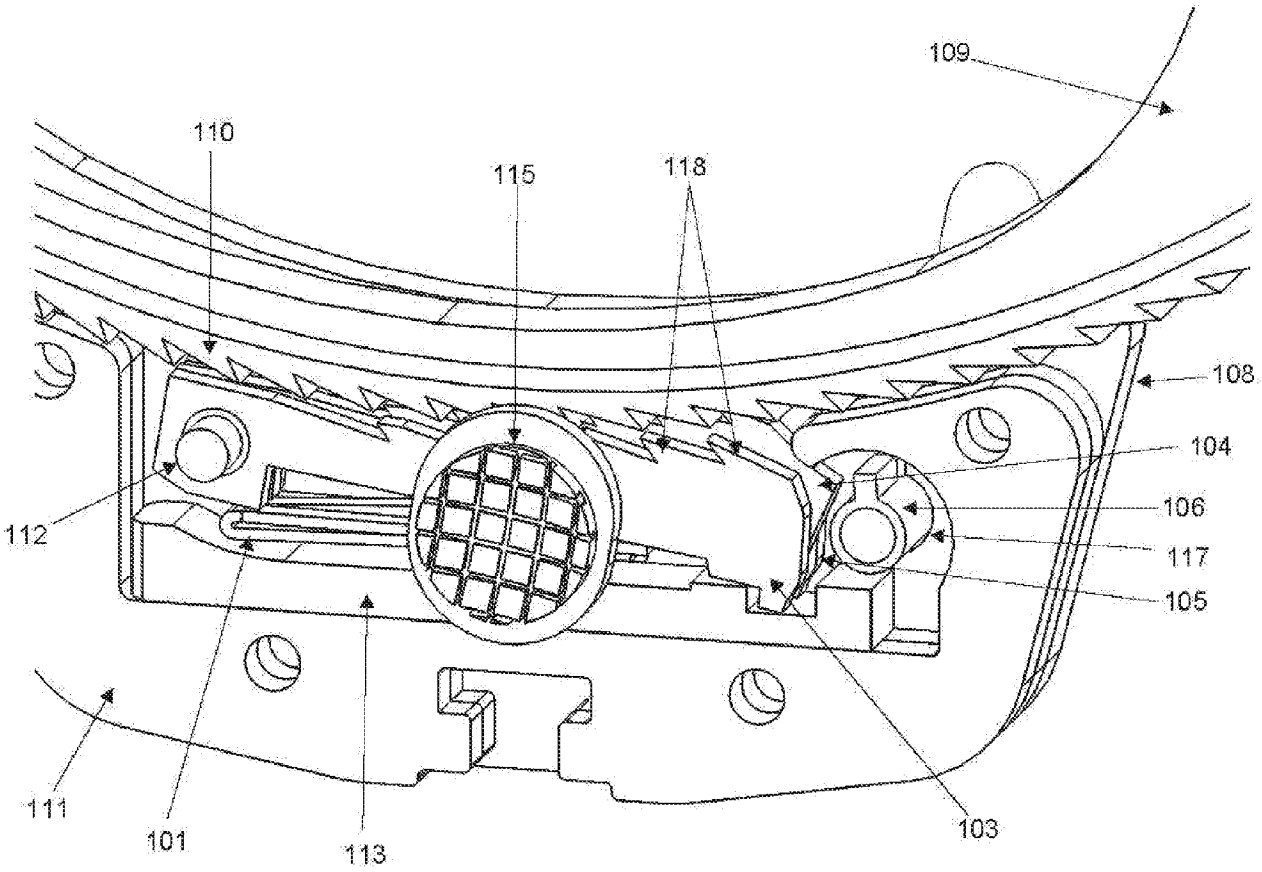
FIG. 1C shows button pawl disengaged while the key pawl remains engaged with the ratchet teeth.

A close view of the assembled version of handcuffs 100 is shown in FIG. 1C. In this variation, two recessed pull down buttons, including button 115 in this view, located on either sides of the cuff connect to and thereby control the two outer button pawls, first lock bar button pawl 103 and second lock bar button pawl 105, positioned above or on triple tab spring 101, contained within the double strands of handcuffs 100. Each recessed pull down button controls a single button pawl, such as first button 115 controlling first lock bar button pawl 103 in this view. When manually pulled or depressed toward the handcuff chain, teeth 118 of the button pawls are disengaged from teeth 110 of the single strand bow 109. When each recessed pull down button, such as first button 115 and 116, are pulled toward the chain linking the pair of handcuffs, the first lock bar button pawl 103 and second lock bar button pawl 105, separately but simultaneously disengage from the teeth of the single strand.

This two handed operation then further requires that a traditional handcuff key 106 be inserted into the key hole 117 located on the double strand 107 using a different hand and turned, while simultaneously depressing the recessed pull down buttons 115 and 116 with the first hand to disengage the button pawls 103 and 105, thereby disengaging the third of the three pawls, the key pawl 104, from the single strand. Only when all three pawls 103, 104, and 105 are simultaneously disengaged from the ratchet teeth 110 is the single strand bow 109 released and therefore able to open.

Due to the design of triple tab spring 101, constant individual pressure is continuously applied by spring 101, upwards into each of three individual pawls 103, 104, and 105. If at any point, pressure is released from the handcuff key 106 or either of two buttons 115 and 116, each of the pawls individually reengages ratchet teeth 110 thereby relocking the handcuffs and preventing them from being opened.

The requirement for two separate hands to be utilized to simultaneously manipulate the handcuff key 106 and both lock bar button pawls 115 and 116 makes it extremely difficult for the wearer of the handcuffs to free him or herself, even if he or she is in possession of a handcuff key 106. This system increases the security features of the handcuffs, as it requires two separate but simultaneous actions, each requiring hands with opposable digits.

Figure 1D:
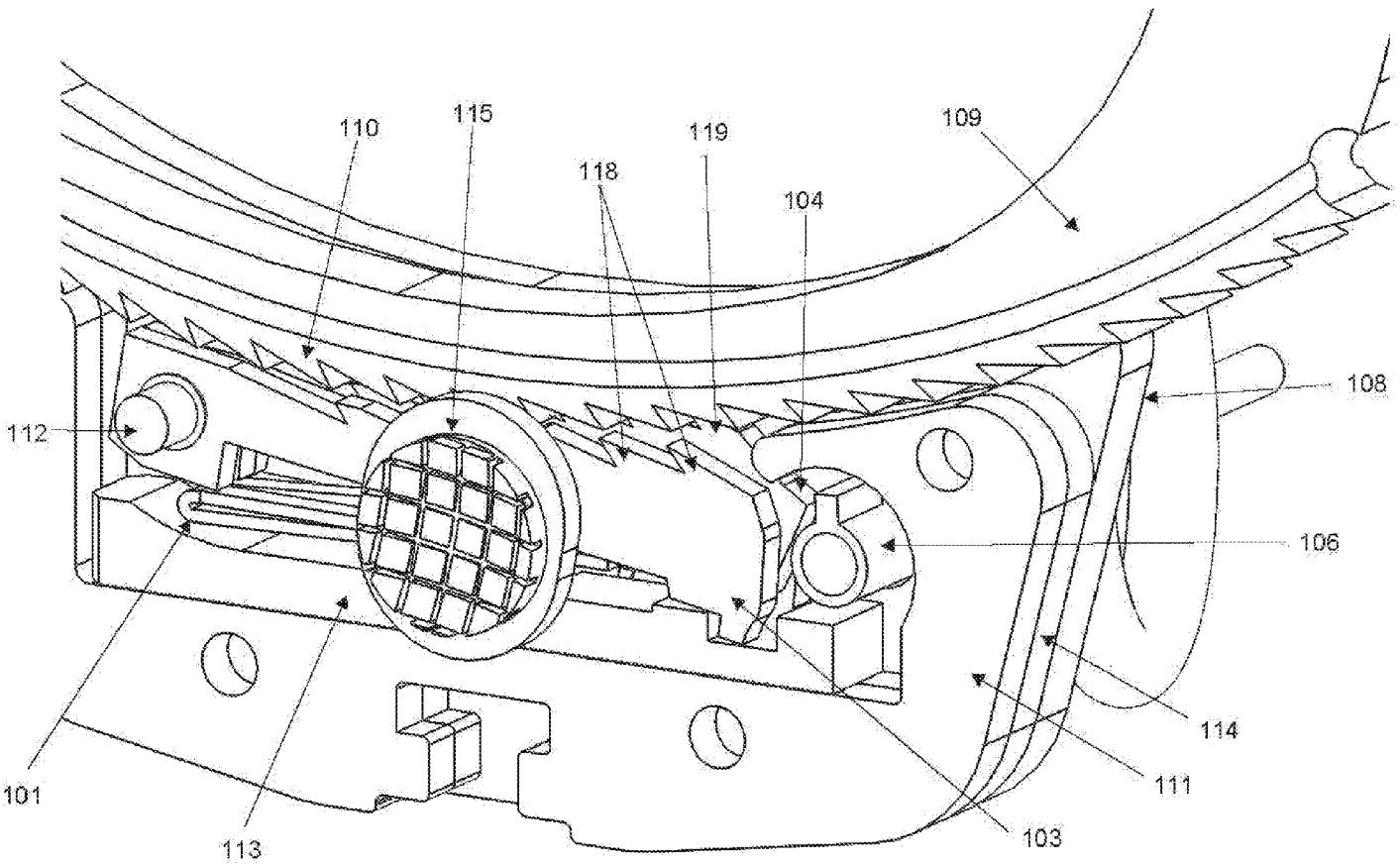
FIG. 1D provides a second view showing the button pawl disengaged while the key pawl remains engaged with the ratchet teeth.
Figure 1E:
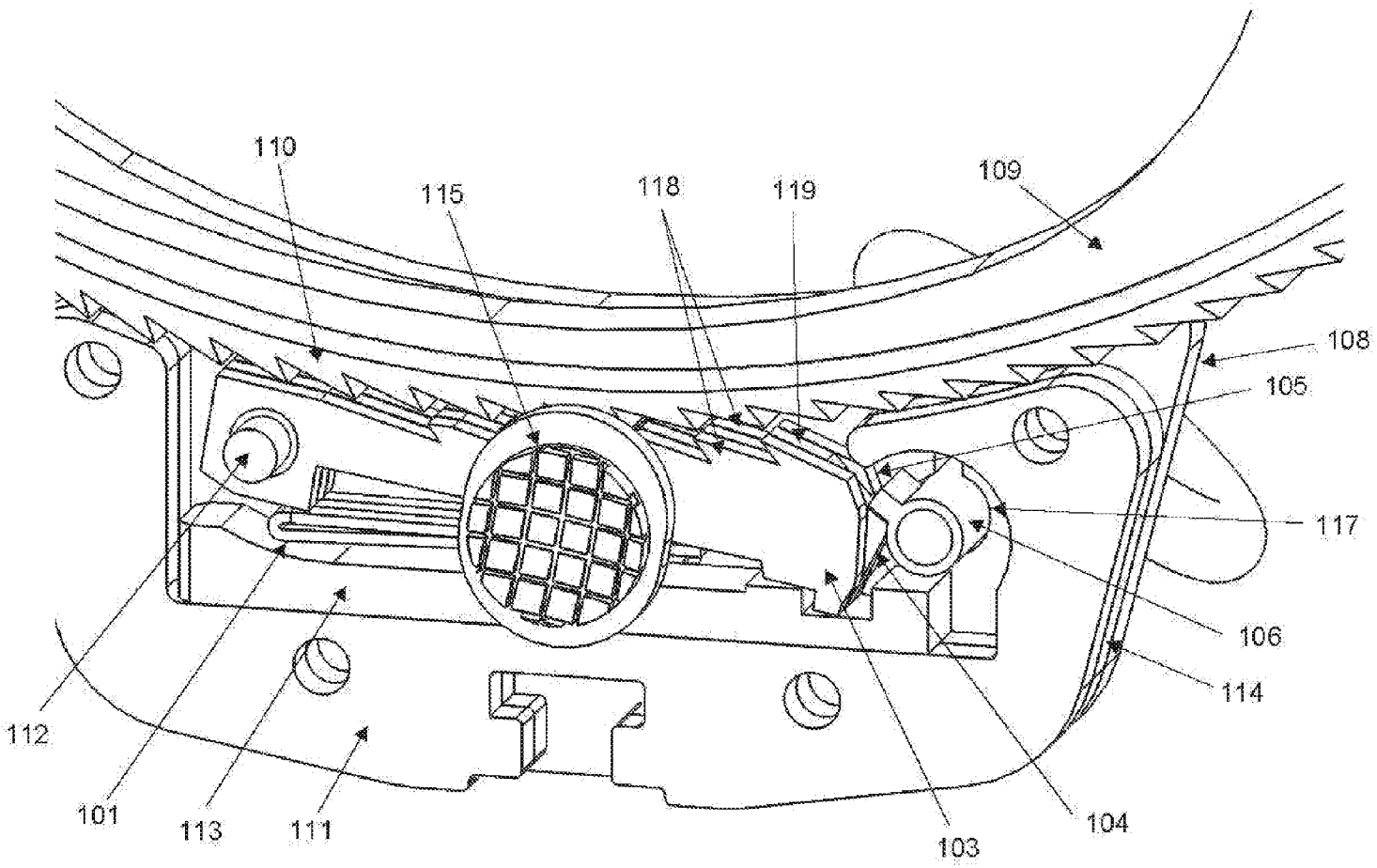
FIG. 1E illustrates all three pawls retracted and disengaged from the single strand ratchet teeth.

FIG. 1D shows an alternate view of this embodiment with handcuff key 106 inserted but not turned, teeth 119 of key pawl 104 engaged with teeth 110 single strand bow 109, and teeth 118 of first lock bar button pawl 103 disengaged from teeth 110. FIG. 1E shows handcuff key 106 turned, and both buttons including button 115 pulled/pushed downward in this view, enabling release of single strand bow 109.

Figure 2A:
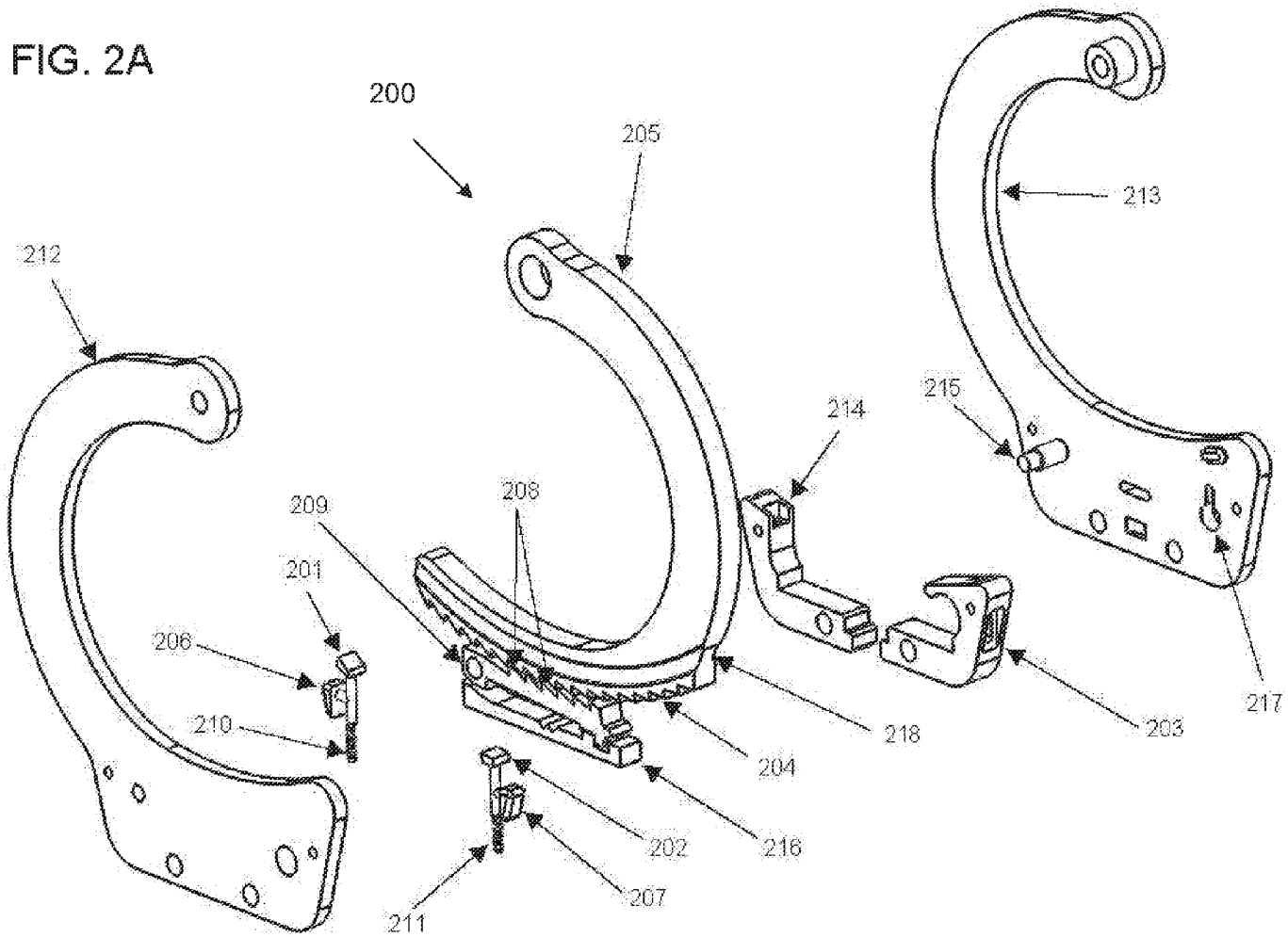
FIG. 2A illustrates an exploded view of a second embodiment.

A second variation of the design is presented in FIG. 2A. In this embodiment, two independent "side pawls" 201 and 202 are located on the outer edges of the handcuffs 200. These side pawls 201 and 202 are controlled by buttons located at either end of first mid plate 203, which sit perpendicular to the teeth 204 of the single strand 205 in such a way as engage with teeth 204 of single strand 205 to prevent movement of single strand 205 when in a locked position. These side pawls 201 and 202 act in a capacity similar to pawls located inside the handcuffs, such as is shown in the handcuffs 100 of FIG. 1A, and are under spring pressure 210 and 211 forcing them upward into the single strand ratchet teeth 204.

Figure 2B:
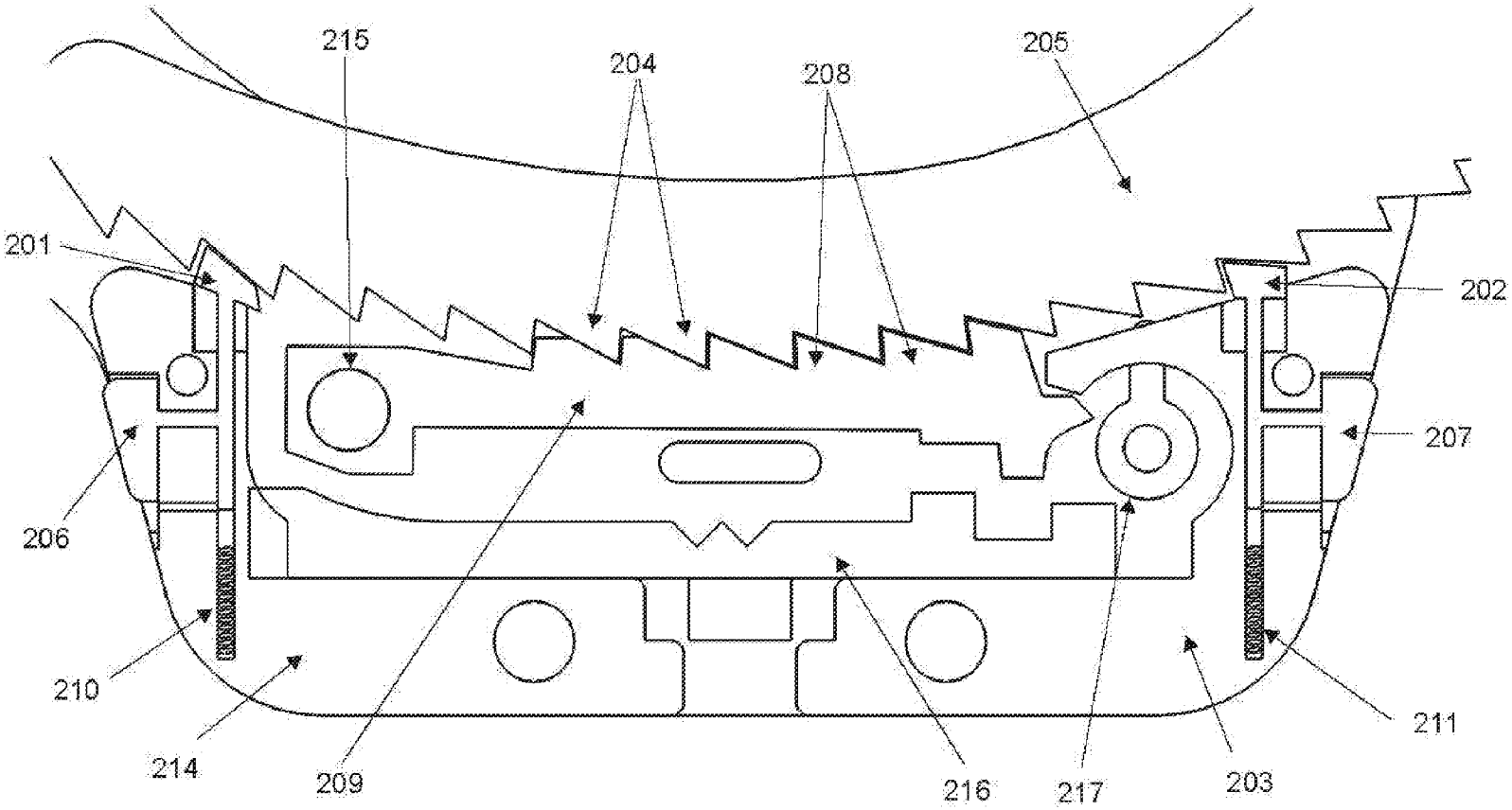
FIG. 2B shows the key pawl and the side pawls engaged with the single strand ratchet according to the second embodiment.

Also shown in FIG. 2A are various cuff components, including first double strand 212, second double strand 213, single strand bow 218, second mid plate 214, pawl pivot pin 215, double lock bar 216, keyhole 217 located in the second double strand 213, and single strand bow 218. FIG. 2B depicts teeth 208 of key pawl 209 engaged with the teeth 204 of single strand 205. Additionally, teeth 201 and 202 of the side pawls are also engaged with teeth 204 of single strand 205.

In this embodiment of the design, in order to disengage each side pawls 201 and 202 from teeth 204 of single strand 205, each button 206 and 207 located on either end of mid plate 203 and 214, separately and independently control a single side pawl 201 and 202 and must be pulled down or depressed simultaneously in order to release teeth 201 and 202 of the single side pawl(s) from teeth 204 of the single strand 205. As a depicted in FIG. 2C, a handcuff key, not shown in this view, must simultaneously be inserted in keyhole 217 and turned in order to disengage teeth 208 of key pawl 209. Only when the teeth of each separate side pawl 201 and 202 and key pawl 209 are disengaged (separately and simultaneously) may the single strand 205 be released and the cuff therefore opened.

Figure 2C:
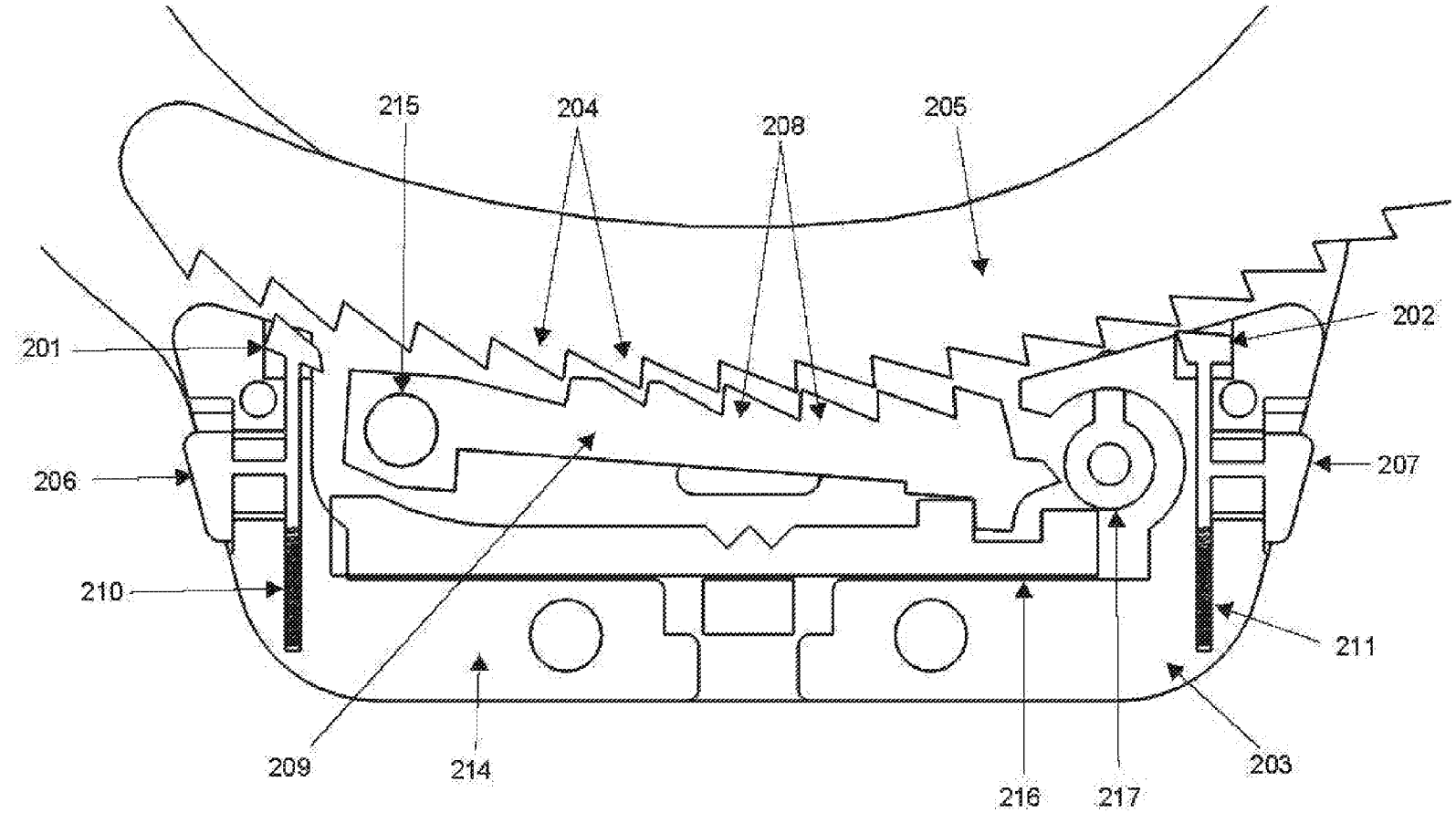
FIG. 2C illustrates the key pawl and the side pawls disengaged from the single strand ratchet.
Figure 2D:
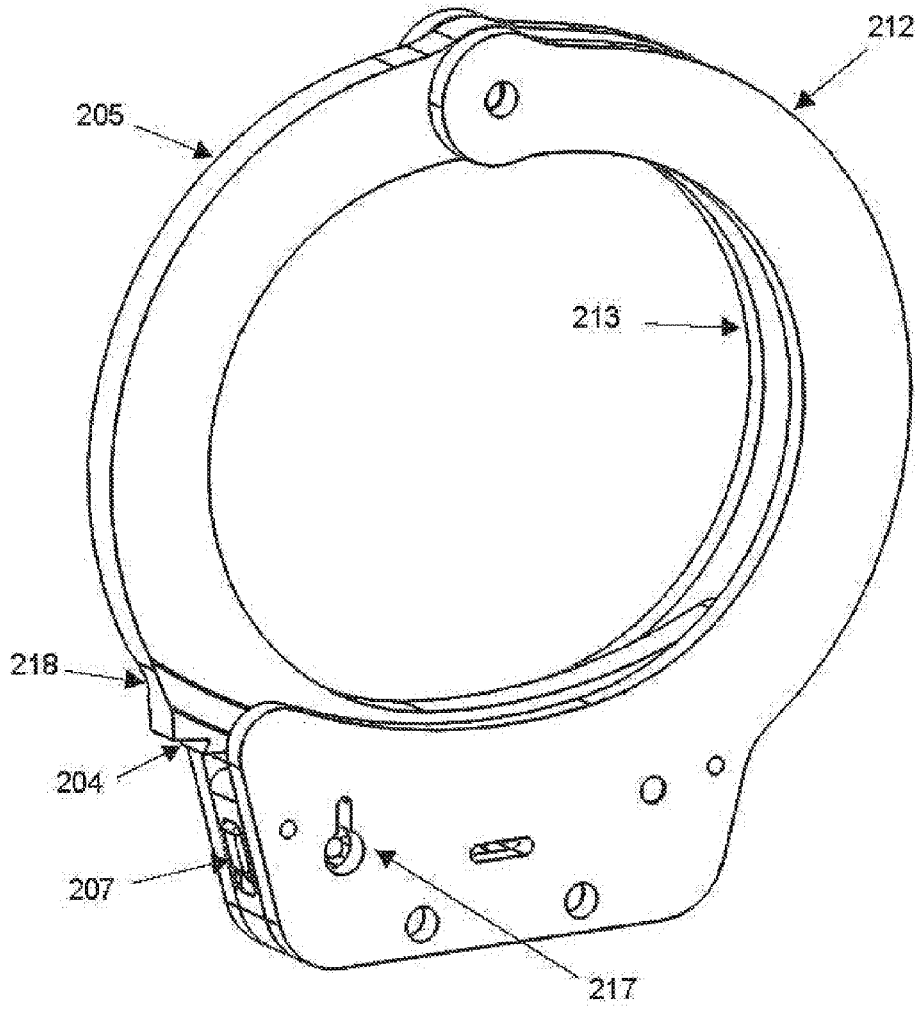
FIG. 2D shows the exterior of the handcuff according to the second embodiment.

As shown in FIG. 2D, this design maintains the traditional controls and functions of a handcuff while adding two additional pawls 201 and 202 and sliding buttons 206 and 207 on the sides of the handcuff. Side pawls 201 and 202 and associated respective buttons 206 and 207 may be manufactured in one piece to provide strength and rigidity or may be designed as separate components. The side pawls 201 and 202 are continuously pushed upwards under individual spring pressure from springs 210 and 211 located under the bodies of side pawls 201 and 202 as depicted in FIG. 2B. The springs 210 and 211 reside in small holes or reliefs built into the side plates 214 and 203 along with the side button assemblies 206 and 207.

The top of the side pawls 201 and 202, where they engage the ratchet teeth 204, may be provided such that the single strand 205 can only move in one direction, such as tightening, without the use of a handcuff key 217. The handcuffs in such a configuration may only be opened or loosened if the key pawl 209 and the side pawls 201 and 202 are simultaneously disengaged from the single strand 205 teeth 204 as depicted in FIG. 2C.

This two handed operation, requiring opposable digits on two different hands, makes it extraordinarily difficult if not impossible for the wearer of the handcuffs to open the handcuffs even with the use of a handcuff key. This is largely because one hand of the wearer of the handcuff is incapacitated by the handcuff leaving only one hand to manipulate the locking mechanism of the handcuff.

Figure 3A:
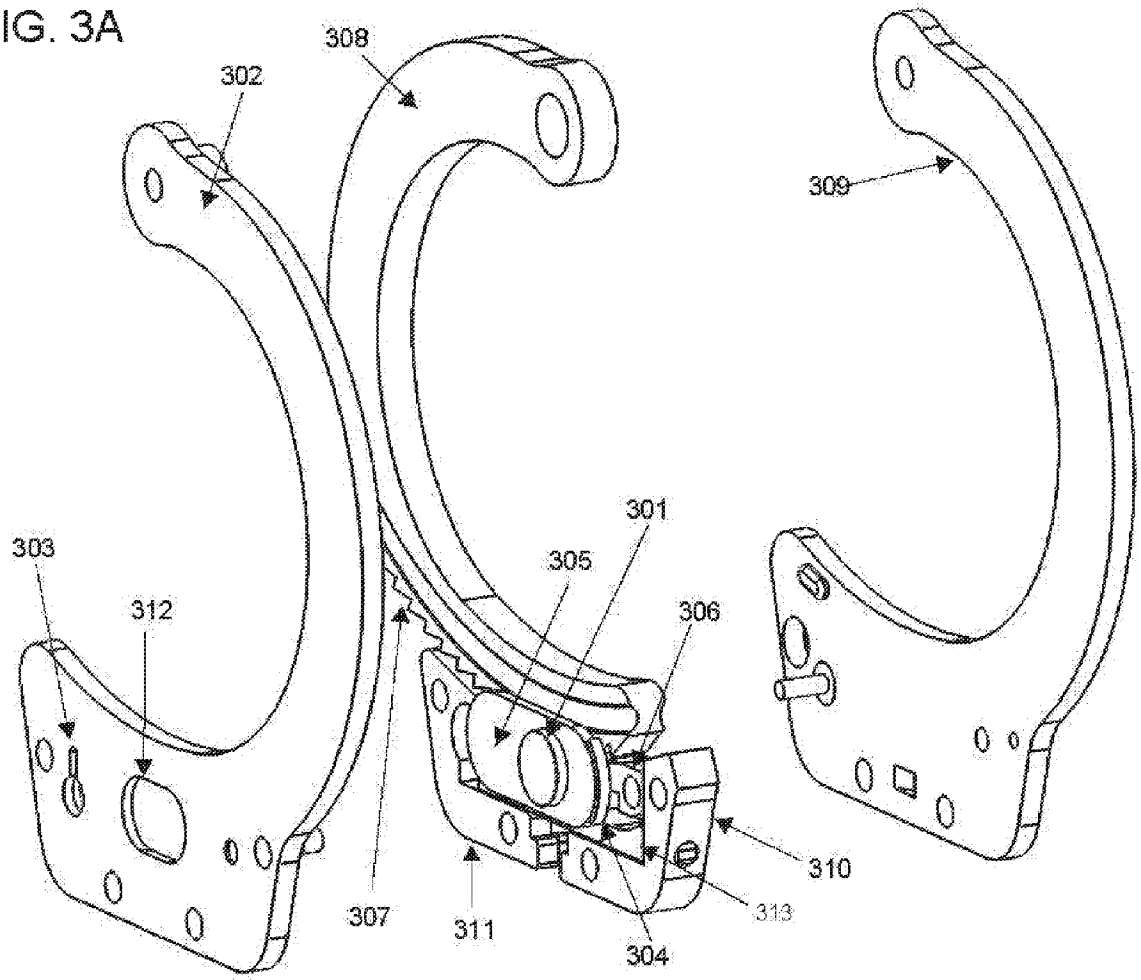
FIG. 3A shows an exploded view of a third embodiment.
Figure 3B:
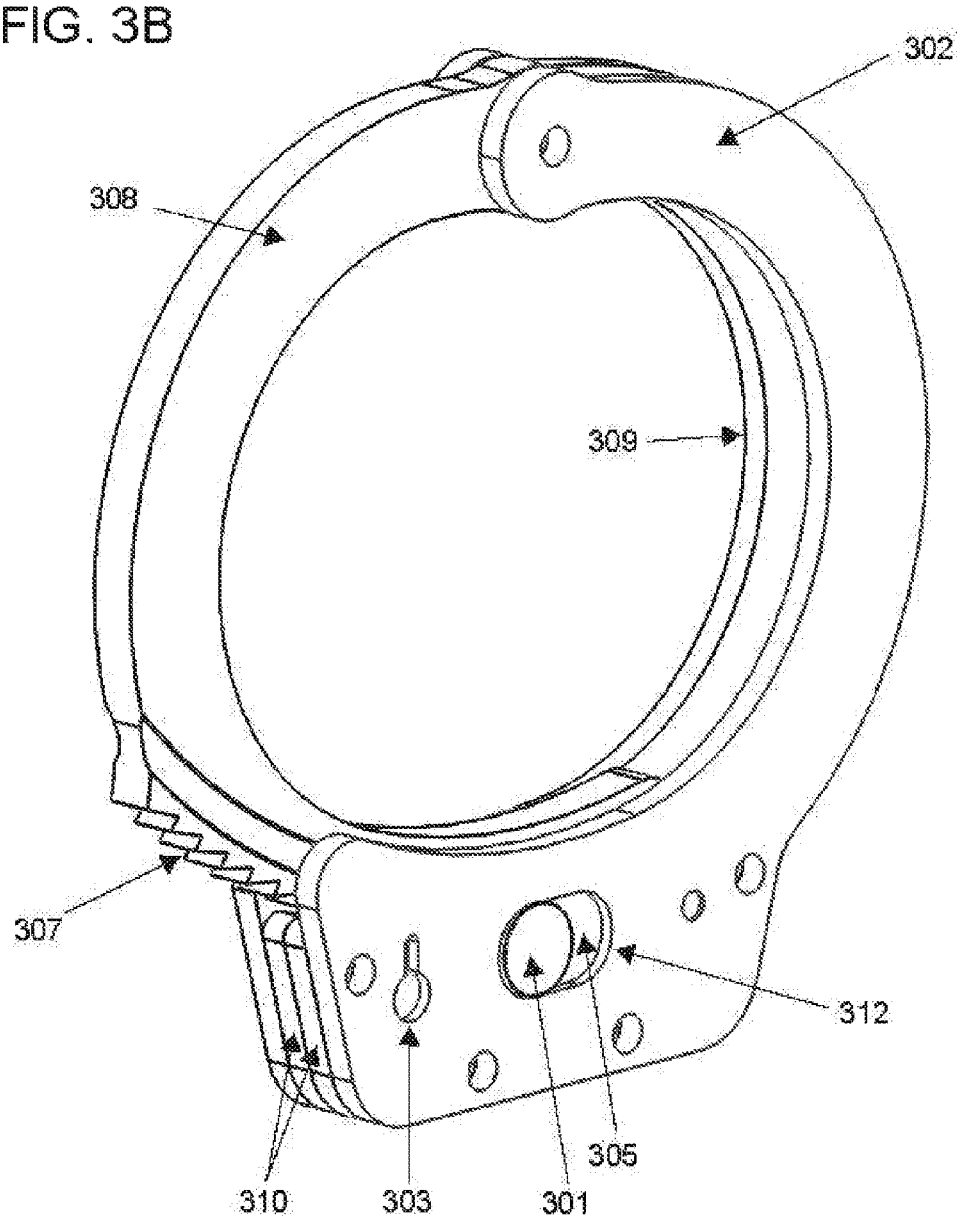
FIG. 3B is an outside view of a handcuff according to the third embodiment.

A third variation of the design is presented in FIG. 3A. In this variation of the design, a sliding keyhole block button 301 is positioned on the double strand 302 next to and on the same side as the keyhole 303. The sliding keyhole block button 301, has a concave surface and fits inside an opening 312 in the first double strand 302. The concave surface of the button 301 ensures the button 301 cannot be activated by side pressure on the outside of the double strand. As presented in FIG. 3B, the outward appearance of the handcuff is consistent with the basic design configuration of most commercial handcuffs with the visible exception of sliding button 310 and related components. FIG. 3B depicts the handcuff in its normal state whereby button 301 is held under spring pressure in proximity to keyhole 303.

Figure 3C:
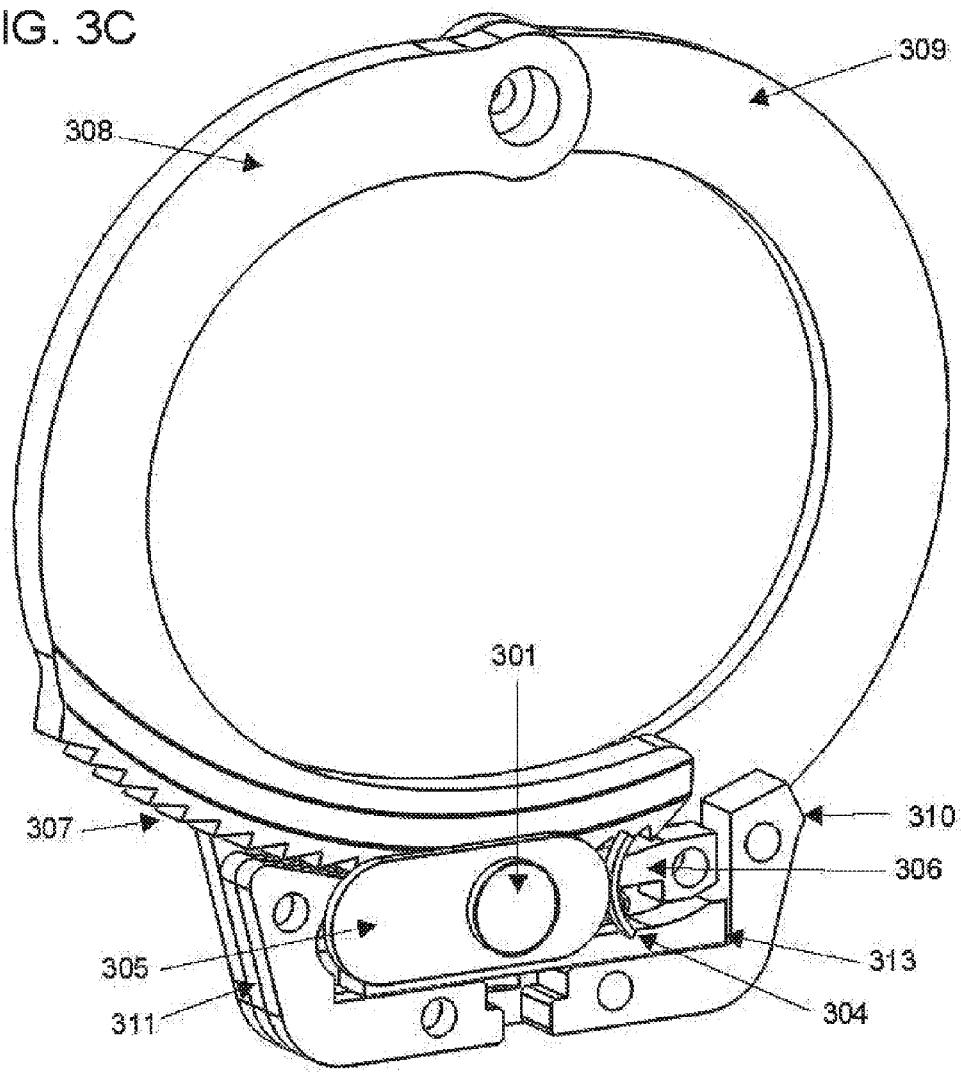
FIG. 3C shows an interior view of a handcuff where a plate bocks the keyhole on the same side as the keyhole.

As depicted in FIG. 3C, the sliding button 301 is held under pressure by a small spring 304. The spring 304 provides positive pressure on the button 301 in a direction towards keyhole 303. This provides a condition whereby the natural state of the sliding keyhole block button 301 is in the closed position thereby covering the keyhole 303 as shown in FIG. 3B and FIG. 3C. This configuration prevents a person from placing a universal handcuff key (not shown) inside the keyhole 303 unless sliding keyhole block button 301 and attached cover 305 have first been retracted.

The keyhole block button 301 includes a plate 305 acting in the capacity of a keyhole cover. The keyhole cover 305 and keyhole block button 301 may be designed as a one-piece design or two pieces bonded together to form a single unit.

Figure 3D:
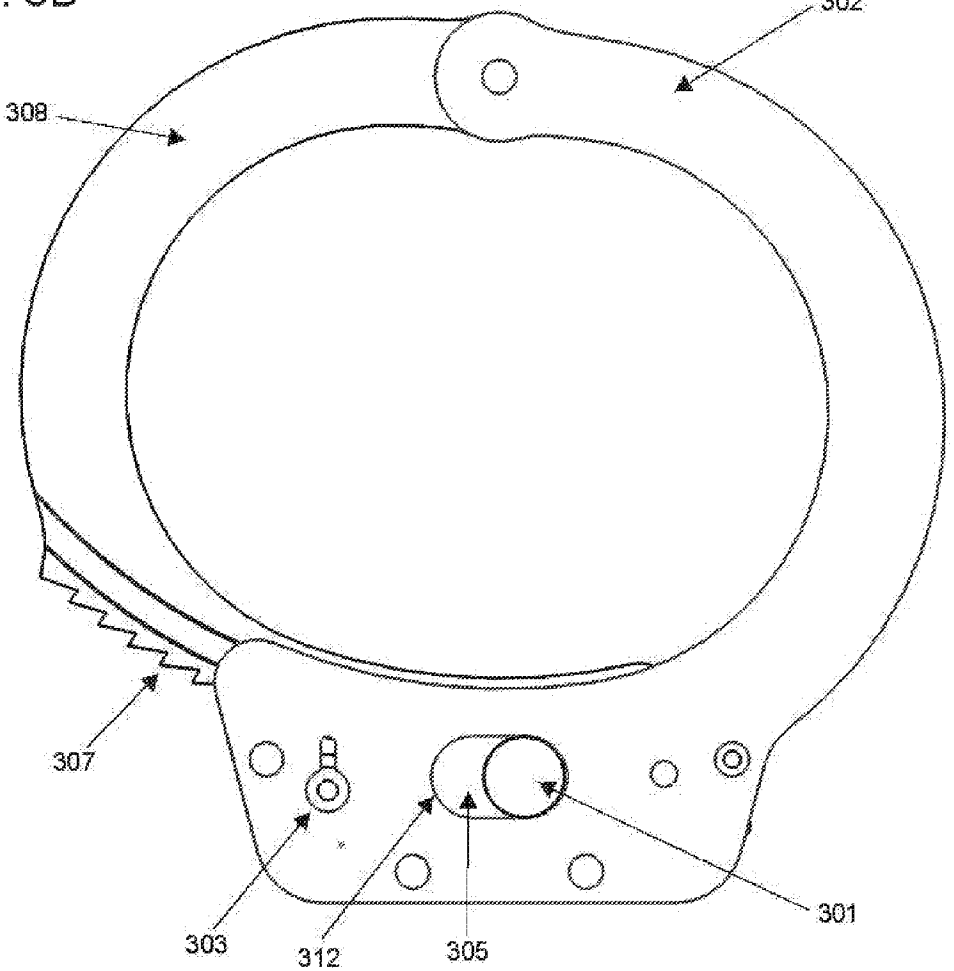
FIG. 3D shows an exterior view of the handcuff where the button is retracted exposing the keyhole according to the third embodiment.
Figure 3E:
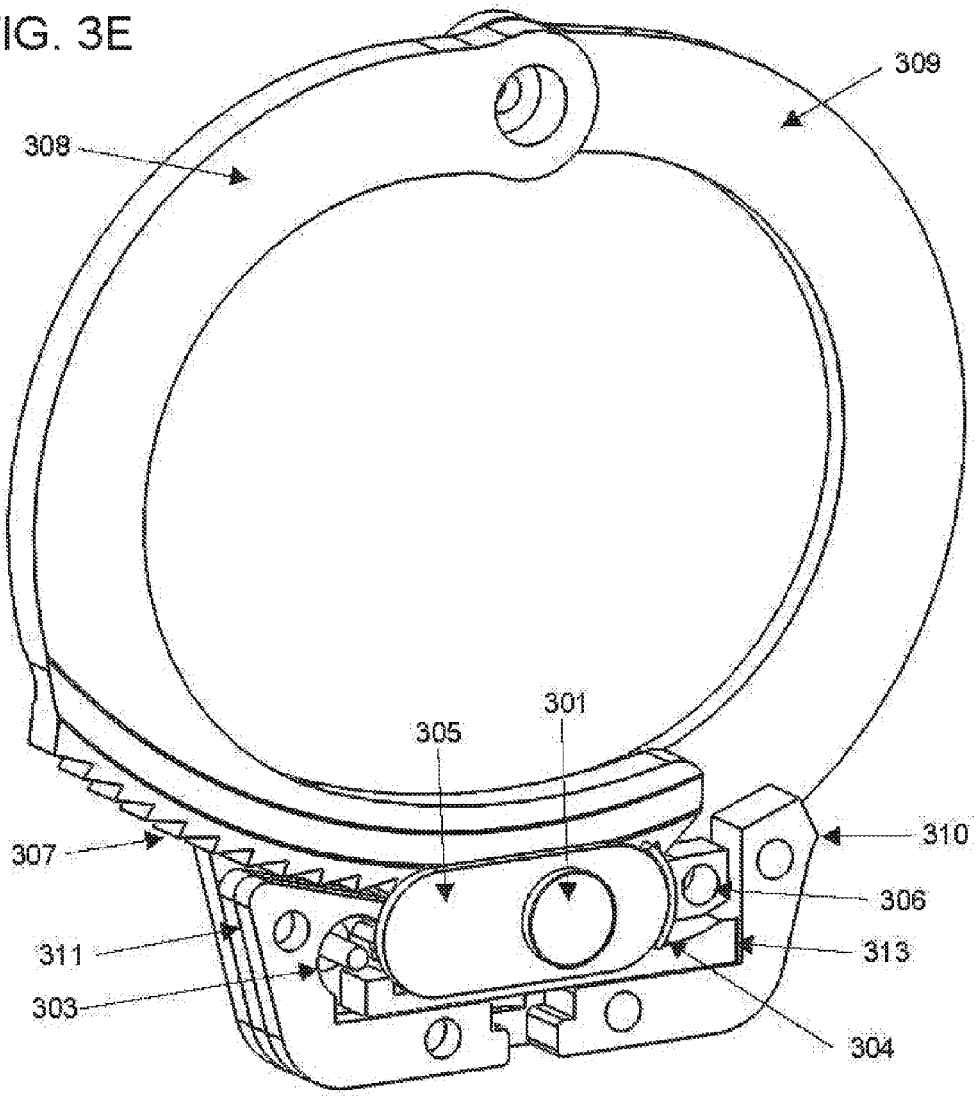
FIG. 3E shows an interior of the handcuff where the button is retracted exposing the keyhole.

This embodiment prevents access to the keyhole 303 located on double strand 302 of the handcuff, requiring that sliding keyhole block button 301 first be pulled in a direction away from the keyhole 303, sliding open the door 305 and providing access to the keyhole 303 as depicted in FIG. 3D. The sliding keyhole block button 301 would be contained within the double strand 302, next to the keyhole 303. As shown in FIG. 3D, this design requires one hand to open the door 305 of sliding keyhole block button 301, thereby exposing opening 303 for the insertion of the universal handcuff key (not shown in this view), and allowing for insertion and rotation of the key to disengage the teeth of the key pawl 306 from the teeth 307 of the single strand 308, thereby opening the cuff. In a normal position, the keyhole 303 of the handcuff is blocked by door 305 controlled by the sliding keyhole block button 301, thereby preventing access to keyhole 303. Also shown in FIG. 3A are various handcuff components, including a second double strand 309 and two mid plates 310 and 311.

Figure 4A:
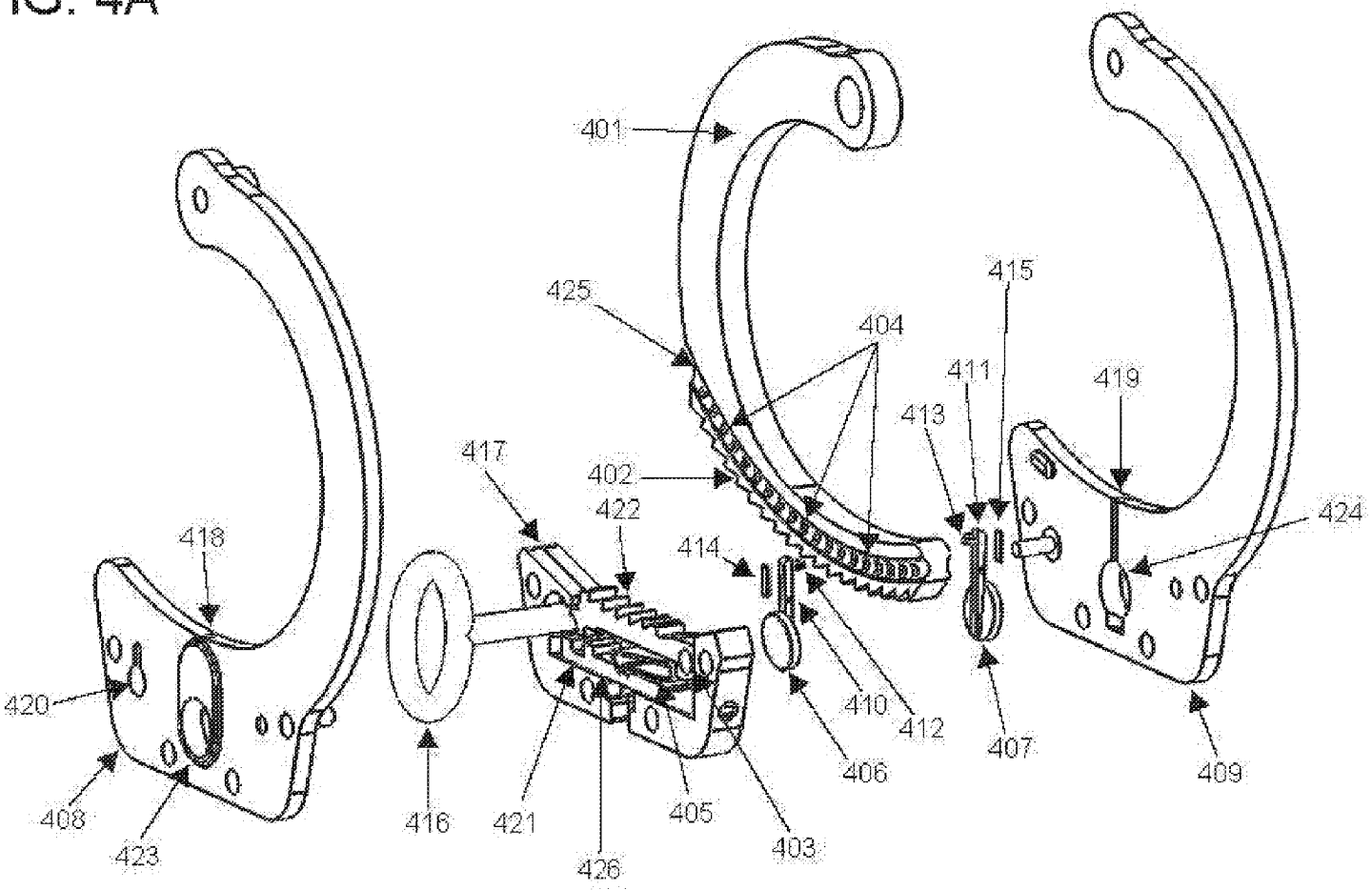
FIG. 4A illustrates an exploded view of a fourth embodiment.

This two handed operation, requiring opposable digits on two hands, would make it extremely difficult if not impossible to achieve by the wearer of the handcuff. This is largely because one hand of the wearer of the handcuff is incapacitated by the handcuff leaving only one hand to manipulate the locking mechanism of the handcuff. A fourth embodiment of the design is presented in FIG. 4A. The standard handcuff is manufactured with a single strand 401 with (male) ratchet teeth 402 protruding on the outer edge of the single strand bow 425. These ratchet teeth 402 engage with the teeth 422 of the key pawl(s) 403 in order to lock the handcuffs and allow the handcuffs to freely travel in only one direction (tighten) unless a handcuff key 416 is utilized to unlock them. In this embodiment, (female) ratchet indentations 404 are formed into the side edges of single strand bow 425 of single strand 401. The indentations 404 may match the density and frequency of ratchet teeth 402 on single strand bow 425. The outer ratchet teeth 402 are engaged by teeth 422 of the key pawl(s) 403 located in the center of the handcuffs whereby a spring 405 places constant upwards pressure on the key pawl 403 into outer ratchet teeth 402 of single strand 401.

Figure 4B:
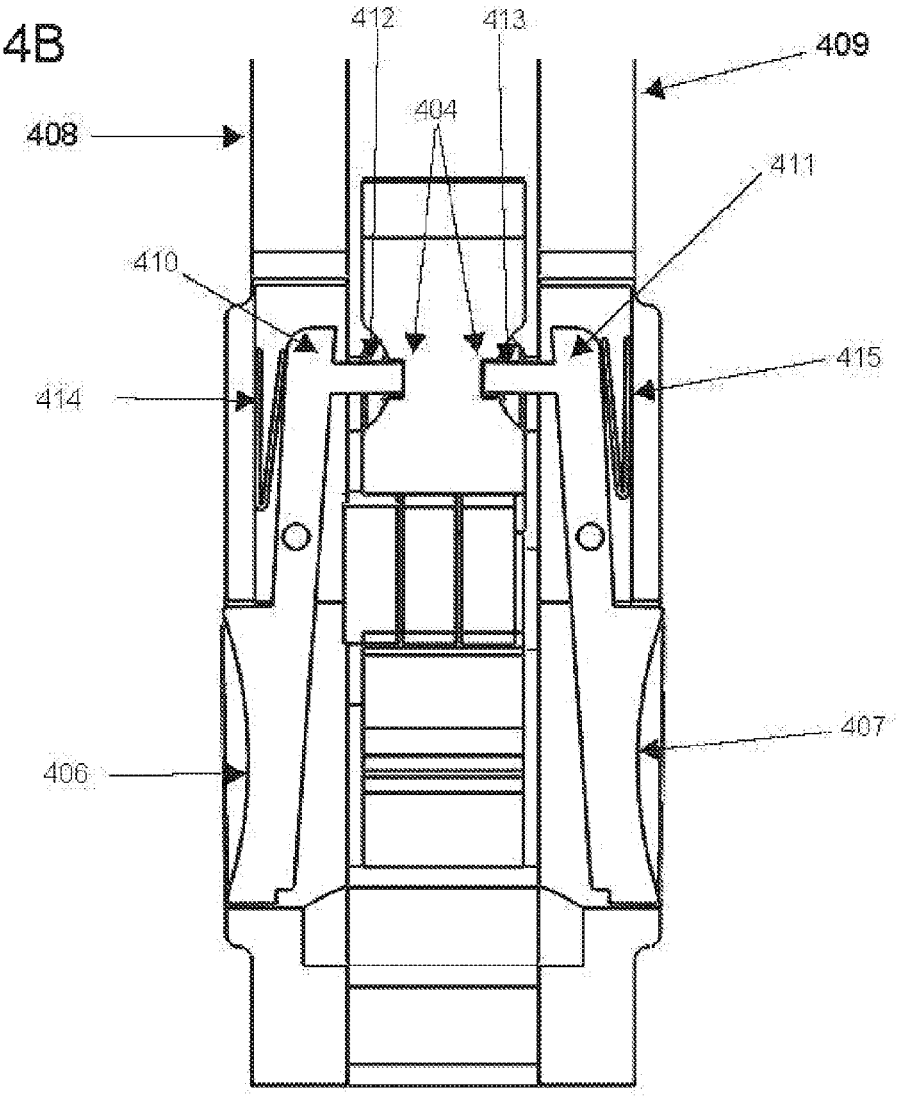
FIG. 4B shows the buttons in a normal resting position with the extensions engaging a number of indentations.

From FIG. 4B, the ratchet (female) indentions 404 are located at opposing sides and ninety-degree angles along the outer edges of bow 425 of single strand 401. Two squeeze buttons 406 and 407 are located on both sides of outer double strand 408 and 409 of the handcuffs and protrude through two holes 423 and 424 in the double strands 408 and 409. These buttons 406 and 407 have a concave surface to prevent external pressure on the double strands 408 and 409 from inadvertently depressing them. On the back of these buttons 406 and 407 are small extensions 410 and 411 with a (male) ratchet 412 and 413 interface. The button(s) 406 and 407 are held in place by double strand housing 408 and 409 and a pin (not shown) or other type of fulcrum is used to provide the ability for this part to pivot back and forth (into and out from the handcuff).

Figure 4C:
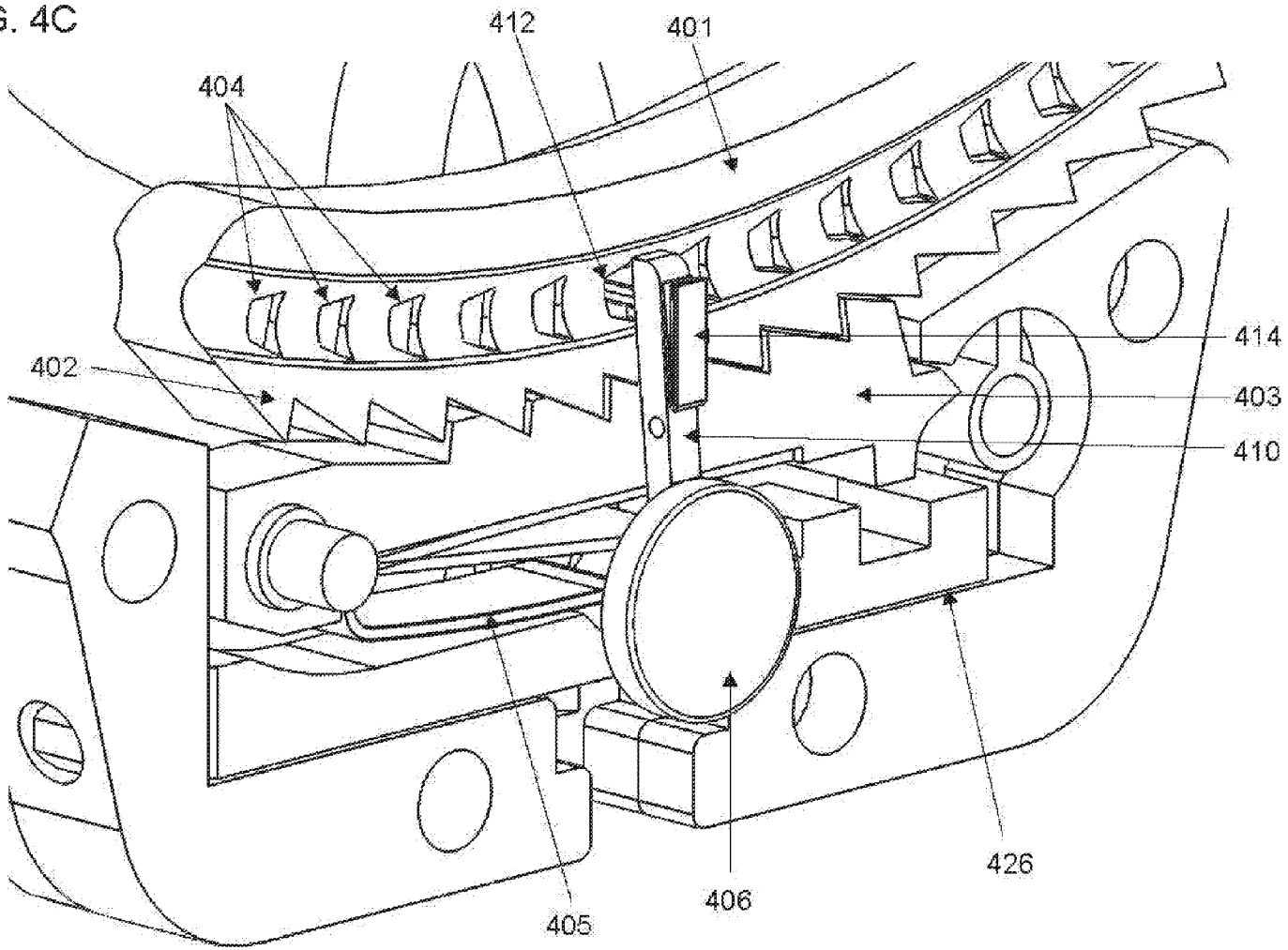
FIG. 4C is another view according to the fourth embodiment with extensions engaging the indentations.

The top of the button extension arms 410 and 411 interface using a small spring(s) 414 and 415, providing positive pressure inward onto the outer edge of single strand ratchet 401 indentations 404 as depicted in FIG. 4C. The shape of ratchet indentations 404 and corresponding button ratchet interface 412 and 413 mirror the style and concept as exhibited by teeth 402 of single strand ratchet 401. This allows the handcuffs to freely move in one direction (tighten only) without the use of a key. A universal handcuff key 416 is required to unlock or reverse the direction of the moving single strand 401.

A common handcuff lock picking technique employs a shim comprised of a thin piece of metal, plastic or other material pushed into rear channel 417 of the handcuffs between ratchet teeth 402 and the key pawl teeth 422. This handcuff countermeasure is extremely effective and can rapidly unlock/open a pair of handcuffs without the use of a handcuff key 416.

Defeating the present design may require the use of three simultaneous shims to open the handcuffs in the manner described above. The three shims would need to be simultaneously used on single strand ratchet teeth 402 and both sides of the single strands at ratchet indentions 404 of the bow 425 to open the handcuffs.

When the two squeeze buttons 406 and 407 are resting (not depressed), they engage with corresponding indentations 404 on the sides of the single strand 401 to prevent movement of the single strand 401 backwards which could loosen the handcuffs. The single strand 401 can still tighten without the use of a handcuff key 416, a capability common with most handcuffs.

Figure 4D:
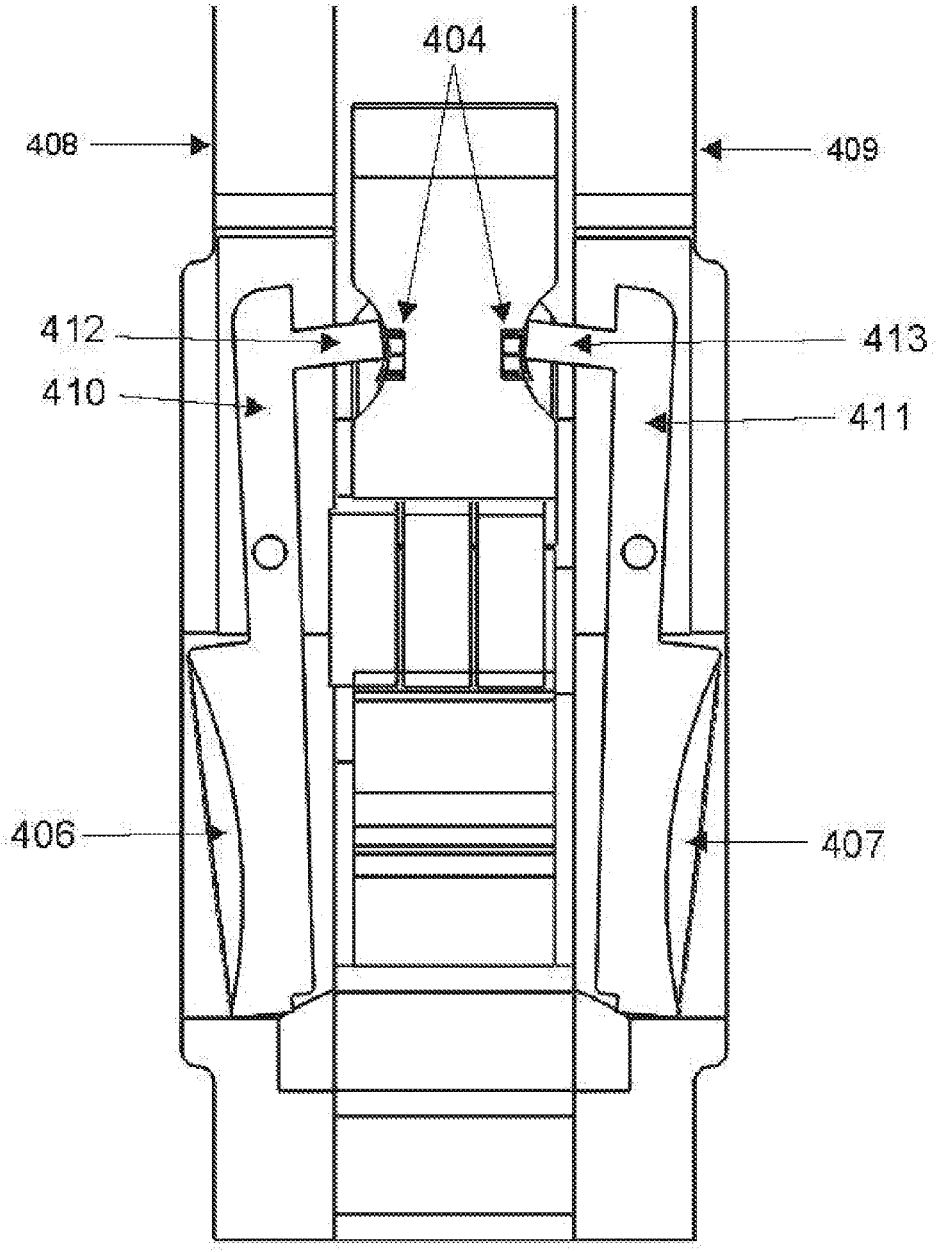
FIG. 4D shows the buttons being depressed and the extensions retracted from the indentations.
Figure 4E:
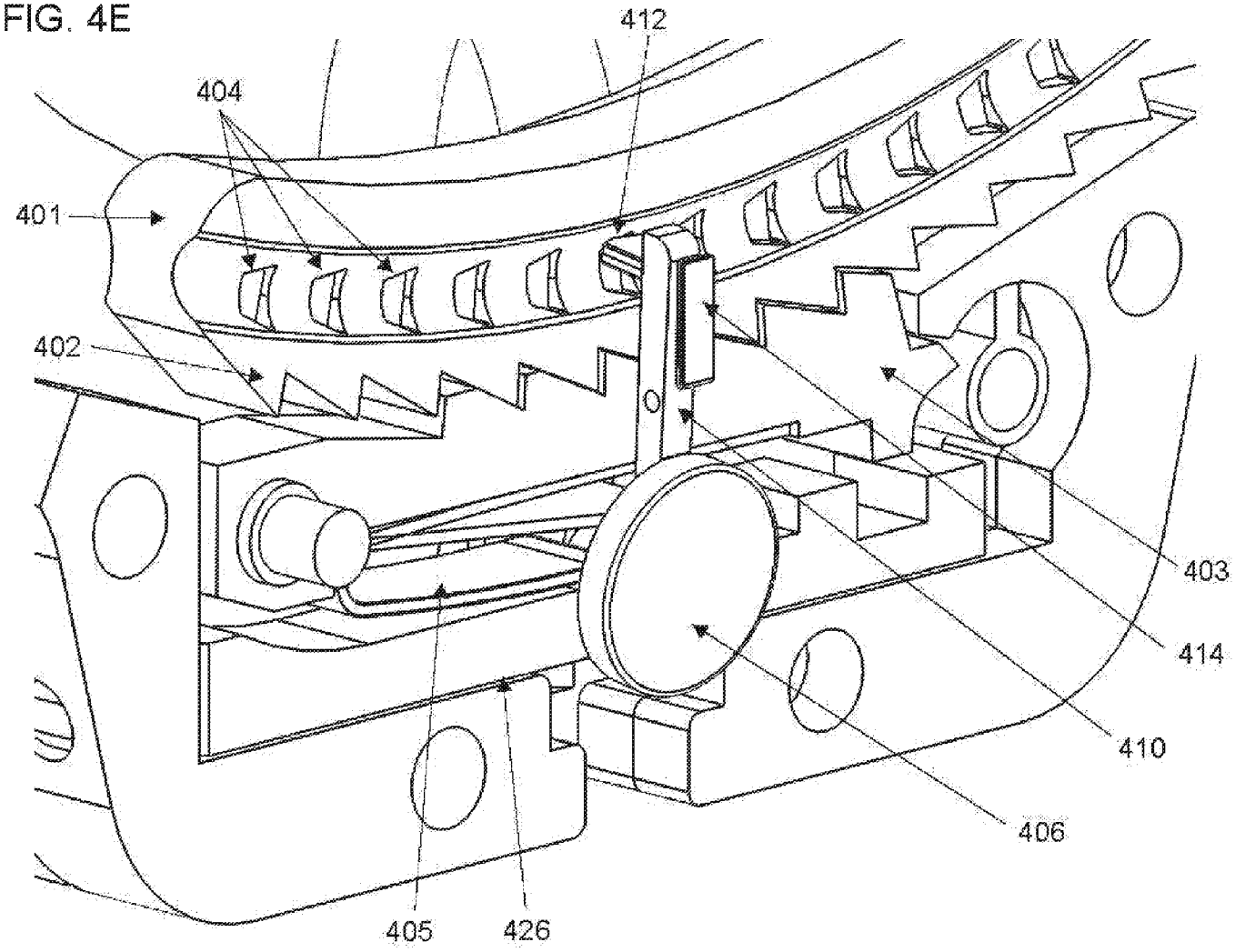
FIG. 4E shows another view where the buttons are depressed and the extensions are retraced from the indentations.

As depicted in FIG. 4D, each squeeze button detent 406 and 407 is positioned on a pivot indentation 418 and 419 within the handcuff double strand(s) 408 and 409 so that when the button(s) 406 and 407 is/are squeezed, teeth 412 and 413 at the top of detent 418 and 419, located between the single 401 and double strands 408 and 409, are pressed against and engaged with side indentations 404 of single strand 401. From FIG. 4E, when buttons 406 and 407 are depressed, the attached extensions 410 and 411 pull away from indentations 404 in the single strand 401 thereby disengaging teeth 412 and 413.

The two squeeze buttons 406 and 407 are separately and simultaneously squeezed to disengage from side indent 404 of the single strand 401, while also inserting and rotating a handcuff key 416 in the keyhole 420 to disengage key pawl 403 from bottom teeth 402 of single strand 401 to allow for the release or uncuffing of single strand 401.

This two handed operation, requiring opposable digits on two separate hands, would be difficult if not impossible for the wearer of the handcuff. This is largely because one hand of the wearer of the handcuff is incapacitated by the handcuff leaving only one hand to manipulate the locking mechanism of the handcuff. Additionally, the design of the ratchet indentations 404 on the outer edge of the single strand 401 prevents the use of a single shim to open the handcuff.

Figure 5A:
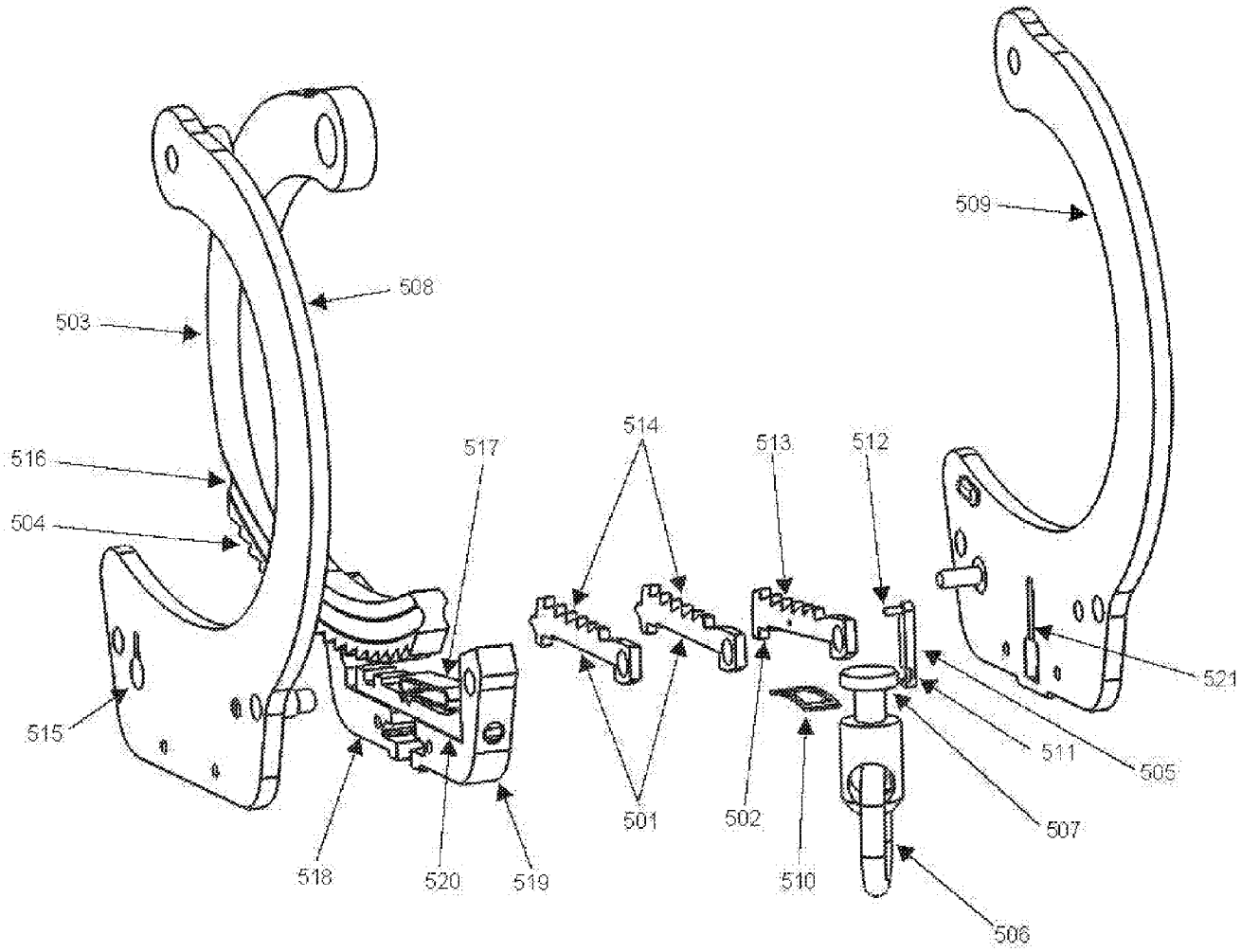
FIG. 5A illustrates an exploded view of a fifth embodiment.

In another embodiment of the design, depicted in FIG. 5A, the handcuffs are constructed in the traditional manner utilizing pawl(s) 501 and 502, which engage the ratchet teeth 504 of single strand 503. A chain tension lock bar 505 system controls a second (or third, etc.) pawl 502 which, when in a locked position, engages with teeth 504 of single strand 503. In this variation of the design, the chain 506 linking the pair of handcuffs is connected to a swivel collar 507 that interfaces with a chain tension lock bar 505, which controls the movement of a pawl 502 located within double strands 508 and 509 of the handcuff. The chain tension lock bar 505 connects secondary pawl 502 to handcuff chain 506. The chain tension lock bar 505 moves up and down inside an indentation 521 inside double strand 509.

Figure 5B:
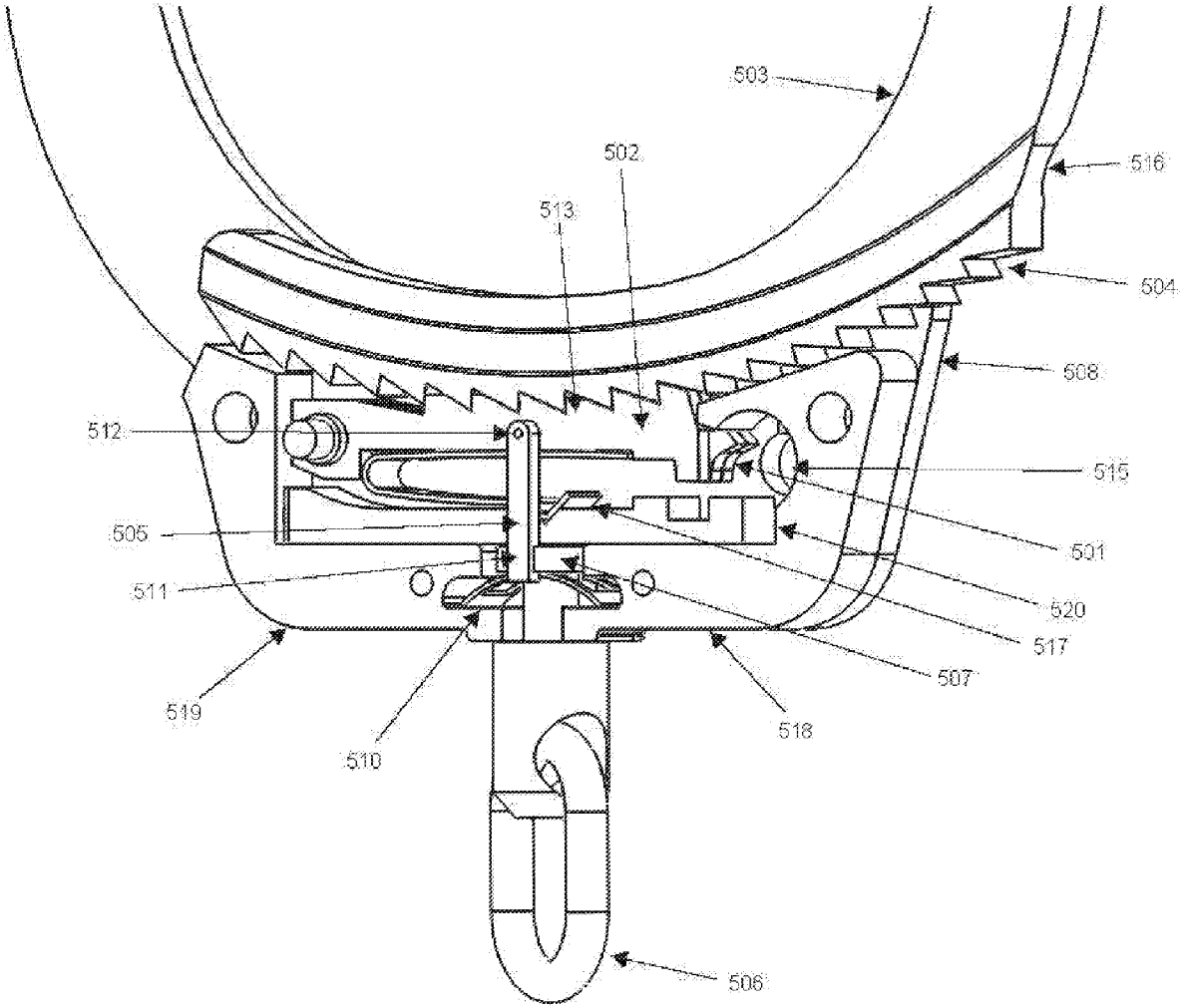
FIG. 5B depicts the interior handcuff with the chain tension lock bar pawl engaged with the ratchet teeth.

As shown in FIG. 5B, a small spring 510 provides constant positive tension on swivel chain collar 507, forcing the system upwards into the handcuff towards the ratchet teeth 504 of single strand 503. The chain tension lock bar 505 possesses an indentation 511 that interfaces with the swivel collar 507 connected to chain 506.

The swivel collar 507 of chain 506, under pressure from spring 510, forces chain tension lock bar 505 upwards towards pawl 502. The upper portion 512 of chain tension lock bar 505 is connected to key pawl 502 by any type of method to include welded, pinned as shown in arrangement 512, bonded, glued, etc. The pressure exerted by spring 510 into collar swivel 507 is transferred into tension lock bar 505, pushes pawl 502 upwards and engages teeth 504 of single strand 503.

Figure 5C:
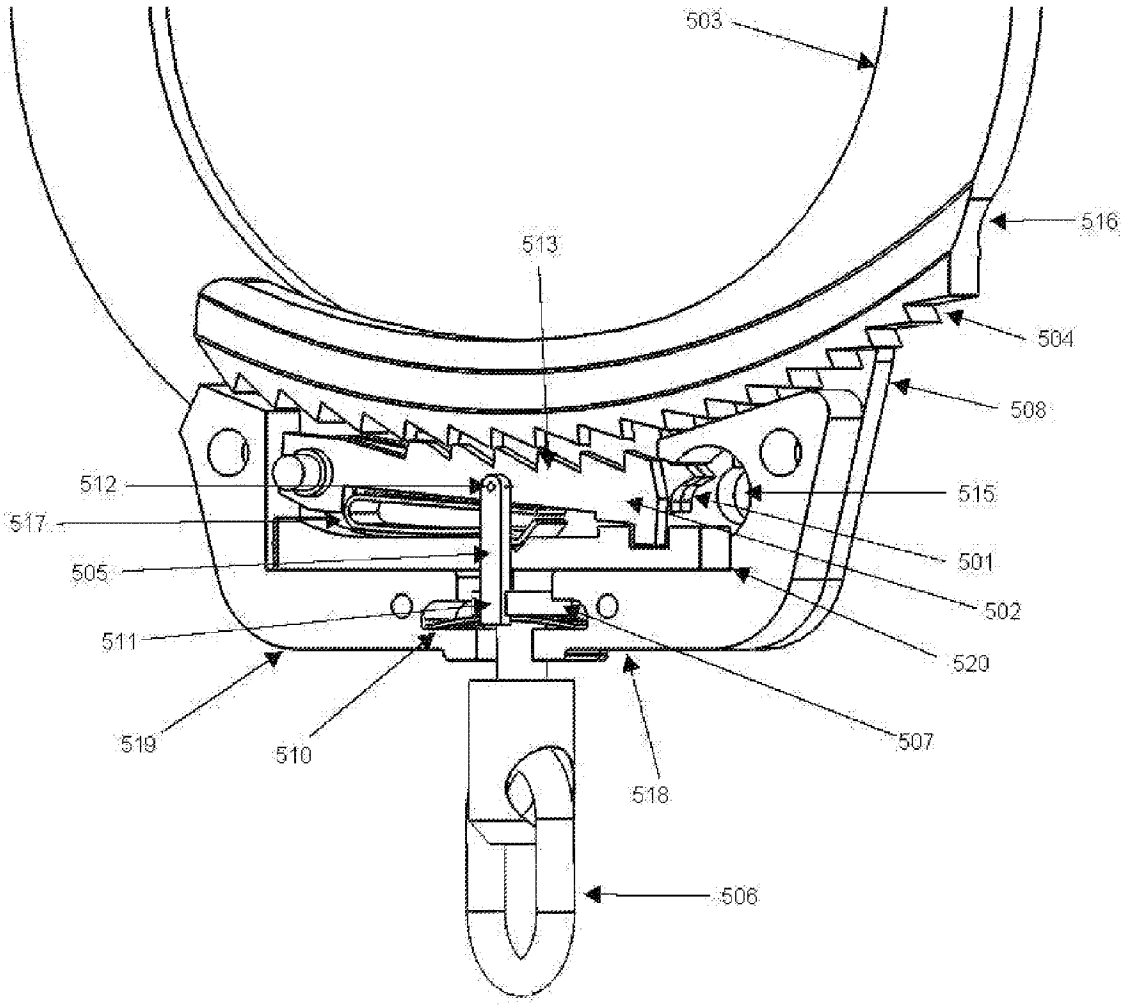
FIG. 5C shows the chain tension lock bar pawl disengaged while the key pawls remain engaged with the ratchet teeth.

From FIG. 5C, when the handcuff chain 506 is pulled away from the body of handcuff 507 and 509, the connected pawl 502 is also pulled down, disengaging the teeth 513 of secondary pawl 502 from the teeth 504 of single strand 503. In order to create a full release of single strand 503, the teeth 514 of key pawl(s) 501 must also be disengaged through the simultaneous insertion and rotation of a handcuff key in keyhole 515 of the handcuff. Only when the teeth 513 of secondary pawl 502 and the teeth 514 of key pawl 501 are simultaneously disengaged from the teeth 504 of single strand 503, may the single strand 503 be released.

In this embodiment two or more pawls may be employed. One pawl 502 connects to swivel collar 507 so that the retraction of handcuff chain 506 from the handcuff double strand 508 and 509 retracts pawl 502 from teeth 504 of single strand 503. This pawl 502 cannot be disengaged from teeth 504 of single strand 503 by use of a universal handcuff key. Also shown in FIG. 5A are various cuff components, including the single strand bow 516, tab spring 517, first mid plate 518, second mid plate 519 and double lock bar 520.

This embodiment requires the wearer of the handcuffs to pull the two handcuffs apart to create pressure on the secondary chain tension pawl 502 while simultaneously turning a handcuff key to release the single strand 503. This design makes it more difficult for the wearer of the handcuff to release himself or herself from the restraints even with the use of a handcuff key.

Handcuffs are generally constructed with two individual handcuff ratchets connected together via swivel collars and a small metal chain. This system allows the handcuffs to be folded over for transport and quickly deployed. Additionally, the metal chain links provide flexibility and allow movement of the wearer so that he may twist and move his hands even when handcuffed. This flexibility and movement allows for the wearer to be more comfortable, reduces injuries, and allows an officer to handcuff a person more easily as the handcuffs may be turned and twisted as needed.

This flexibility of the existing linked chain design provides a security weakness in the handcuffs. Due to the flexibility of the linked chain, a wearer may twist her hands and wrists in a manner in which he or she can now access the keyholes of the handcuffs he or she is wearing in an attempt to defeat the security mechanism. This flexibility allows the wearer to unlock the handcuffs he or she is wearing using a universal handcuff key or lock-picking device.

Figure 6A:
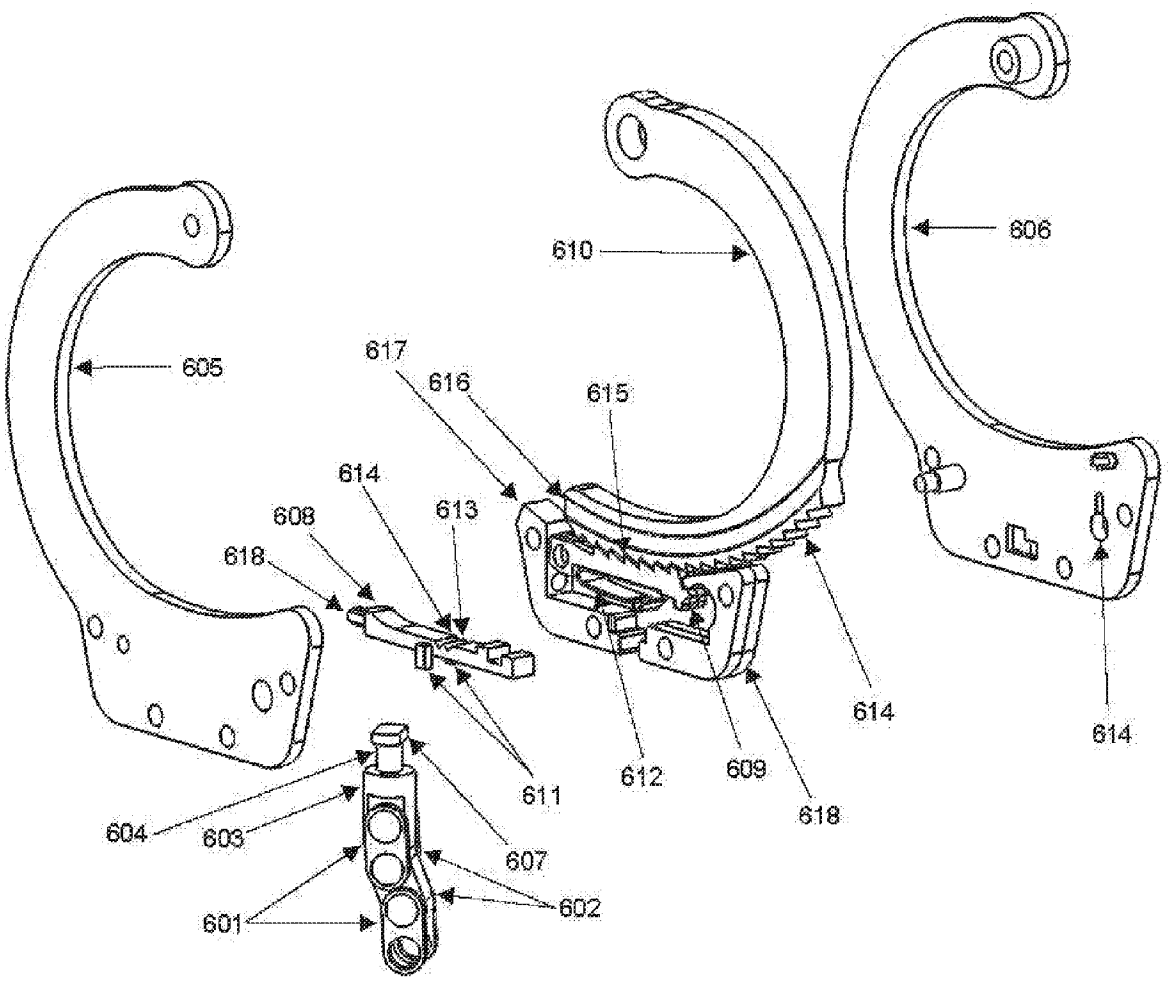
FIG. 6A illustrates an exploded view of sixth embodiment.
Figure 6B:
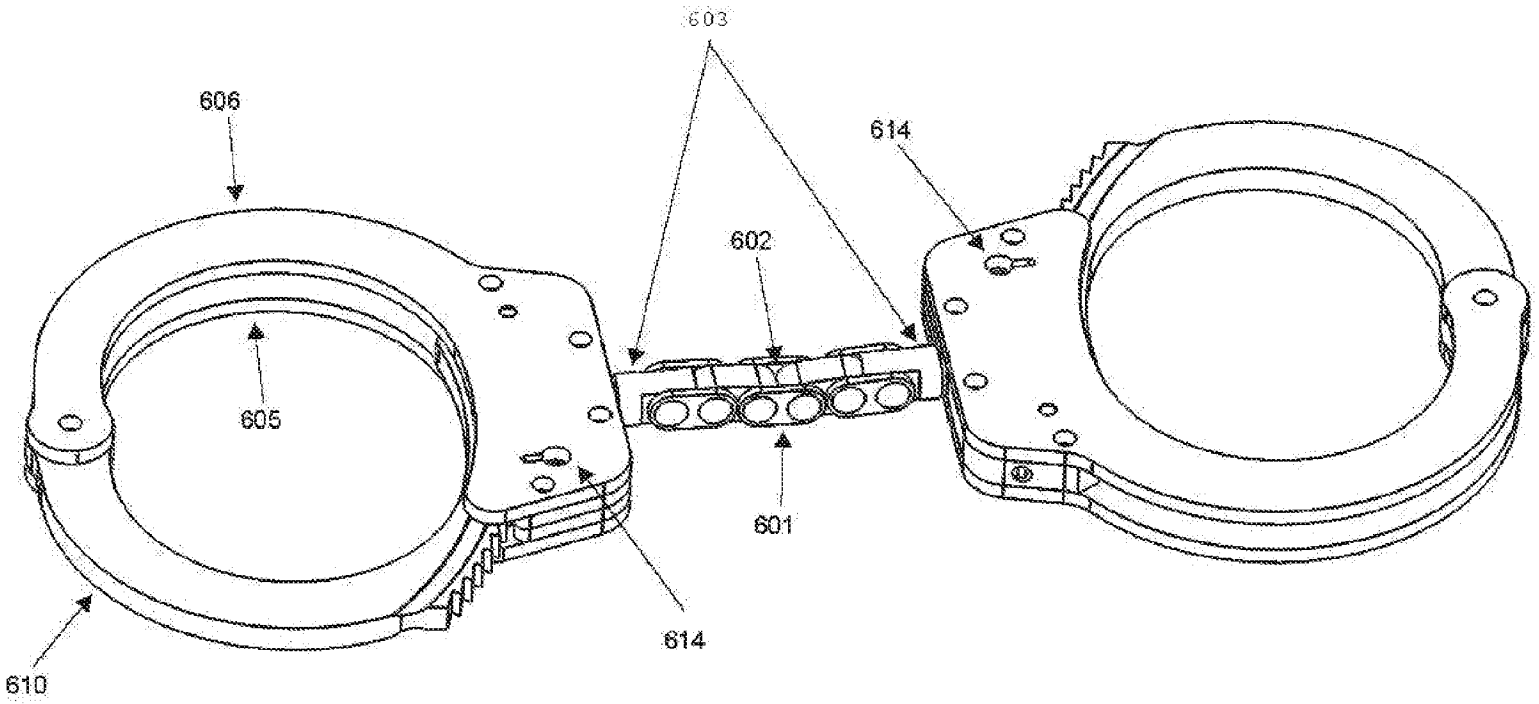
FIG. 6B depicts two handcuffs connected via the roller chain.

Another embodiment of the design is shown in FIG. 6A. From FIG. 6A, a small linked roller chain 601 allows only for forward and backward flexibility and does not allow for lateral movement. This allows for the handcuffs to be folded over for transport and quickly deployed similar to a standard pair handcuffs in the manner shown in FIG. 6B.

The roller chain 601 is relatively rugged and linked openings 602 between the chain links 601 may be minimal to prevent the insertion of pry bars or tools. The roller chain 601 may be connected to each of the handcuff ends by a swivel collar 603 or other similar system. The roller chain 601 may be comprised of one or many links to provide greater flexibility and/or space between the two pair of handcuffs or a minimal amount of links in order to reduce the flexibility available to the wearer of the handcuffs.

Figure 6C:
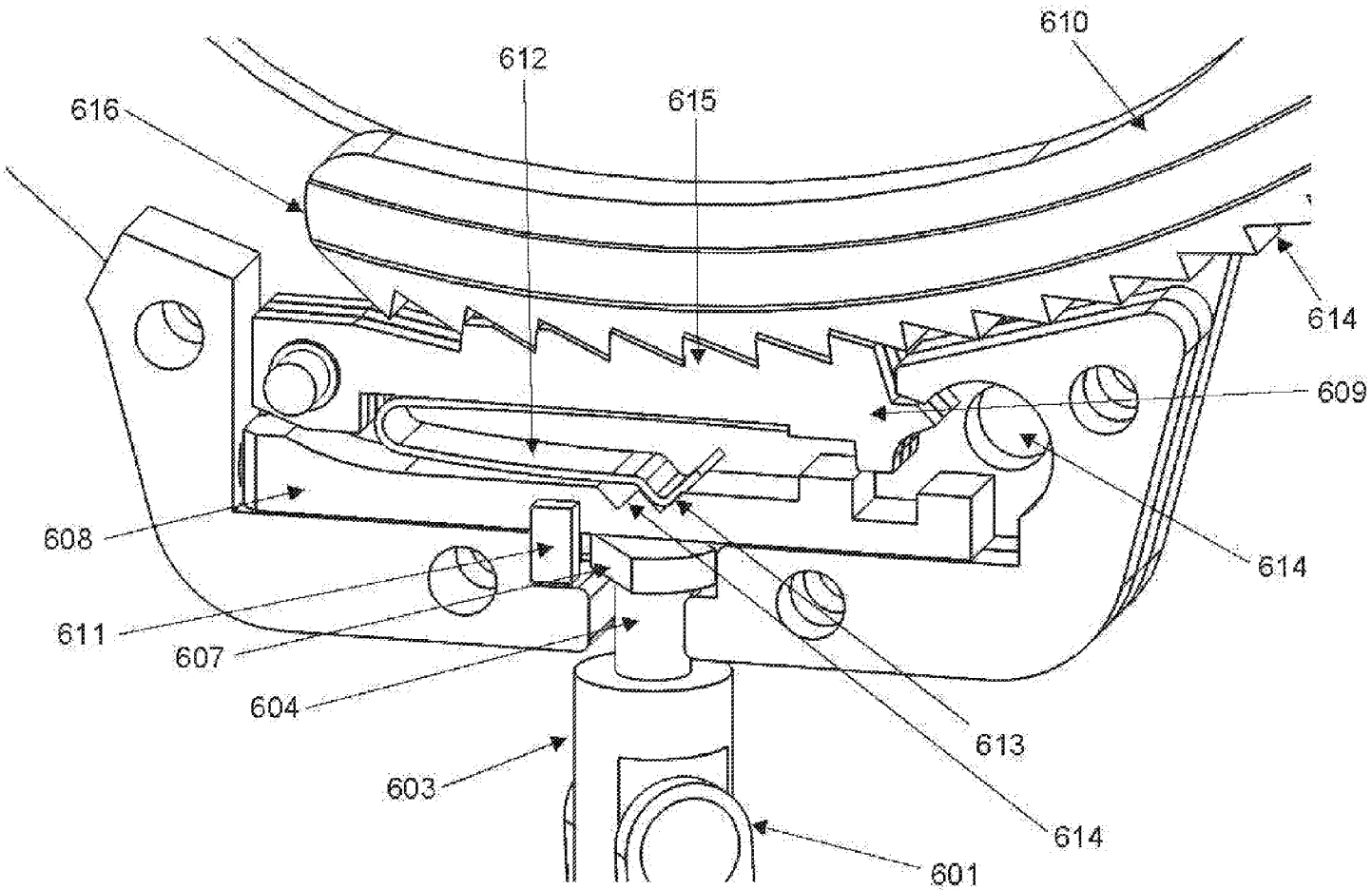
FIG. 6C shows the swivel collar turned and the double lock bar in the unlocked position according to the sixth embodiment.

The swivel 603 connects roller chain 601 to the handcuffs and has the ability to rotate freely and independently from each of the handcuffs in the manner shown in FIG. 6C. This allows the handcuffs to be twisted by the wearer to increase comfort or to potentially attempt to manipulate the locking mechanism of the handcuffs. FIG. 6C depicts the handcuff with the swivel collar 604 rotated at 45 degrees and without the double lock bar 608 engaged.

In this embodiment, collar 604 of swivel 603 sits inside the housing of double strand 605 and 606. The collar 604 of swivel 603 has two opposing flat areas 607. The double lock bar 608 sits directly above swivel collar 604. When the handcuffs are double locked, the double lock bar 608 is moved laterally towards keyhole 614 which prevents pawls 609 from moving downward and effectively prevents single strand 610 from moving in any direction (tightening or loosening).

In this design, double lock bar 608 has two small tabs 611 extending downward into the area occupied by swivel collar 604. When the handcuffs are not double locked, tabs 611 do not interface or interfere with the rotation of collar swivel 604. When double lock bar 608 is moved into the double lock position, tabs 611 move forward and interface against the collar of swivel 604.

Figure 6D:
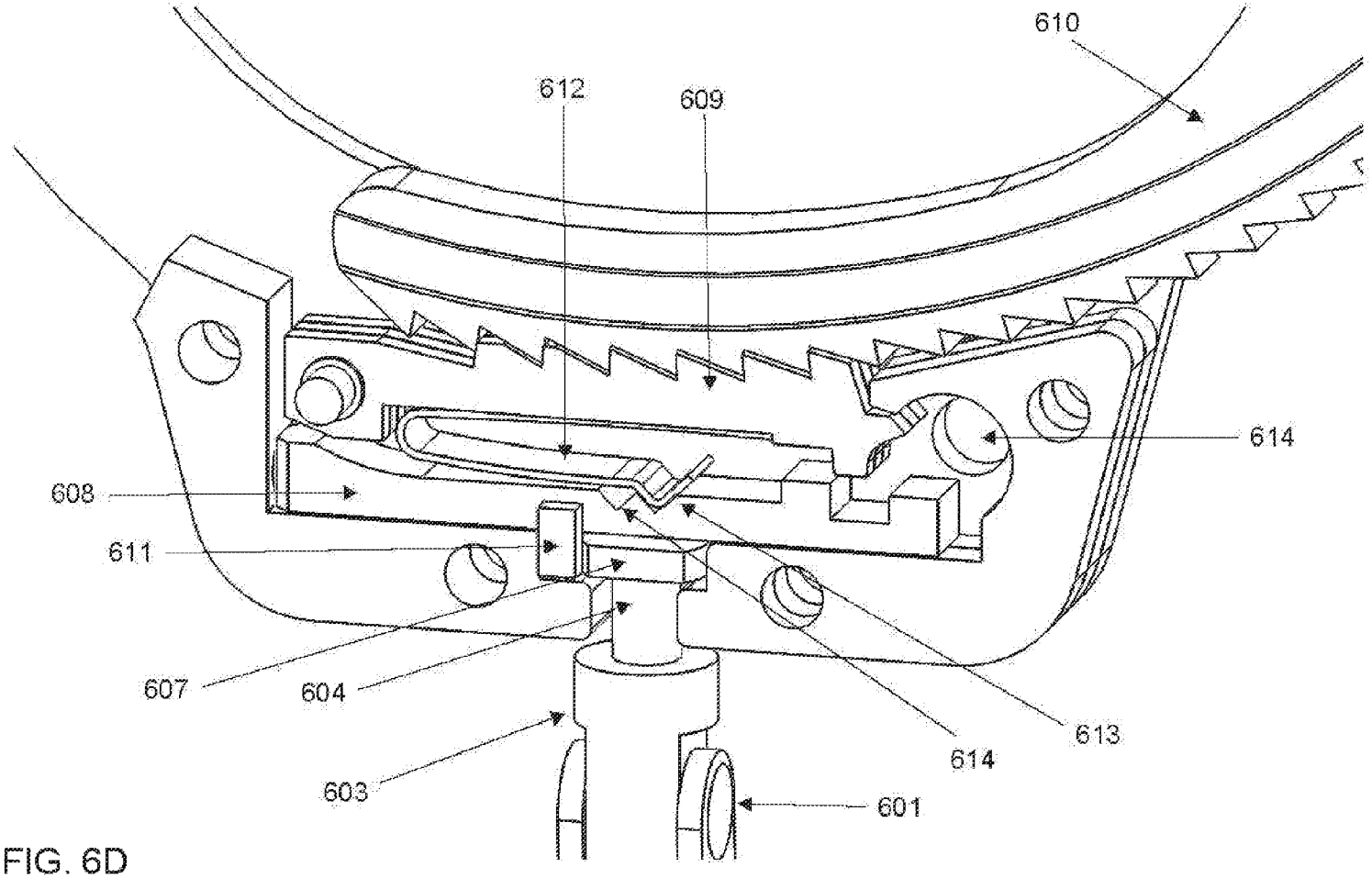
FIG. 6D illustrates the flat areas of the swivel collar aligned with the double lock bar tabs according to the sixth embodiment.
Figure 6E:
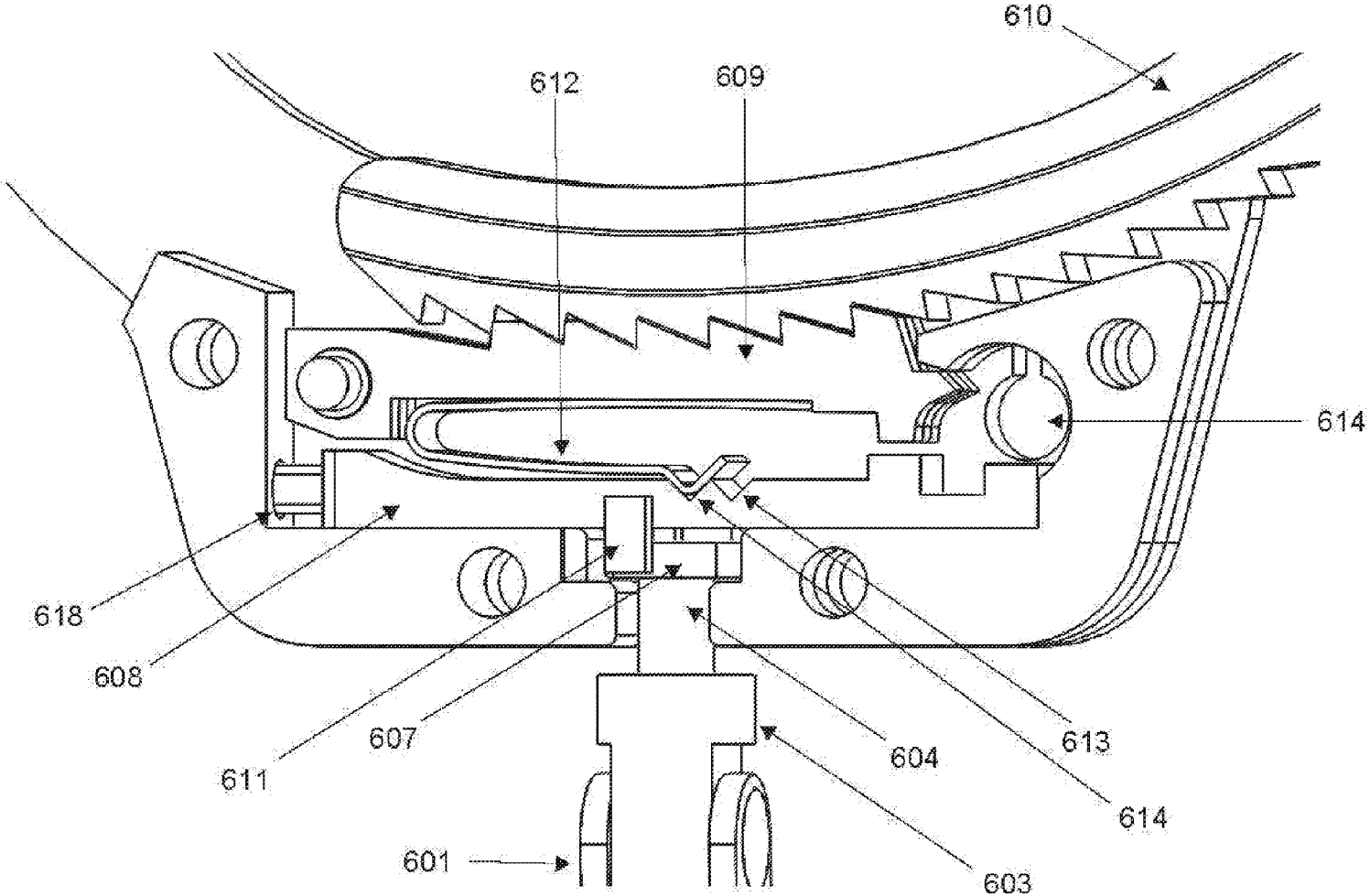
FIG. 6E shows the tabs of the double lock bar engaged with the flat areas of the collar swivel according to the sixth embodiment.

When the flat areas 611 of collar swivel 604 are lined up as shown in FIG. 6D, these tabs 611 move into position and sit solidly against the flat areas 607 of collar swivel 604 as represented in FIG. 6E. This position now prevents the swivel collar 603 and 604 from rotating due to double lock bar tabs 611 resting firmly against the flat areas 607 of swivel collar 604. In order to allow swivel collars 603 and 604 to rotate, the handcuffs first have to be taken out of the double lock position. This moves tabs 611 backward away from the flat areas 607 of the swivel collar 603 and 604 and allow them to rotate.

Figure 6F:
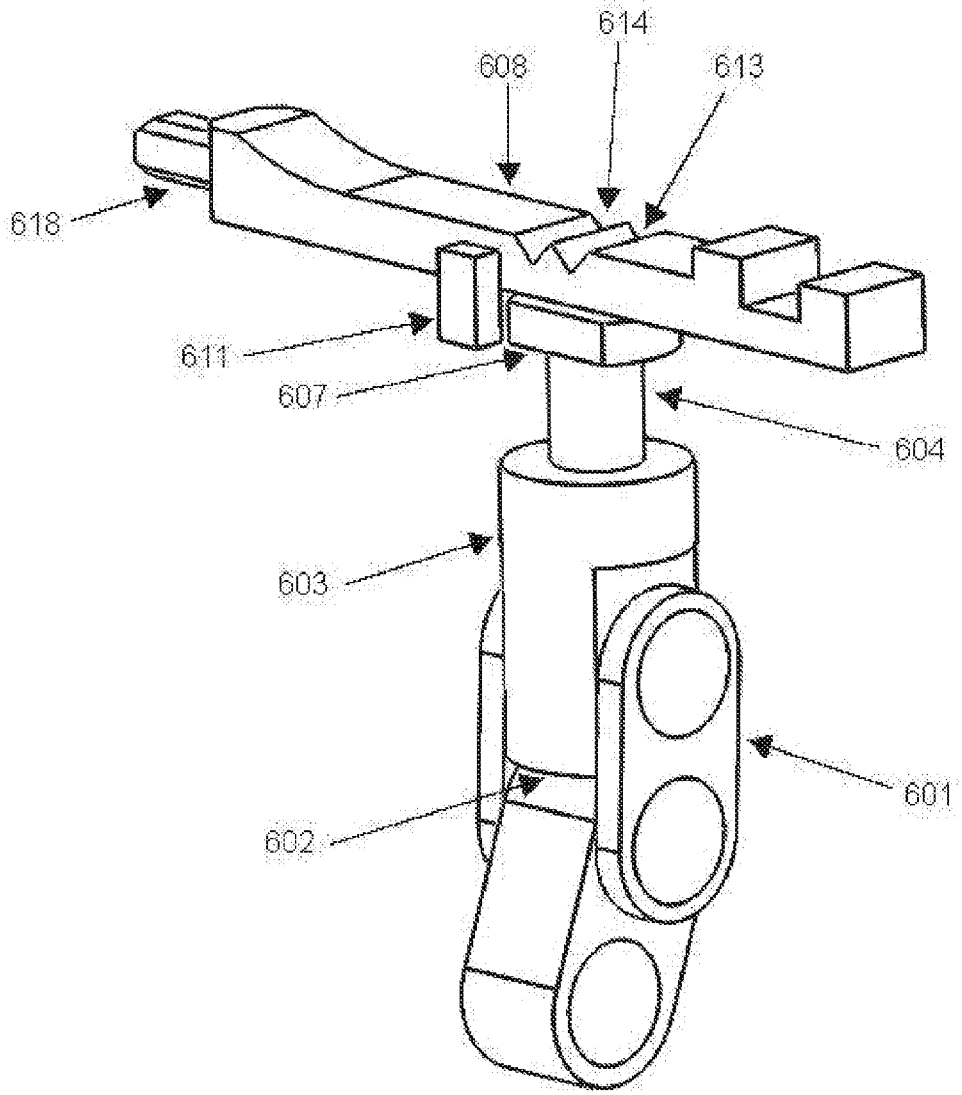
FIG. 6F shows a close up of the double lock bar and swivel collar assembly according to the sixth embodiment, wherein the flat areas of the swivel collar are aligned with the double lock bar tabs but have not been engaged.
Figure 6G:
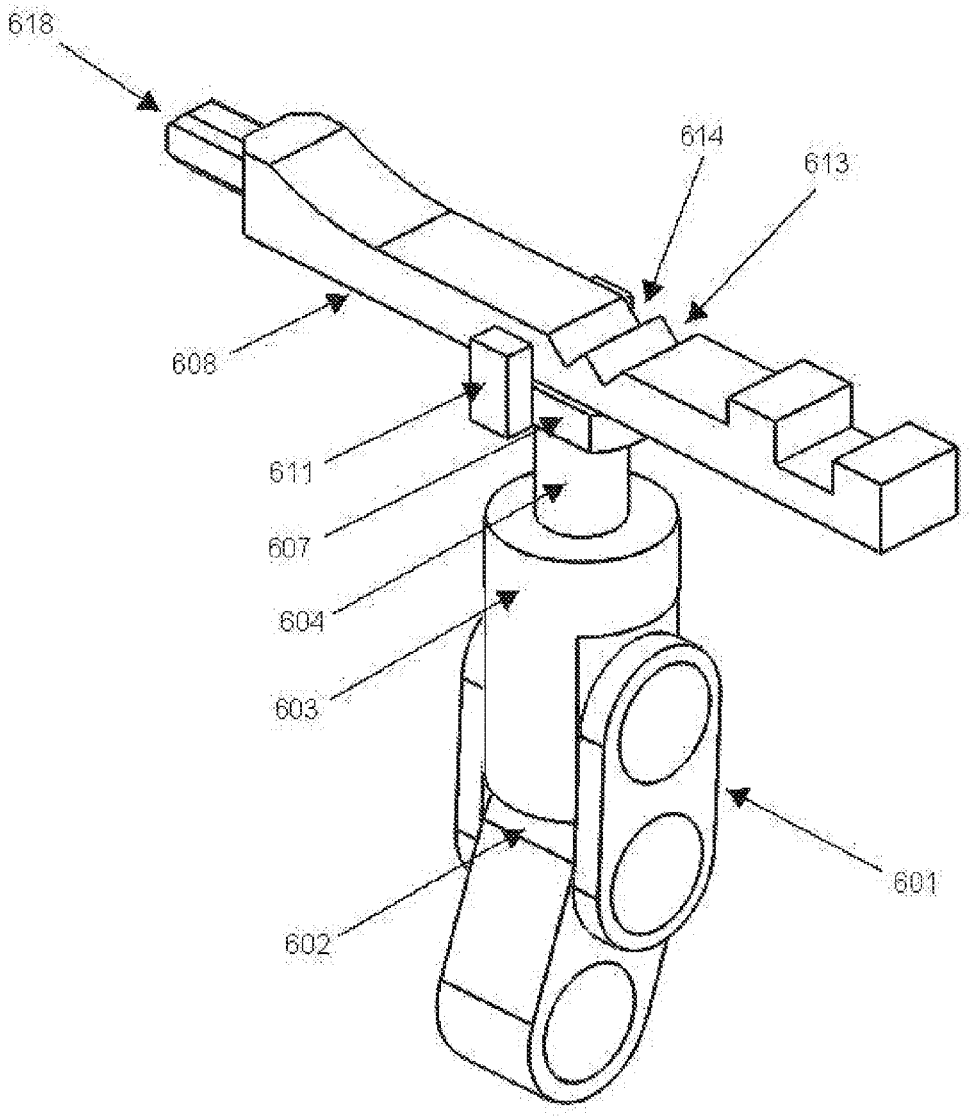
FIG. 6G shows a close up of the double lock bar and swivel collar assembly according to the sixth embodiment, wherein the flat areas of the swivel collar are aligned with the double lock bar tabs and are engaged.

Locking swivel collars 603 and 604 into one position produces a condition whereby, the handcuffs can move or twist only in the direction which the roller chain 601 allows. This design would prevent a wearer from being able to twist the handcuffs in multiple positions when attempting to manipulate the locking system of the handcuffs. The locking bar tabs 611 are only able to move against flat surface 607 of swivel collar 603 and 604 when swivel collar component 604 is aligned with the locking block tabs 611 as shown in FIG. 6F. Once tabs 611 interface with the flat areas of the swivel collar 607, as in FIG. 6G, the handcuffs can be double locked.

Figure 6H:
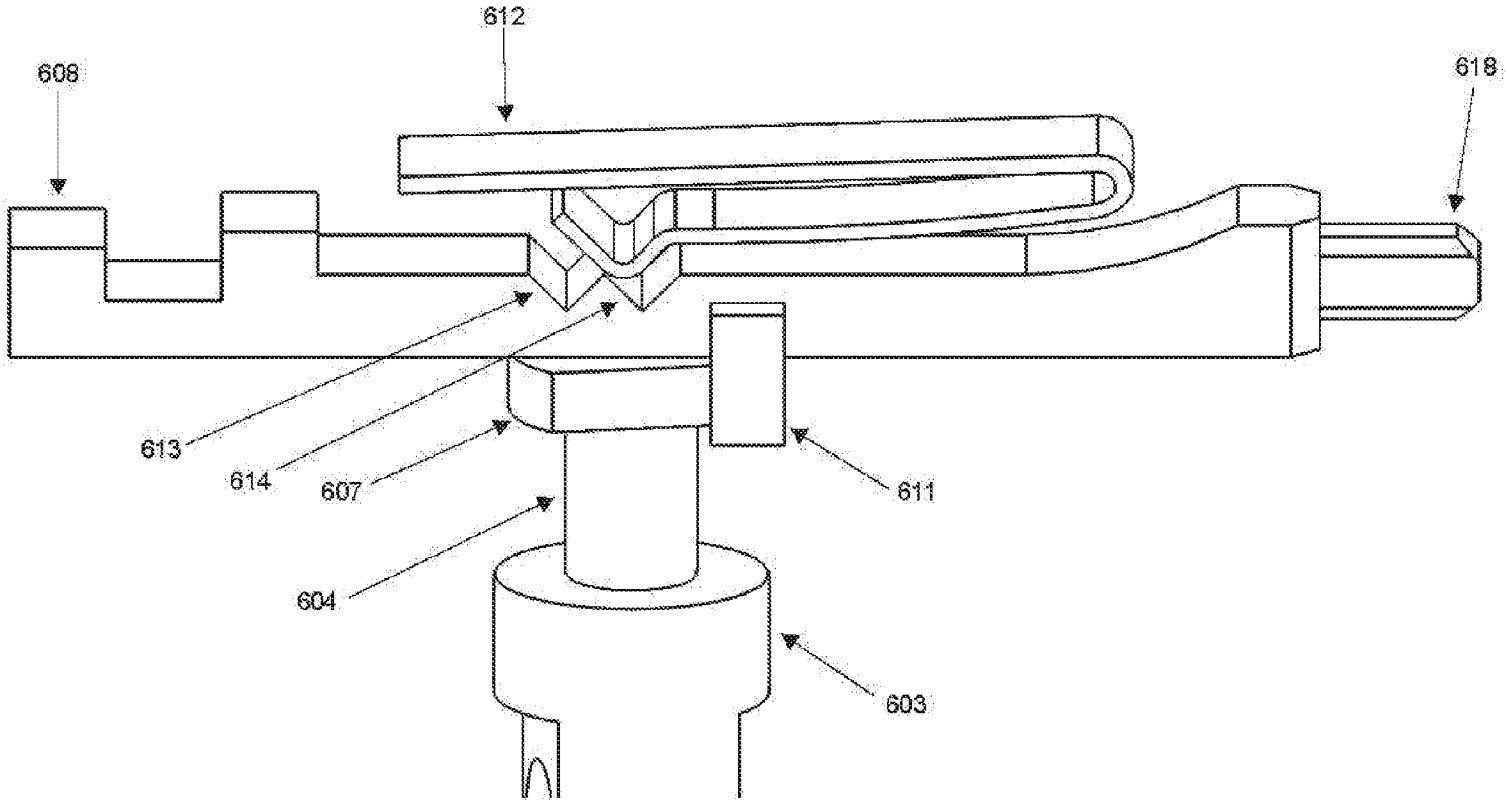
FIG. 6H shows the double lock bar and tab spring according to the sixth embodiment in a pre stage double lock configuration, wherein the flat areas of the swivel collar are not aligned and therefore the tab spring cannot fully seat into the "V" notch.

This embodiment also provides for a double lock pre-staging position for the tabs 611 as depicted in FIG. 6H. In such a case, an officer could place the handcuffs on a wearer and then initiate the double lock capability. If the roller chain 601 of the handcuffs are twisted in such a manner that tabs 611 cannot move into position because the flat areas 607 of swivel collar 604 are turned, the officer may still engage the double locking system. In such a case, the double lock bar 608 moves forward, towards keyhole 614, and double lock bar tabs 611 engage against the rounded area of handcuff swivel collar 604. The movement of double lock bar 608 allows tab spring 612 to move from the unlocked "V" notch 613 into the upper double lock portion of the "V" notch 614 of double lock bar 608. This position would prestage the tab spring 612 and provide positive pressure into double lock "V" channel 614 but would not be fully seated. Once swivel collar 604 turns enough so that the flat areas 607 of swivel collar 604 are in alignment, the double lock bar tabs 611 would then spring forward into position. This movement would be automated because of the positive pressure of tab spring 612 pushing down and forward into the "V" channel 614 of double lock bar 608.

Figure 6I:
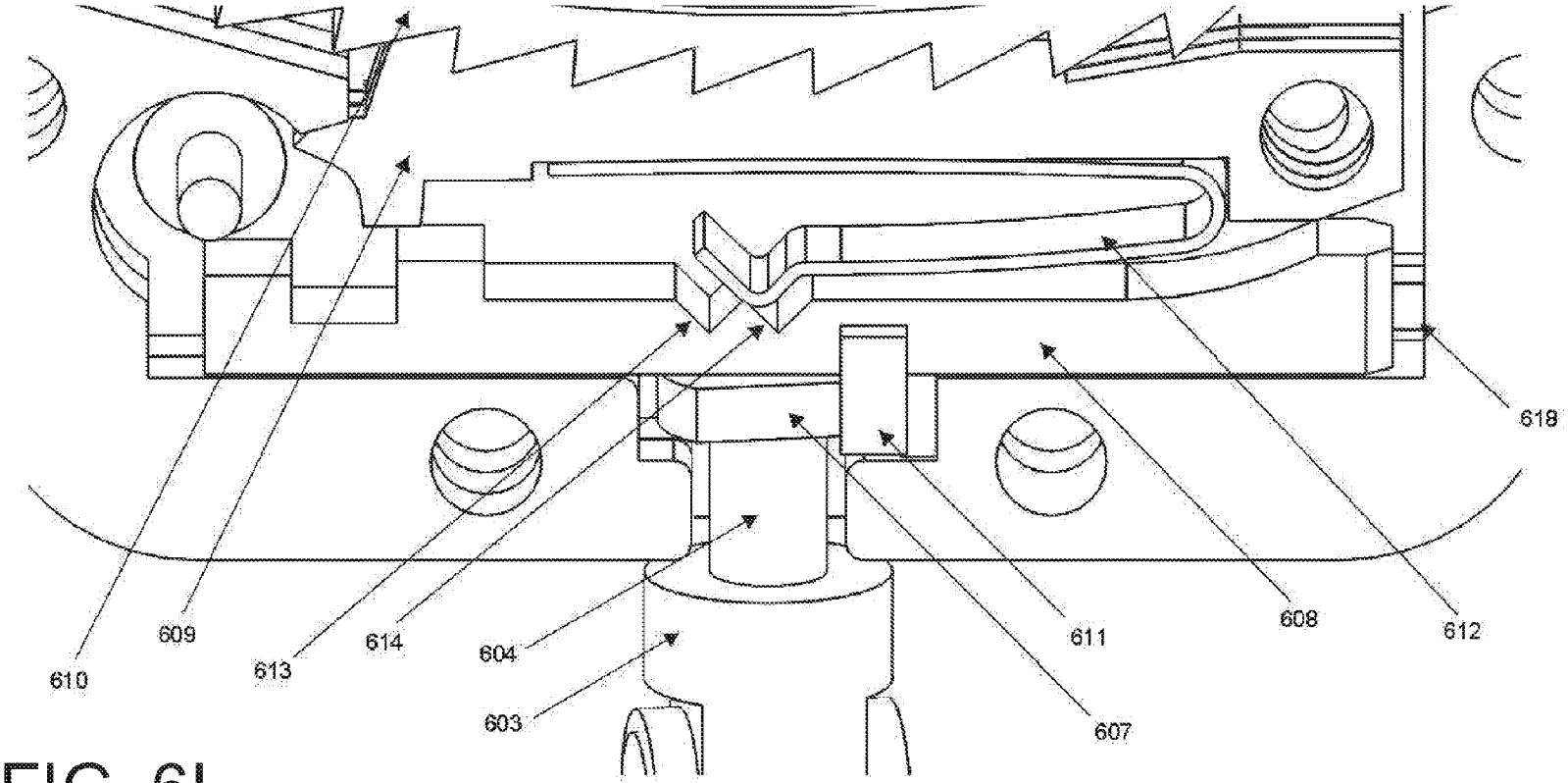
FIG. 6I shows the interior of the handcuff according to the sixth embodiment while in pre stage double lock mode where the flat areas are not aligned.
Figure 6J:
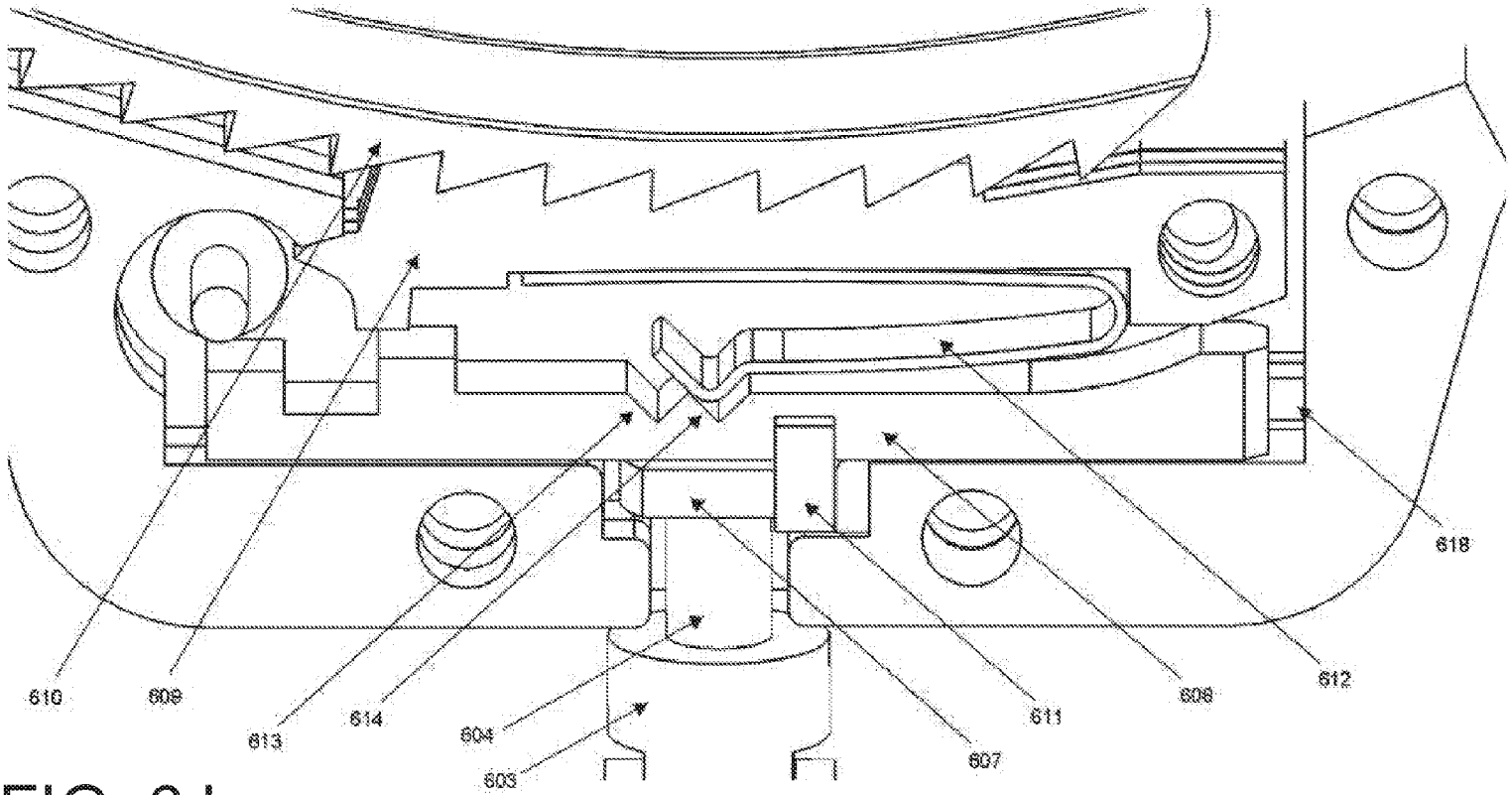
FIG. 6J shows the interior of the handcuff according to the sixth embodiment while in pre stage double lock mode where the flat areas are aligned.
Figure 6K:
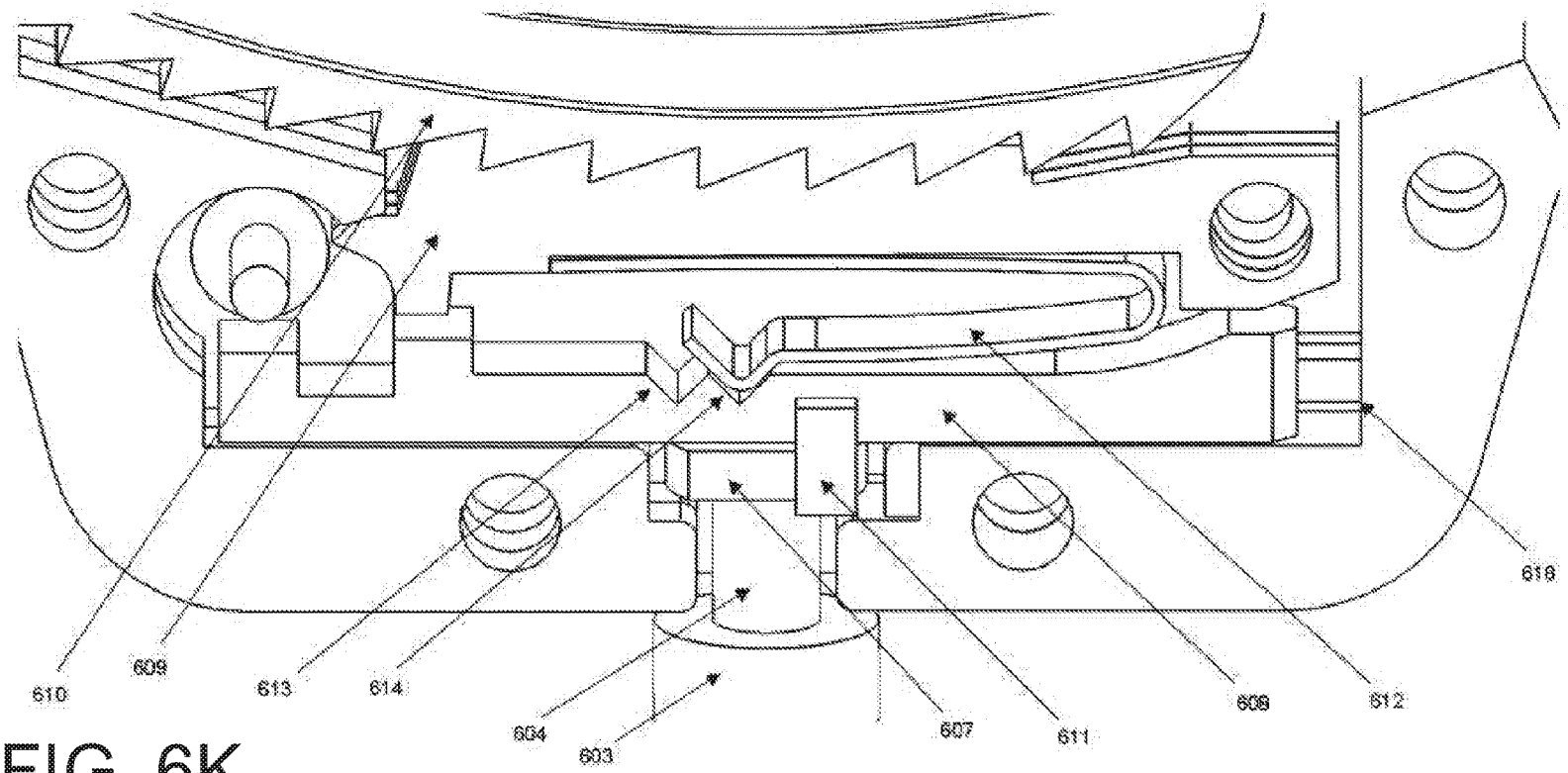
FIG. 6K shows the interior of the handcuff according to the sixth embodiment in double lock mode where the flat areas are aligned and engaged by the double lock bar tabs.

This sequence is depicted in FIG. 6I where double lock bar 608 has been pre-staged and the spring 612 has been moved so that it is not fully seated in the "V" notch 614 of the double lock position. In FIG. 6J tabs 611 are aligned with the flat areas 607 of swivel collar 604. In FIG. 6K the flat areas 607 are aligned allowing tabs 611 to move into the double lock position and fully seating tab spring 612 into the double lock "V" notch 614. As a result, tabs 611 prevent swivel collar 604 from twisting due the flat areas 607 which are aligned against tabs 611.

This embodiment allows an officer to place the handcuffs on the wearer in any position with the handcuffs freely spinning and twisting as needed to facilitate the application of the device. Once the wearer is handcuffed, the officer may initiate the double lock mechanism of the handcuffs. If the handcuffs are aligned, this design limits the ability for roller chain 601 to swivel, thereby preventing the wearer from being able to twist his hands in order to access the keyhole 614 of the handcuffs. If the swivel collar 604 and tabs 611 are not aligned, the handcuffs revert to a double lock pre-stage condition. When the wearer turns their hands into a position which aligns the flat areas 607 of swivel collar 604 with tabs 611, the handcuff double lock bar 608 would automatically move and lock into position. This process is automatic as a result of the spring pressure applied by tab spring 612 entering the double lock "V" channel 614. Also shown in FIG. 6A are various handcuff components, including single strand ratchet teeth 614, pawl teeth 615, single strand bow 616, first mid plate 617 and second mid plate 618.

Figure 7A:
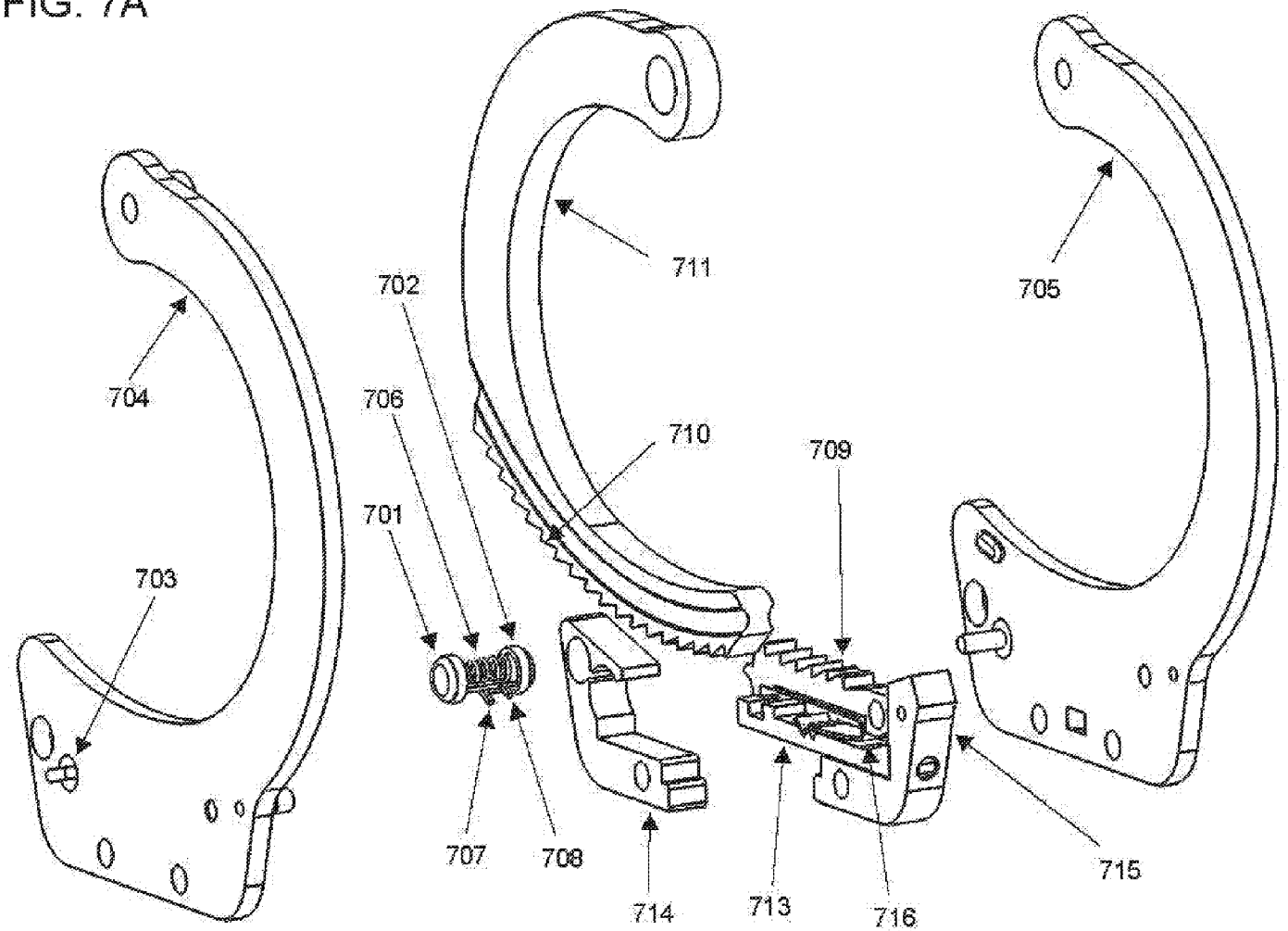
FIG. 7A illustrates and exploded view of a seventh embodiment.
Figure 7B:
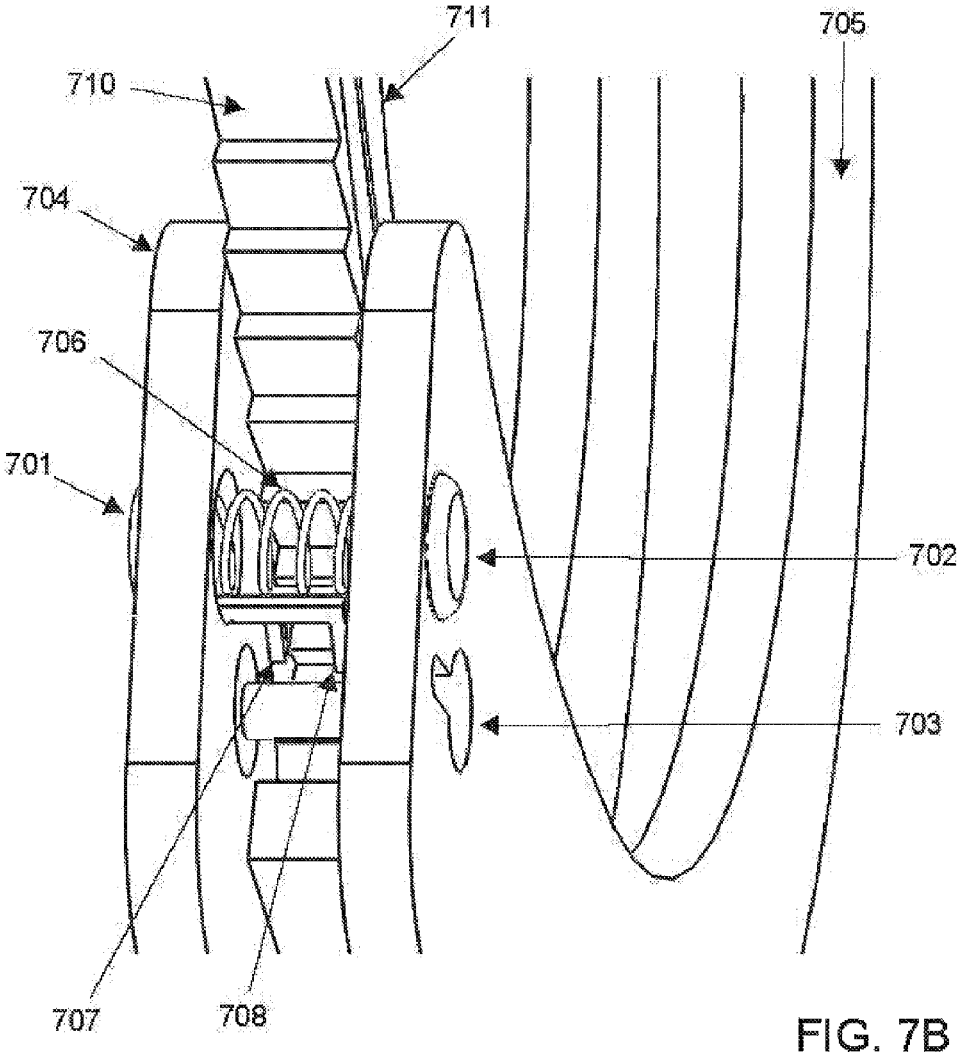
FIG. 7B shows a close up according to the seventh embodiment of the double strands with the buttons and springs inserted whereby they are obstructing the ability of a handcuff key to turn.
Figure 7C:
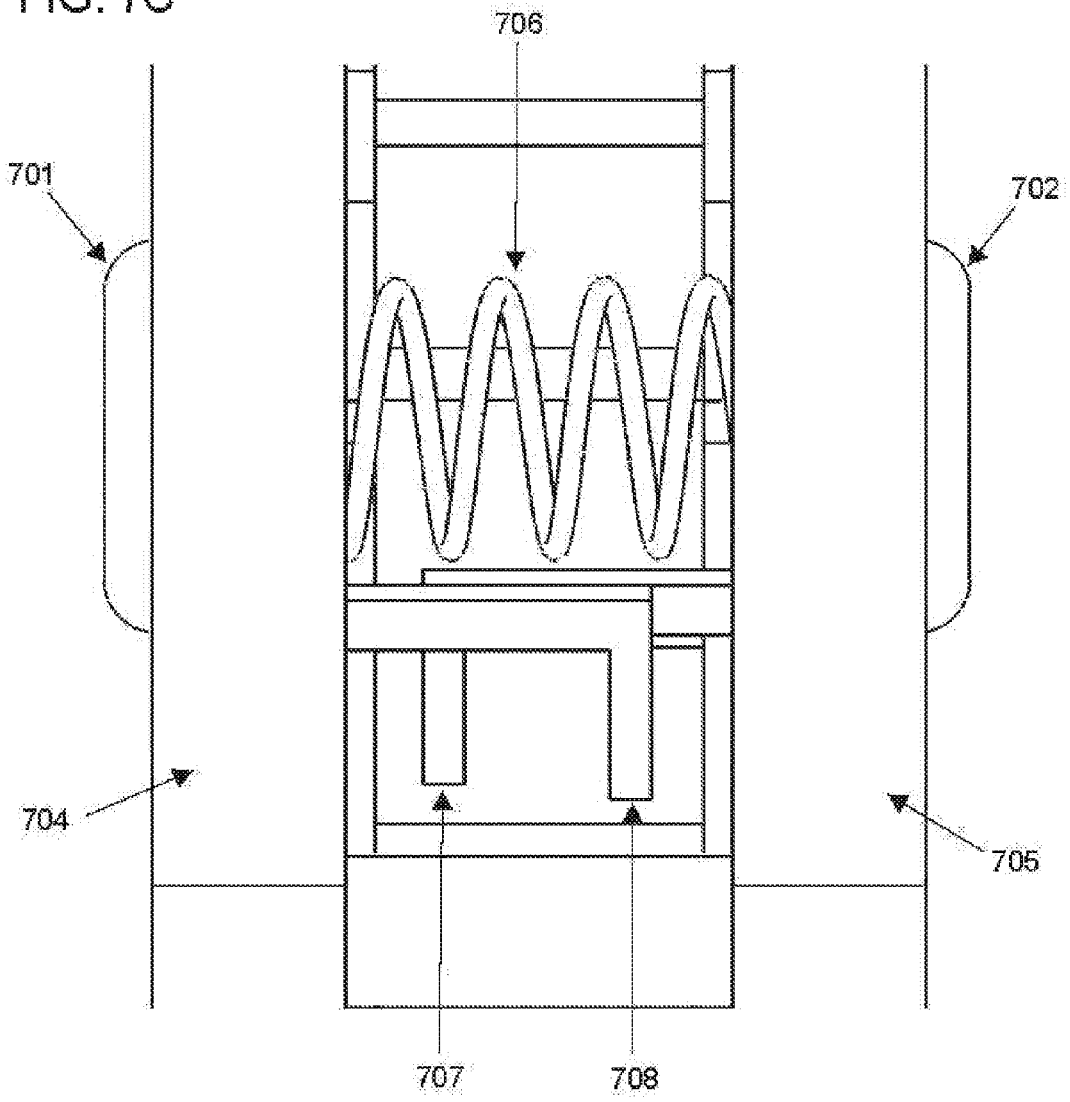
FIG. 7C shows the buttons according to the seventh embodiment not being depressed and the blocking tabs obstructing the ability for a handcuff key from turning.
Figure 7D:
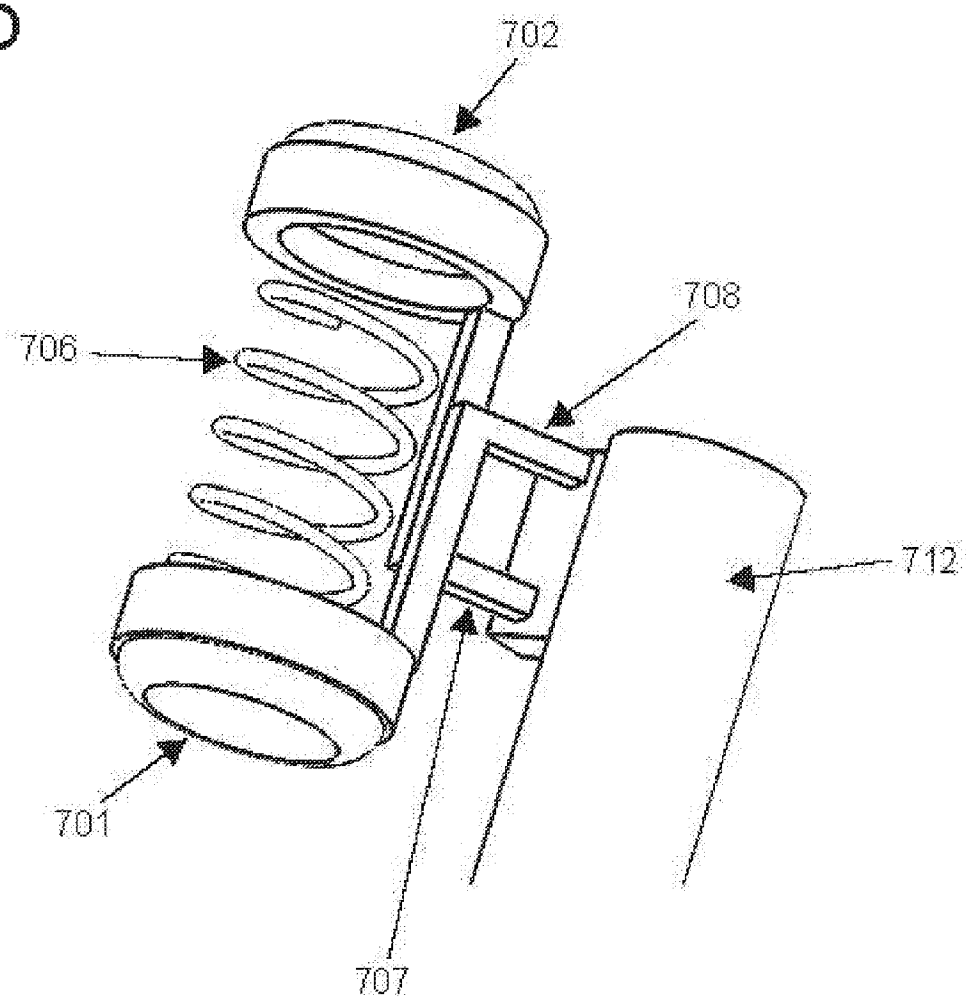
FIG. 7D shows the buttons, spring and blocking tabs obstructing the bit from a handcuff key according to the seventh embodiment.

In another embodiment shown in FIG. 7A, two key blocking squeeze buttons 701 and 702 prevent the free rotation of a universal handcuff key 712 when inserted into the keyhole 703. The two key blocking squeeze buttons 701 and 702 are located on the outside of each double strand 704 and 705. The key blocking squeeze buttons 701 and 702 are comprised of a button portion, which is located on the outside of the double strand 704 and 705, and are connected via a spring 706 which is contained within and between the double strands 704 and 705 of the cuff as shown in FIG. 7B. Each key blocking squeeze button 701 and 702 has an individual blocking tab 707 and 708, similar to a bit in a key and shown in FIG. 7C. The blocking tab, such as individual blocking tabs 707 and 708, on the end of the key blocking squeeze buttons 701 and 702 are contained between the double strands 704 and 705 and block the rotation of the handcuff key in the keyhole 703 as shown in FIG. 7D.

Figure 7E:
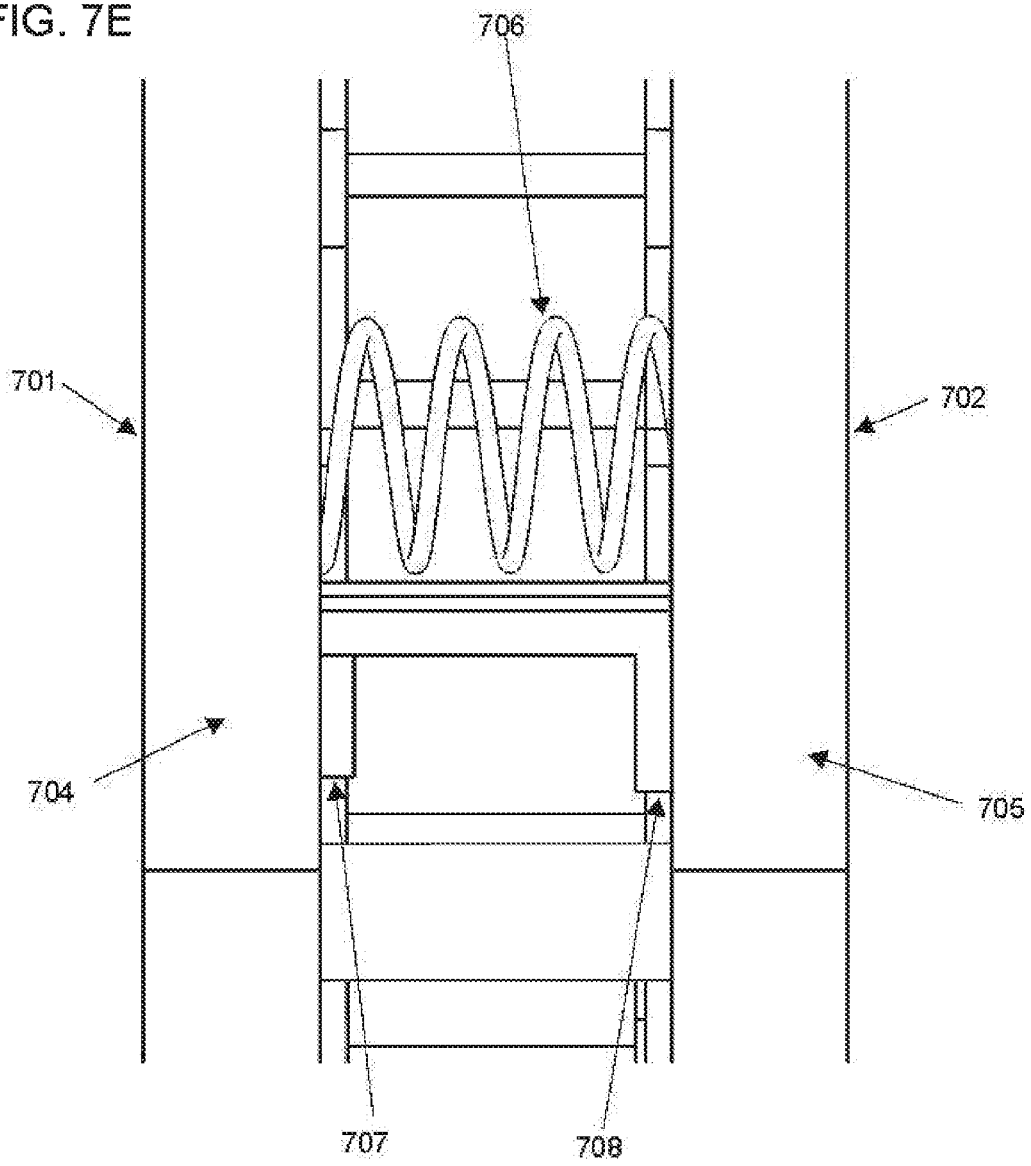
FIG. 7E shows the buttons depressed and the blocking tabs moved so they do not impede the movement of a handcuff key according to the seventh embodiment.
Figure 7F:
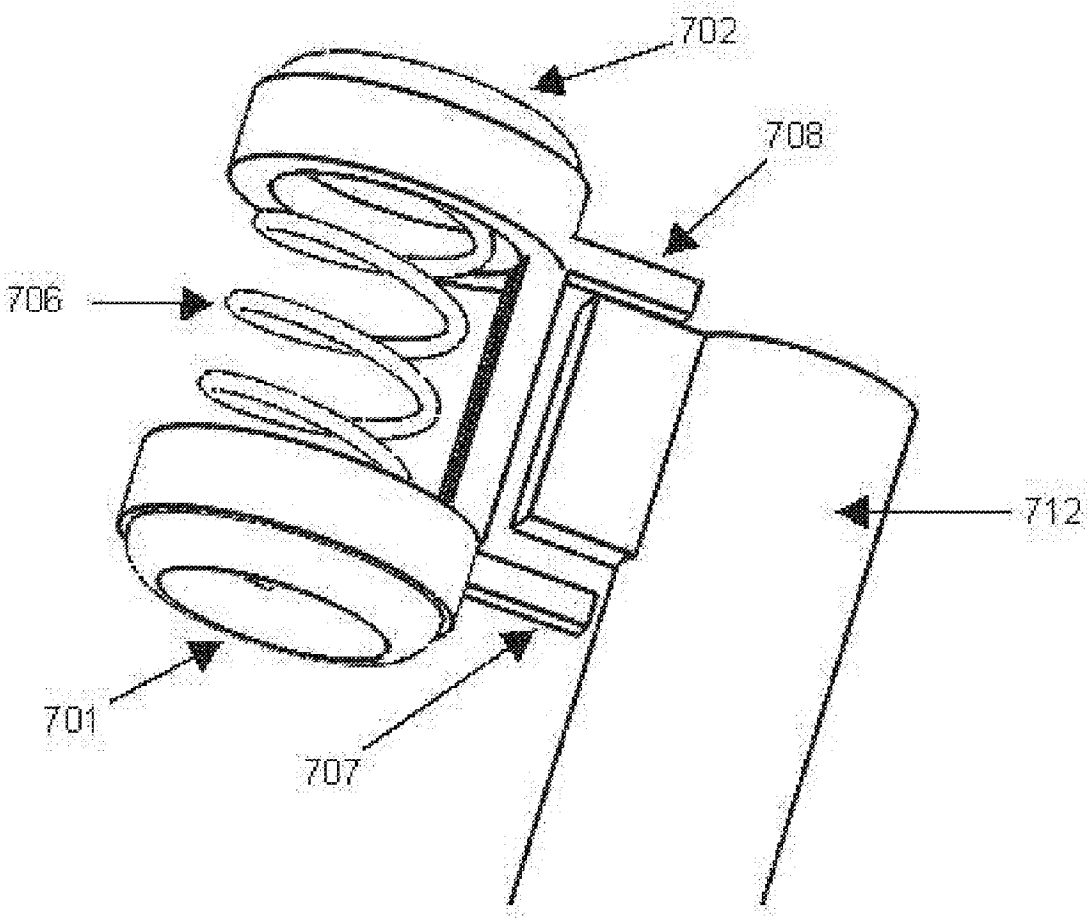
FIG. 7F shows a close up of the buttons being depressed and the blocking tabs moved so they do not impede the movement of a handcuff key according to the seventh embodiment.

When in a blocking position, the blocking tab mechanisms 707 and 708 on the key blocking squeeze buttons 701 and 702 prevent full rotation of the handcuff key 712 in keyhole 703, preventing the disengagement of key pawl 709 from teeth 710 of single strand 711. Release requires a user pressing the two key blocking squeeze buttons 701 and 702 simultaneously inwards on spring 706, towards each other, in order to push blocking tab mechanisms 707 and 708 towards the inside walls of double strands 704 and 705 as shown in FIG. 7E. As a result, this creates a space in which the handcuff key 712 can freely rotate and depress key pawl 709, thereby disengaging teeth 710 of single strand 711 and allowing the handcuff to open as depicted in FIG. 7F. Also shown in FIG. 7A are various cuff components, including the double lock bar 713, first mid plate 714, second mid plate 715 and tab spring 716.

Figure 8A:
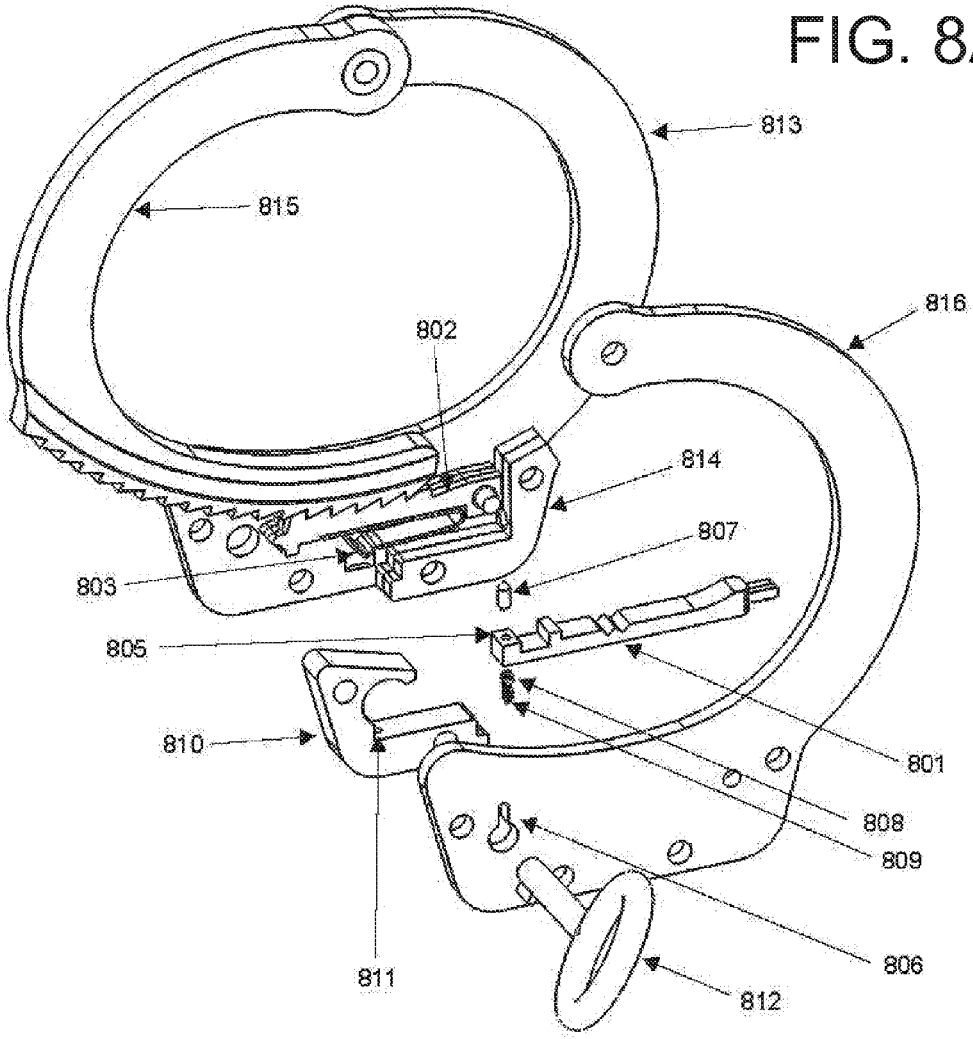
FIG. 8A illustrates and exploded view of an eighth embodiment.

Another version of the design, may comprise a double lock with a plunger, i.e. passive inertia inhibitor, as presented in FIG. 8A. The standard double lock bar 801 system in use for handcuffs is designed to move into position to prevent pawls 802 from moving downward, thereby locking the handcuffs from opening or becoming tighter. As discussed, the double lock bar 801 is manipulated through the use of a universal handcuff key 812 and normally has two positions identified as "double locked" or "not double locked". The double lock bar 801 is held in position due to positive pressure which is being applied by tab spring 803 in a double locked "V" notch 804 or unlocked "V" notch 818 located on top of double lock bar 801. If a double locked handcuff is struck against a hard surface in a specific manner, inertia may move the double lock bar 801 laterally into a position where the handcuffs are no longer in double locked mode. Striking the handcuffs against a hard surface to dislodge the double lock mechanism 801 is a common tactic used by wearers to unlock the double lock bar system currently in use.

Figure 8B:
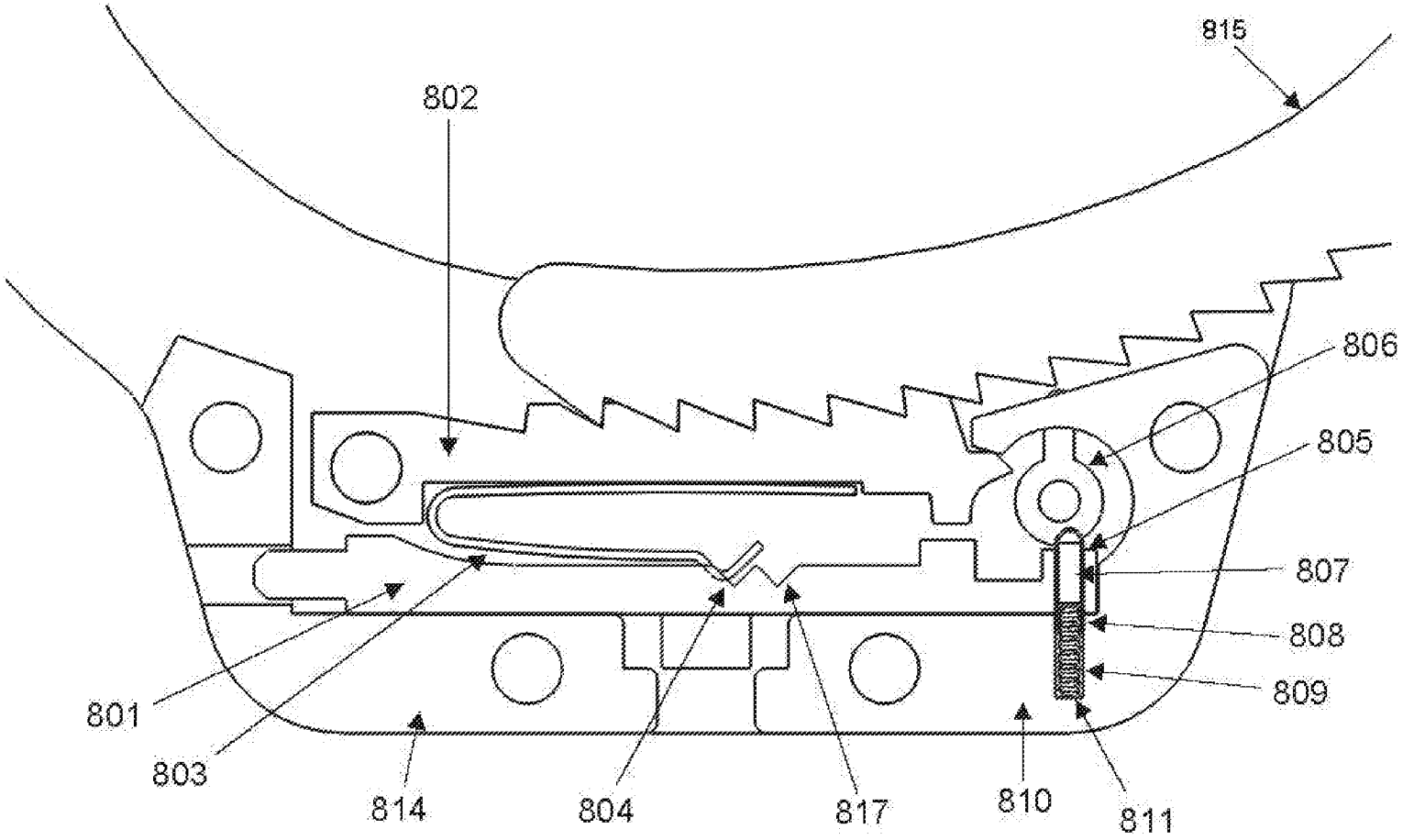
FIG. 8B shows the interior of the handcuffs according to the eighth embodiment where the double lock mechanism is activated and the two-piece plunger is obstructing the ability for the double lock bar to move.
Figure 8C:
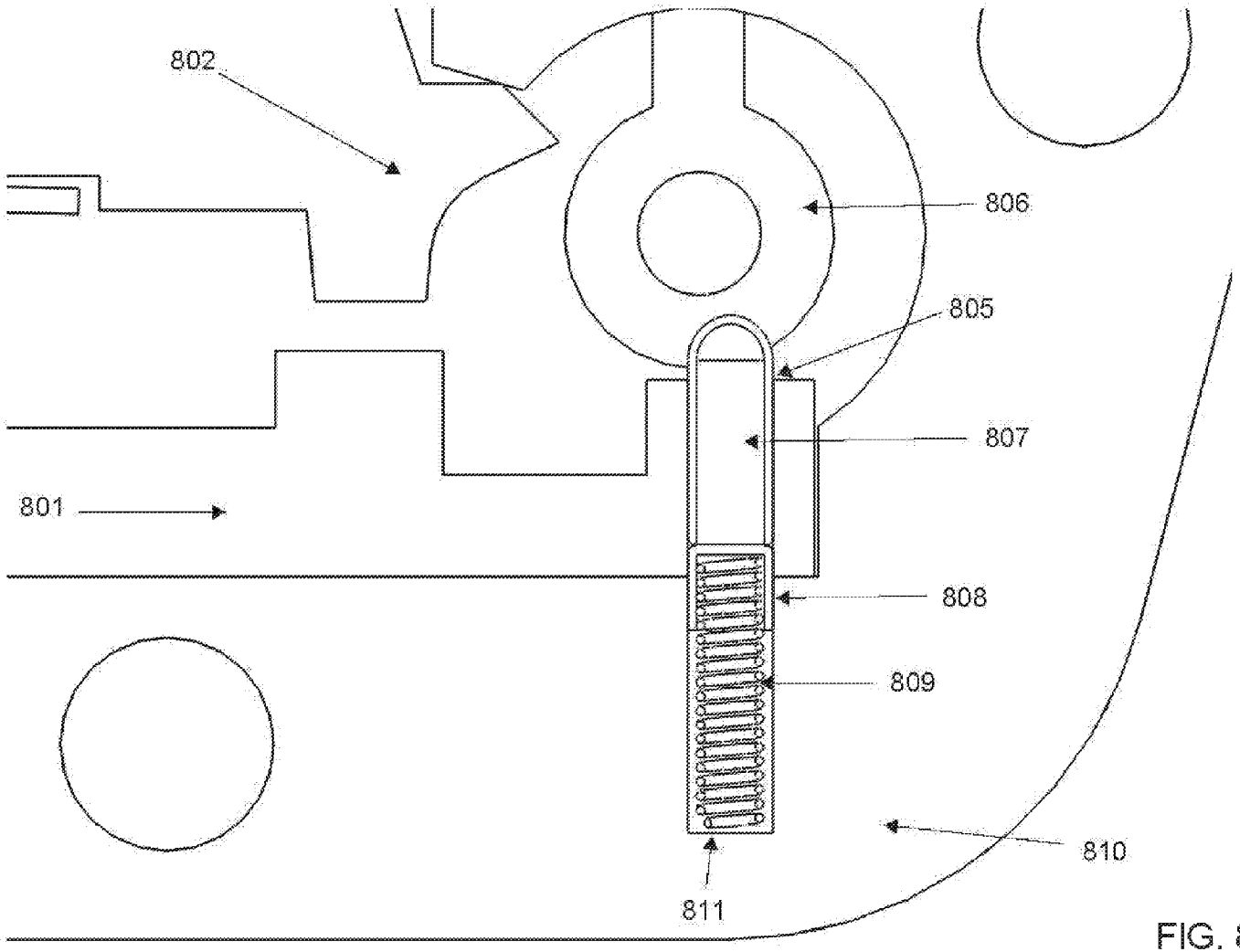
FIG. 8C shows a close up of the plungers elevated into the keyhole area and obstructing the ability for the double lock bar to move according to the eighth embodiment.

From FIG. 8A, double lock bar 801 has a hole 805 in the top portion of the double lock bar 801 near the end closest to the keyhole 806 of the handcuff. As seen in FIG. 8B, a two-piece plunger 807 and 808 is located inside this hole, shown at points 805 and 811, with a spring 809 providing positive pressure upwards from the bottom of mid plate 810. When double lock bar 801 is in the double lock position, the two piece plunger 807 and 808 moves upwards so that the upper portion of the plunger 807 protrudes into keyhole chamber 806 of the handcuffs located within double strand 810. The second piece of plunger 808, located under the upper plunger 807, moves upwards from inside the channel 811 in the bottom of mid plate 810. From FIG. 8C, this upward movement creates a condition whereby the lower plunger cylinder 808 simultaneously engages mid plate 810 and double lock bar 801 in the double lock position thereby preventing double lock bar 801 from moving laterally.

In order for double lock bar 801 to move, plunger 807 and 808 should be depressed or moved downward so that the cylinder of lower plunger 808 moves downward against spring 811. This movement ensures the bottom of the upper plunger 807 and top of the lower plunger 808 are aligned in position where they allow free movement of double lock bar 801.

Figure 8D:
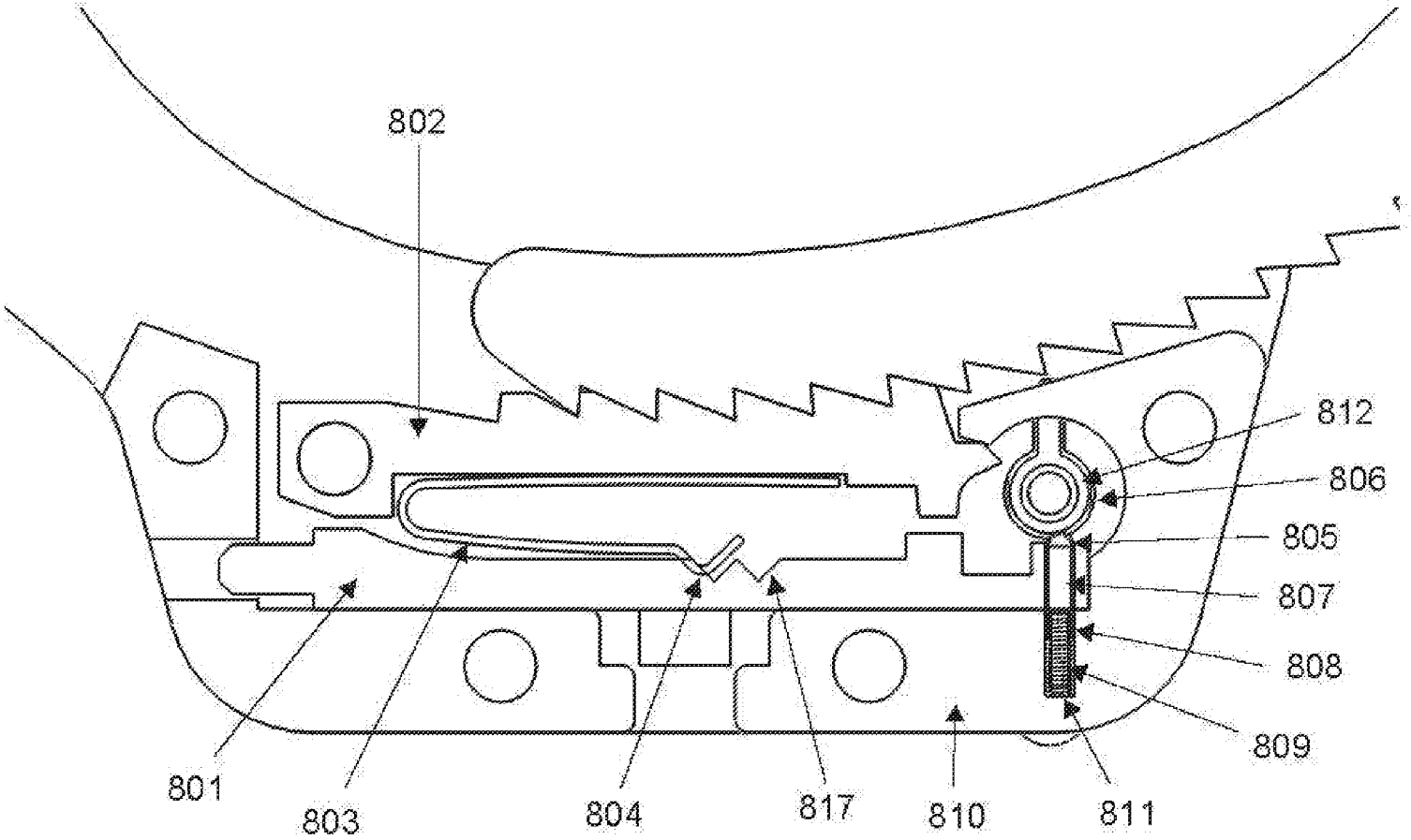
FIG. 8D shows a key inserted into the keyhole thereby depressing the plungers downward and aligning the ability for the double lock bar to move according to the eighth embodiment.
Figure 8E:
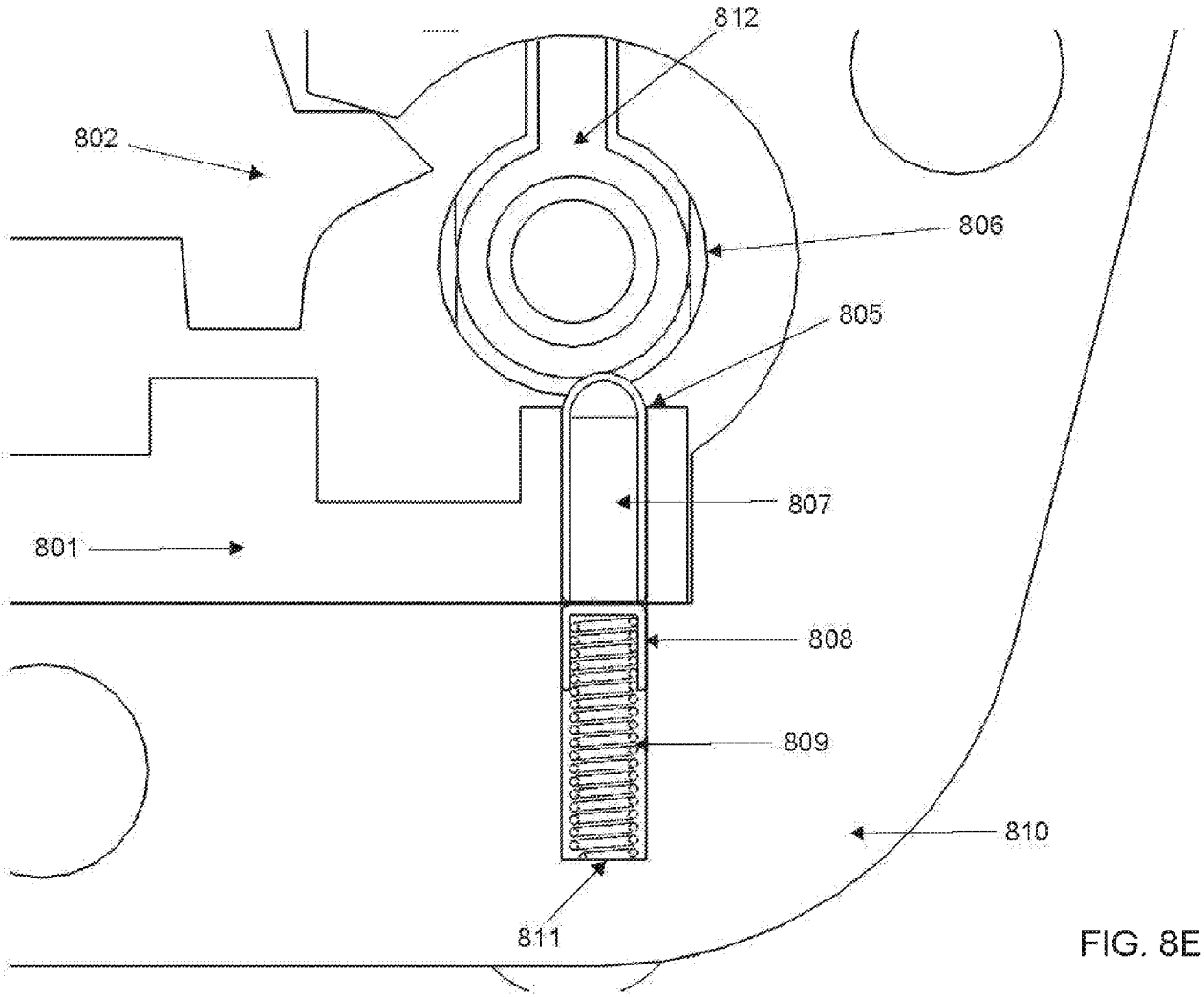
FIG. 8E shows a close view of a key inserted into the keyhole, depressing the plungers downward and aligning the ability for the double lock bar to move according to the eighth embodiment.

From FIG. 8D, this embodiment allows for a universal handcuff key 812 to be placed into handcuff keyhole 806. The handcuff key 812 presses against the rounded or angled upper portion of the upper plunger 807 thereby depressing the plunger 807 and 808 as handcuff key 812 enters the keyhole channel 806 as seen in FIG. 8E.

Figure 8F:
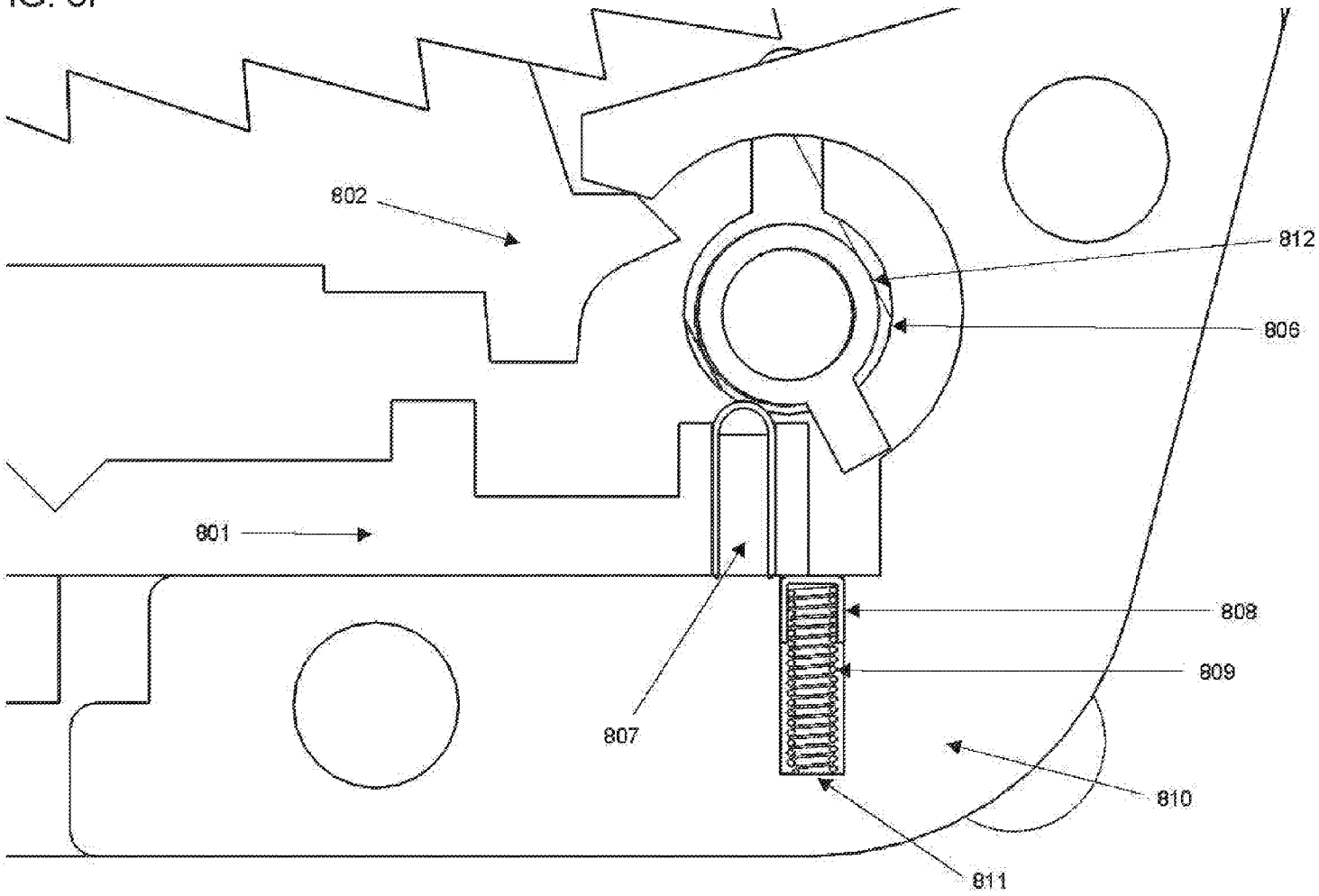
FIG. 8F shows a key inserted, turned and having pushed the double lock bar into an unlocked position according to the eighth embodiment.
Figure 8G:
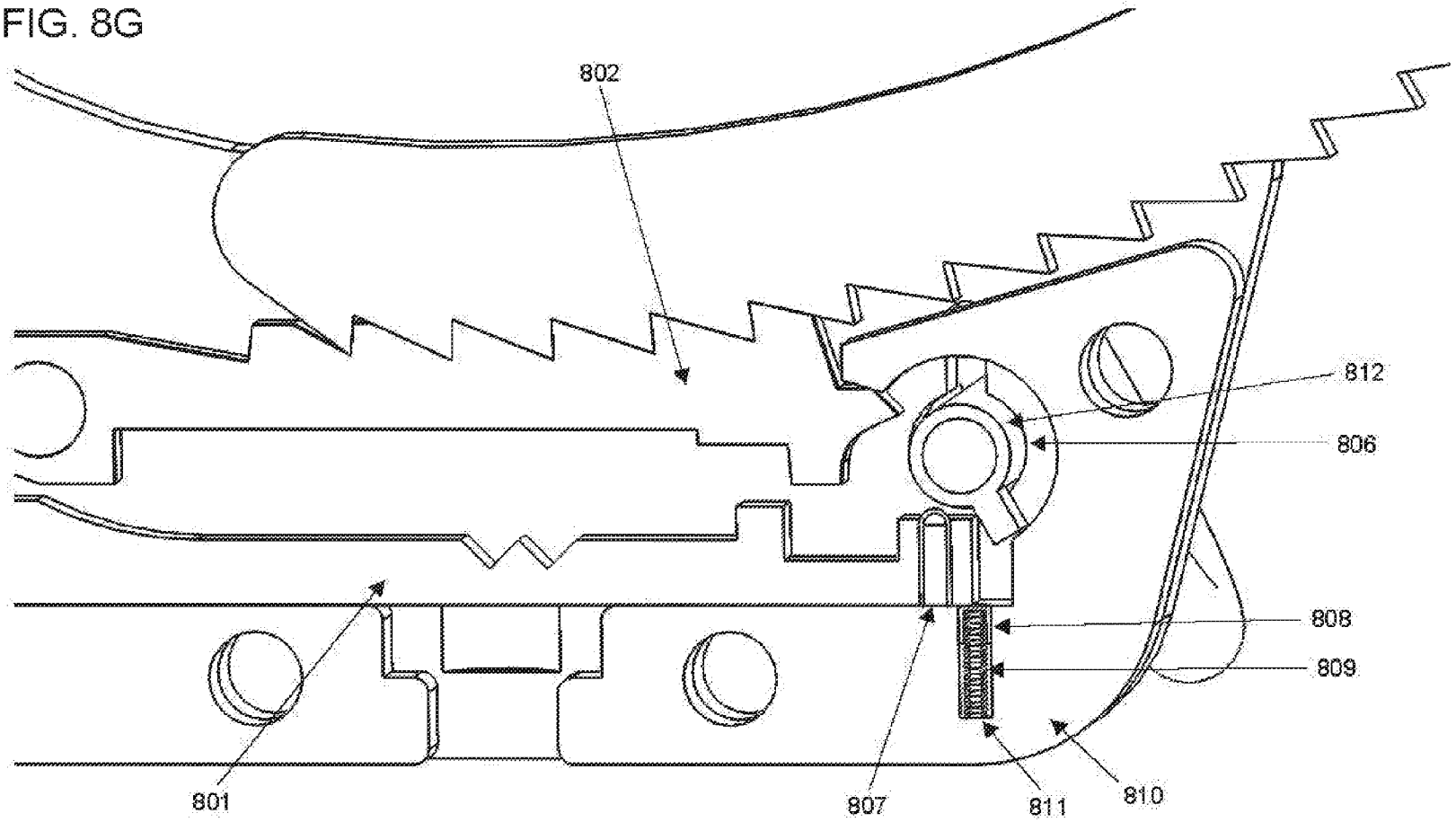
FIG. 8G shows another view of a key inserted, turned and having pushed the double lock bar into an unlocked position according to the eighth embodiment.
Figure 8H:
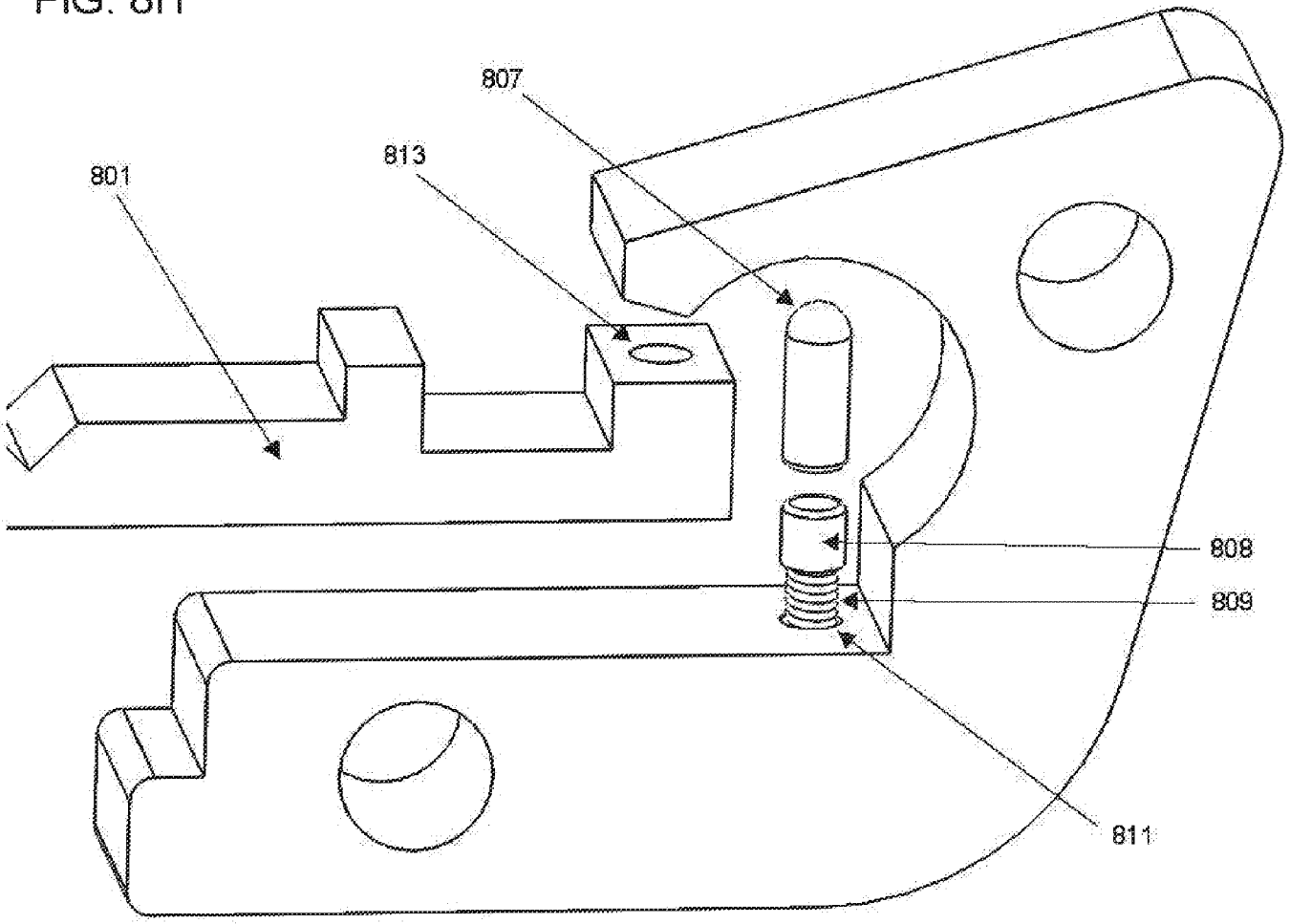
FIG. 8H depicts an exploded view of the mid plate, double lock bar, plungers and spring according to the eighth embodiment.

From FIG. 8F, when double lock bar 801 is moved laterally with a rotating handcuff key 812 into an unlocked position, double lock bar 801 moves with the upper plunger 807 still inside. The lower plunger 808 with spring 809 remains depressed within channel 811 inside mid plate 810 located under double lock bar 801. From FIG. 8G, the bottom of double lock bar 801 covers channel 811 thereby depressing the top of lower plunger cylinder 808 and keeping it in place under spring 809 pressure. An alternate representation of the two piece design of plunger 807 and 808 is shown in FIG. 8H.

The double lock bar 801 may be held in the unlocked "V" notch 818 or double locked "V" notch 804 position by pressure exerted by tab spring 803. Also shown in FIG. 8A are various cuff components, including the first double strand 813, second mid plate 814, single strand 815 and second double strand 816.

Figure 9A:
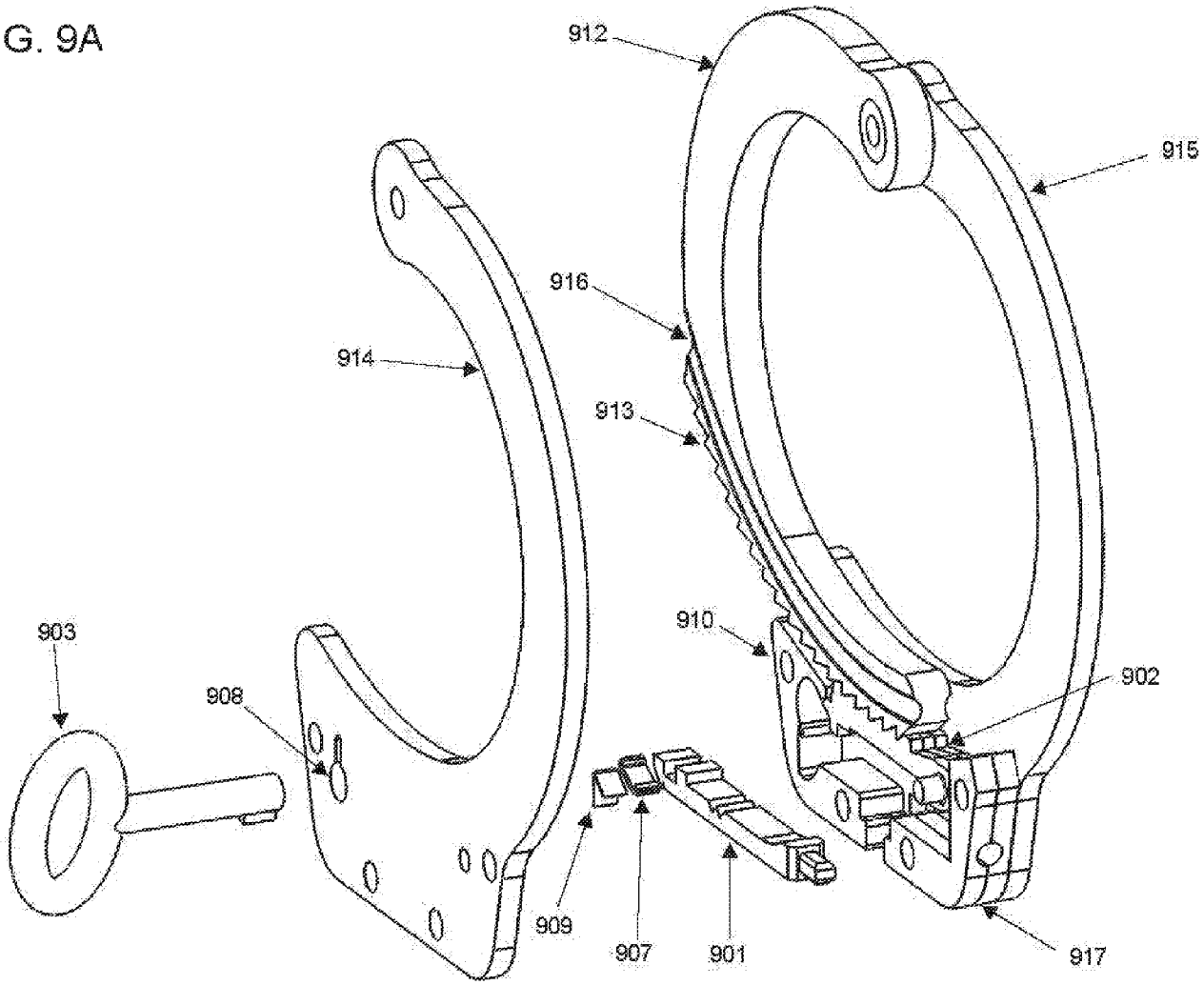
FIG. 9A illustrates and exploded view of a ninth embodiment.
Figure 9B:
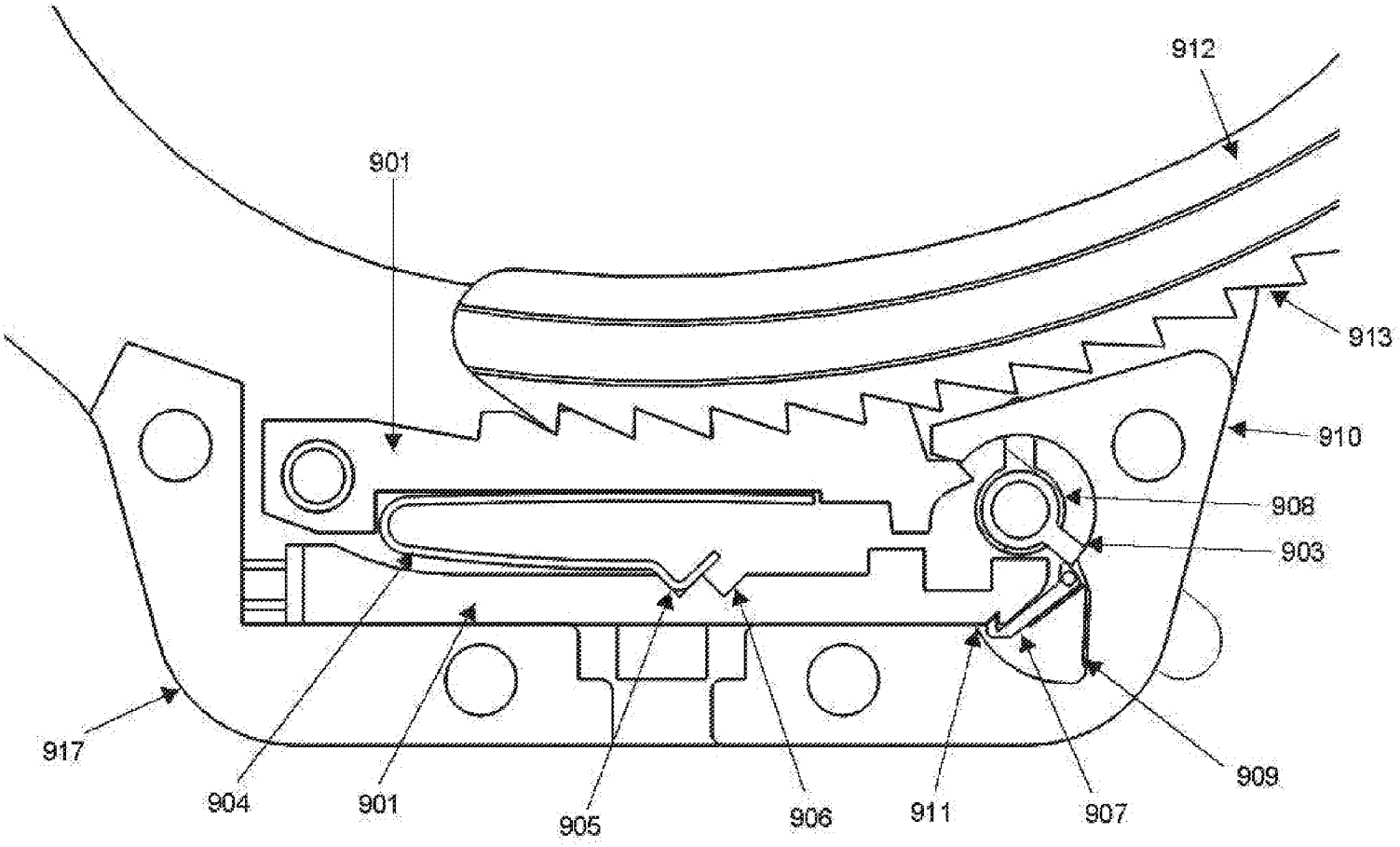
FIG. 9B depicts a key inserted in the keyhole and turned to engage a hook shaped component with the double lock bar engaged.

A further embodiment of the present design is a double lock with hook or passive momentum inhibitor design. From FIG. 9A, a hook shaped component 907 is located adjacent to the handcuff keyhole 908 and pinned into position at the elbow of the hook shaped component 907. This hook shaped component 907 has a small spring 909 that provides positive pressure upwards into the double lock bar 901 against the bottom of mid plate 910. As seen in FIG. 9B, when the handcuffs are placed in a double lock configuration, the hook shaped component 907 moves upwards and engages into a notch 911 located underneath double lock bar 901. This position effectively locks double lock bar 901 into the double locked position as hook shaped component 907 is positively engaged in double lock bar notch 911 to prevent lateral movement.

Figure 9C:
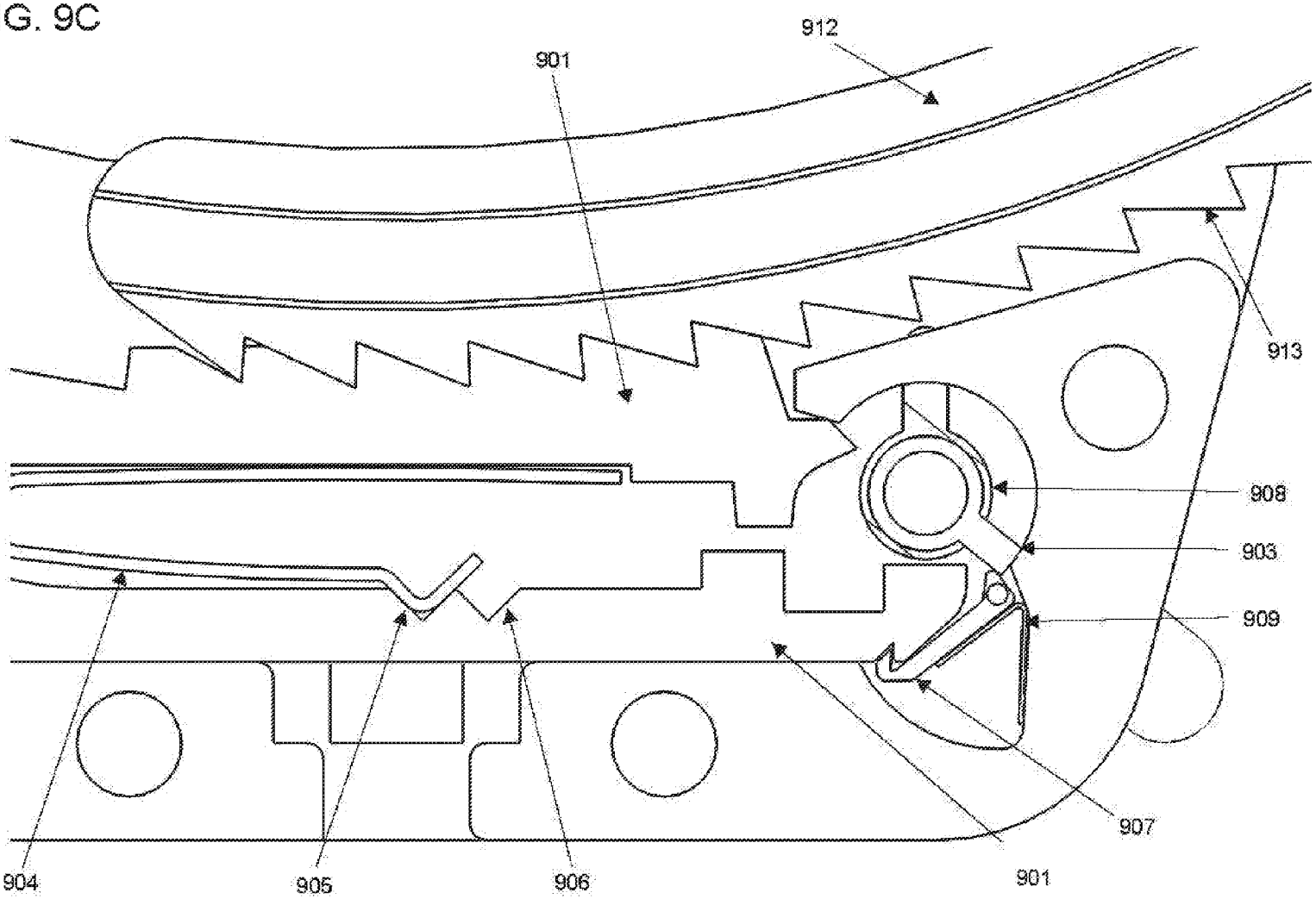
FIG. 9C shows a close up of a key inserted in a keyhole and touching a hook shaped component hooked into a notch underneath the double lock bar according to the ninth embodiment.
Figure 9D:
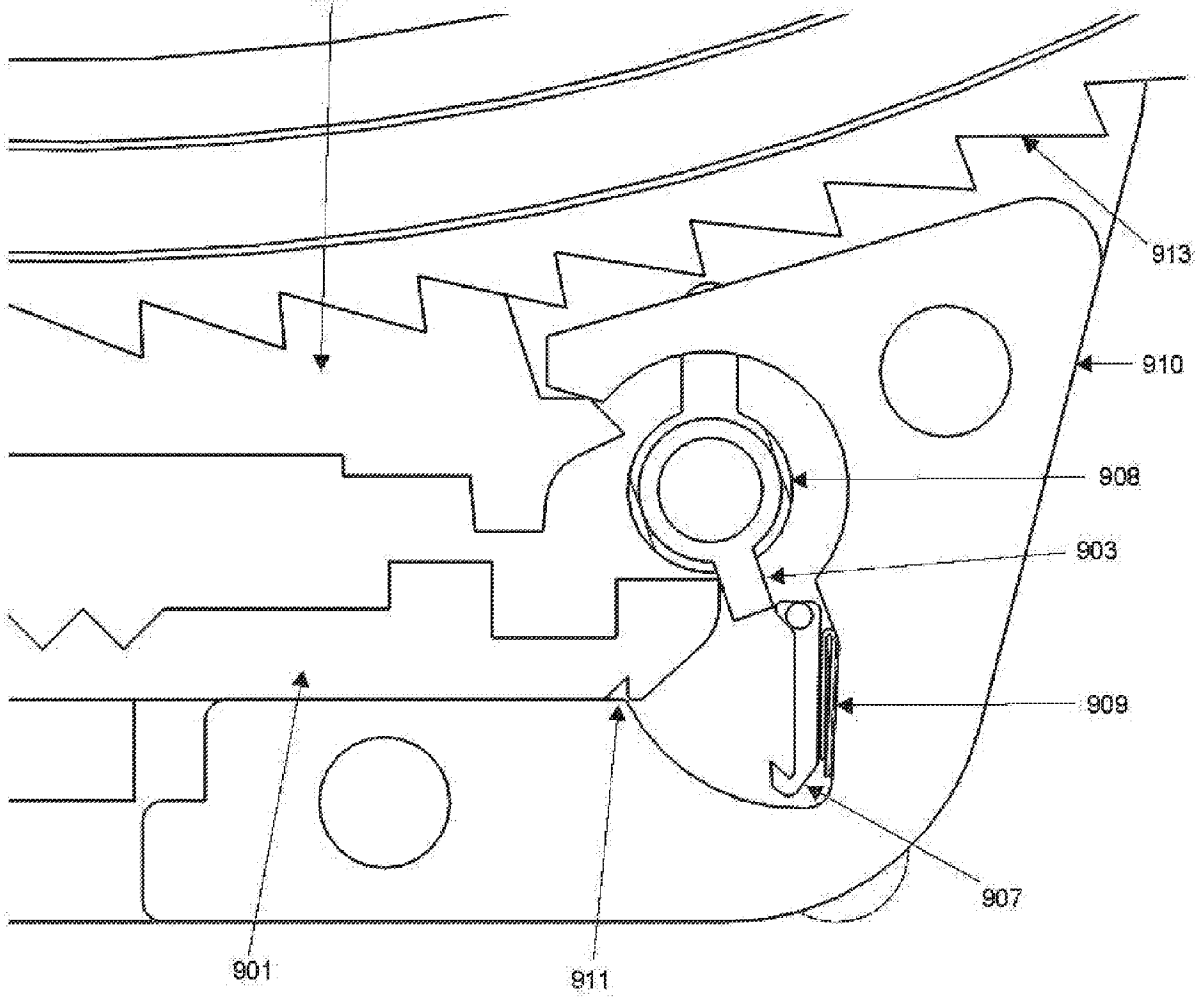
FIG. 9D shows a key inserted into the keyhole and turned to engage and depress a hook shaped component thereby allowing the key to continue to turn and unlock the double lock bar.

As shown in FIG. 9C, when a universal handcuff key 903 is placed in handcuff keyhole 908 and key 903 is rotated to release the double lock mechanism, the bit of handcuff key 908 engages and depresses the hook shaped component 907 first. This engagement forces the hook shaped component 907 downward so that it disengages from double lock bar notch 911. The handcuff key 903 then continues to rotate into double lock bar 901 thereby pushing it laterally out of the double lock position as seen in FIG. 9D. The handcuffs can then be normally unlocked via the handcuff key 908 which depresses the pawls 902 from the ratchet teeth 913 of single strand 912.

When the handcuffs are not in the double lock position, hook shaped bar 907 sits along the bottom of double lock bar 901. When double lock bar 901 moves into the double lock bar position, the hook shaped component 907 engages into a notch 911 located in the bottom of double lock bar 901. This design prevents the double lock mechanism from being moved out of the double lock position unless a handcuff key 903 is placed into handcuff keyhole 908 and turned in order to double lock the system. Also shown in FIG. 9A are various cuff components, including the first double strand 914, second double strand 915, single strand bow 916, second mid plate 917.

Figure 10A:
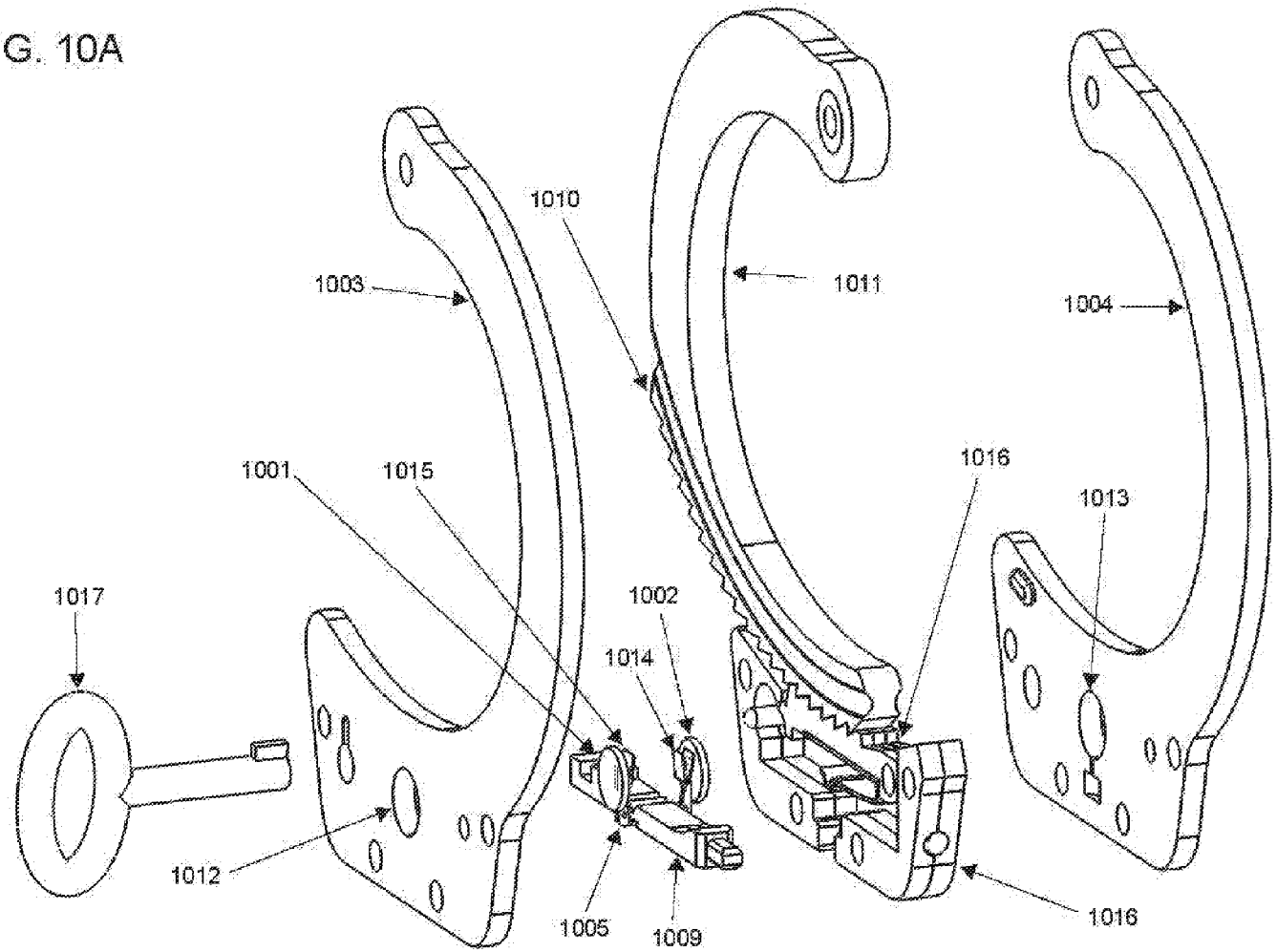
FIG. 10A illustrates an exploded view of a tenth embodiment.

A further embodiment of the present design is shown in FIG. 10A and encompasses a double lock with squeeze buttons on both sides (termed herein a Level 2 action). In this embodiment, two buttons 1001 and 1002 are located on the outside of the double strand 1003 and 1004 centered and on opposing sides of the handcuffs. The buttons 1001 and 1002 are concave and recessed from the exterior of the handcuffs to prevent inadvertently depressing and activating these buttons, although they can be accessed and manipulated via two holes 1012 and 1013 in the double strands 1003 and 1004.

Figure 10B:
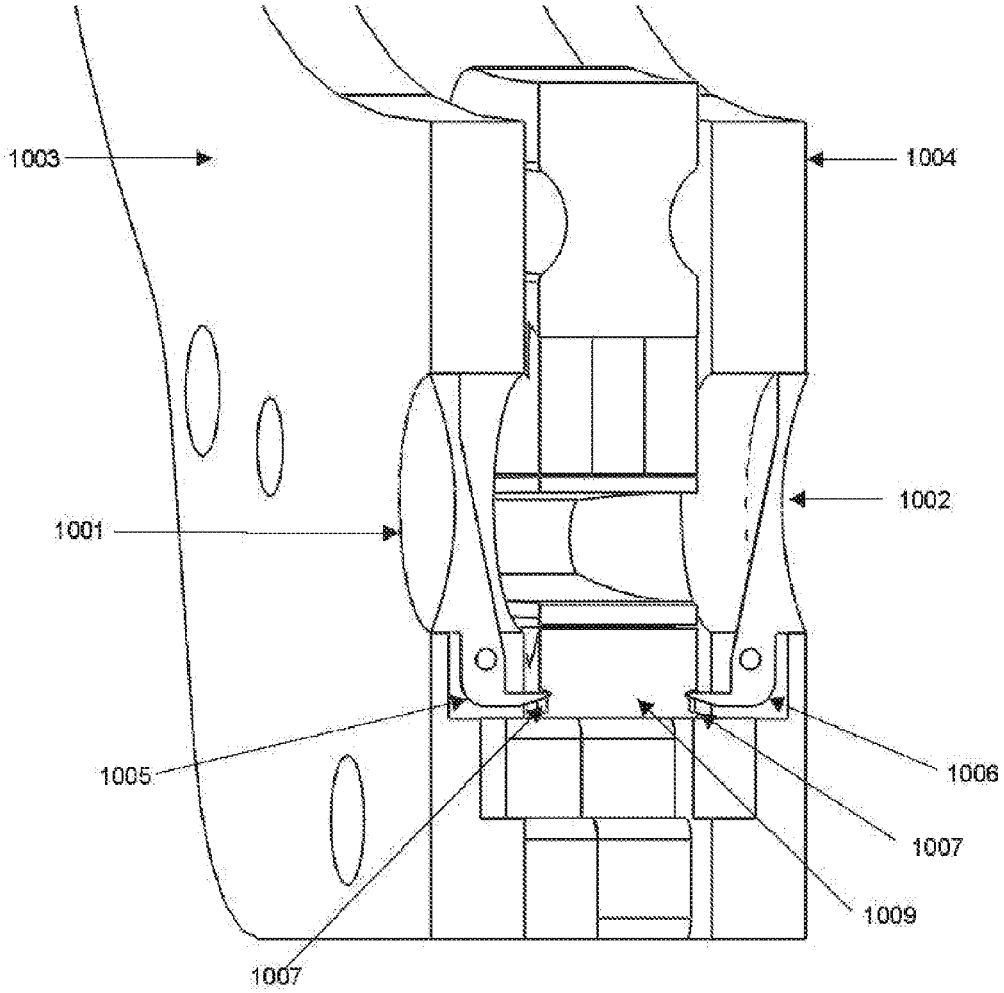
FIG. 10B shows a close up of the buttons not being depressed and engaging notches in the double lock bar.
Figure 10C:
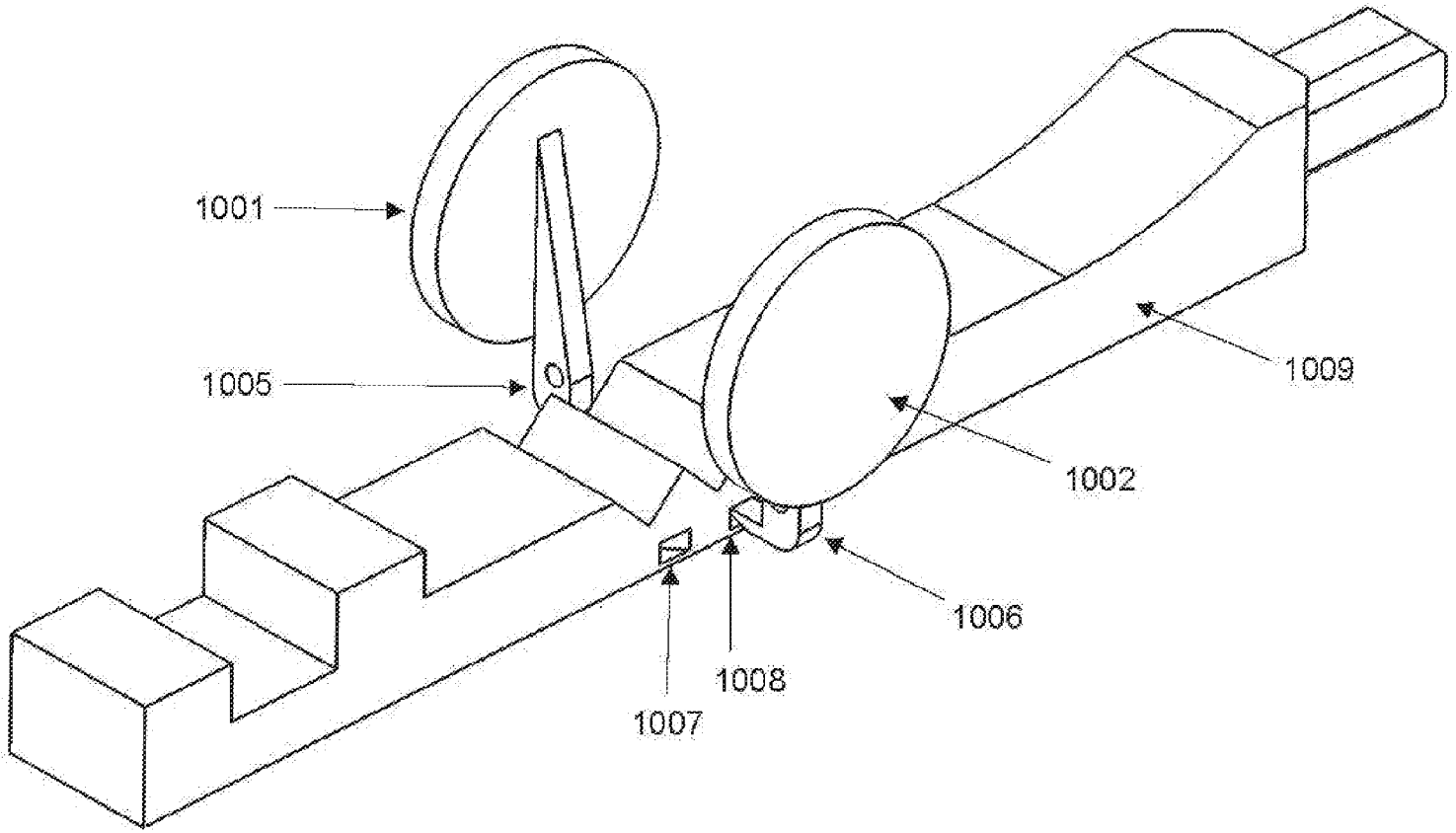
FIG. 10C shows the buttons and how they interface with the double lock bar when not depressed according to the tenth embodiment.

From FIG. 10B, buttons 1001 and 1002 have small extensions with an L shape at the end, shown as L shaped pieces 1005 and 1006. Small springs 1014 and 1015 behind the button faces 1001 and 1002 provide positive pressure outwards from the handcuffs. The L shaped pieces 1005 and 1006 interface with a notch 1008 in the double lock bar 1009 whenever the double lock is engaged, shown in FIG. 10C. When the double lock bar is not engaged, L shaped notches 1005 and 1006 interface with unlocked notches 1007 in double lock bar 1009.

All four notches 1007 and 1008 on both sides of double lock bar 1009 are sculpted to allow for double lock bar 1009 to be moved into the double lock position only without the use of buttons 1001 and 1002. Notches 1007 and 1008 are additionally sculpted so that buttons 1001 and 1002 need to be depressed and the handcuff key 1017 used in order to take the handcuffs out of the double locked position.

This design allows the handcuffs to be double locked and prevents inertia from dislodging double lock bar 1009 thereby unlocking the double lock system. Again, striking handcuffs in order to deactivate the double lock system is a lock picking technique commonly used by suspects.

Figure 10D:
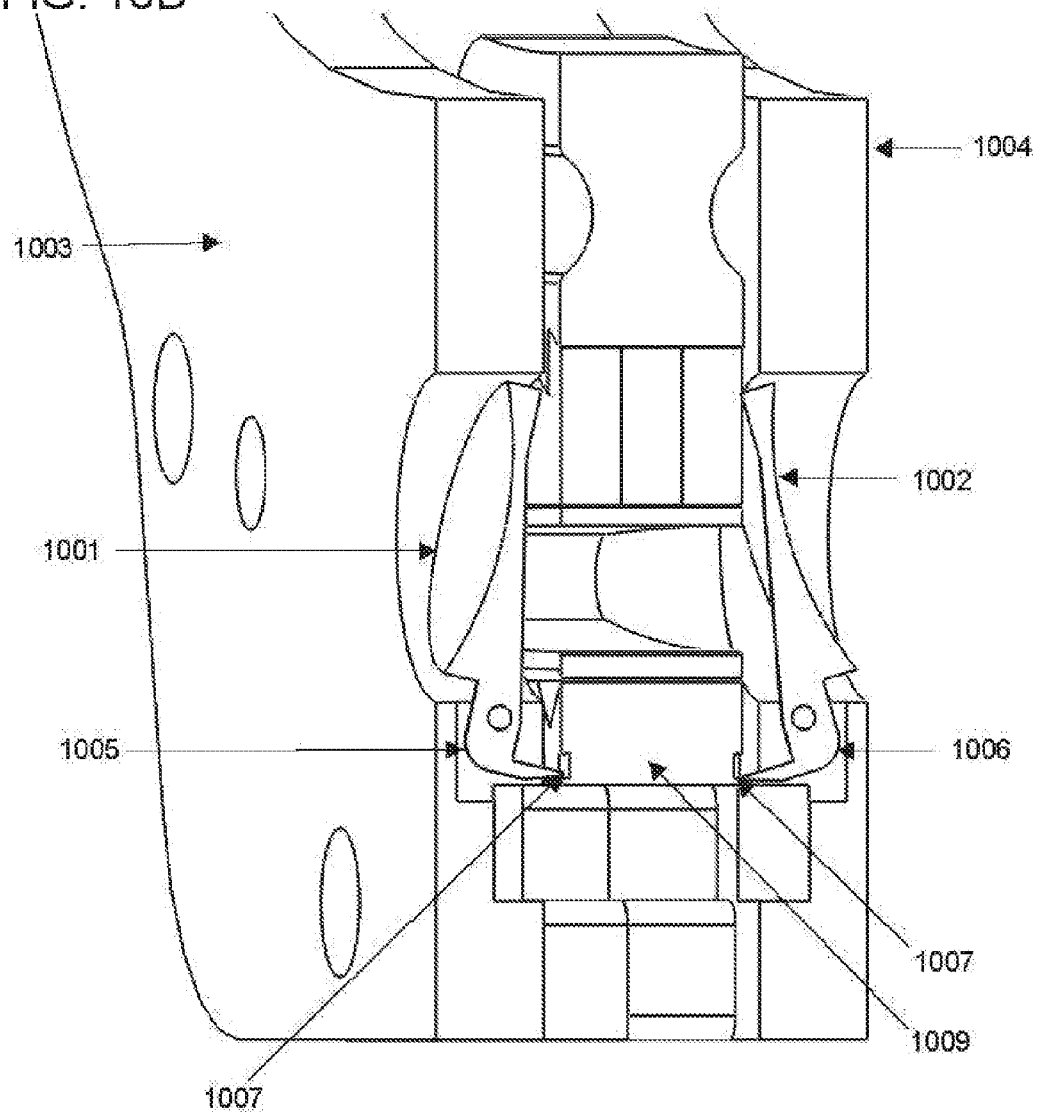
FIG. 10D shows the buttons according to the tenth embodiment depressed and disengaged from the notches in the double lock bar.
Figure 10E:
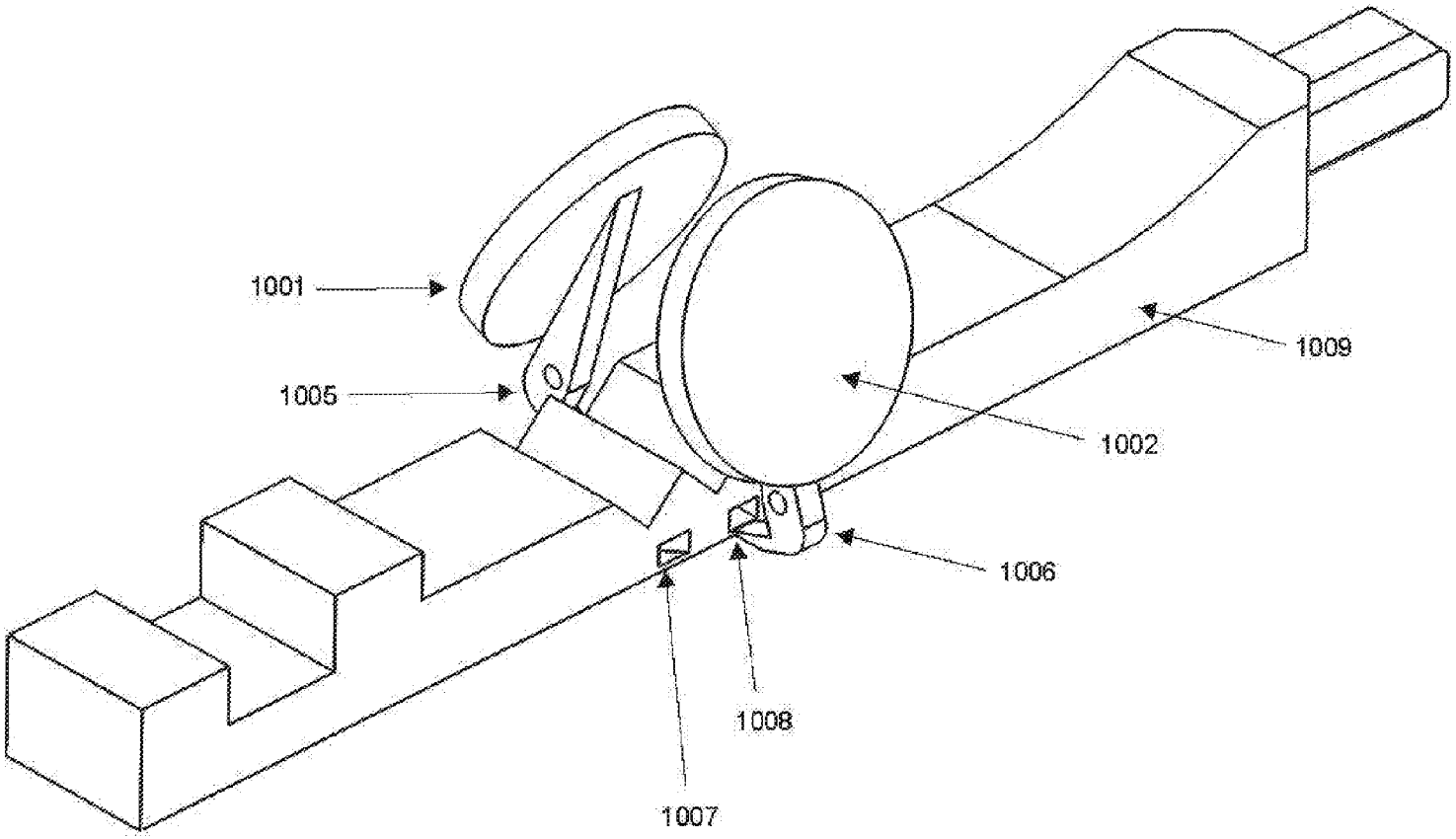
FIG. 10E shows a close up of the buttons being depressed and disengaged from the notches in the double lock bar.
Figure 10F:
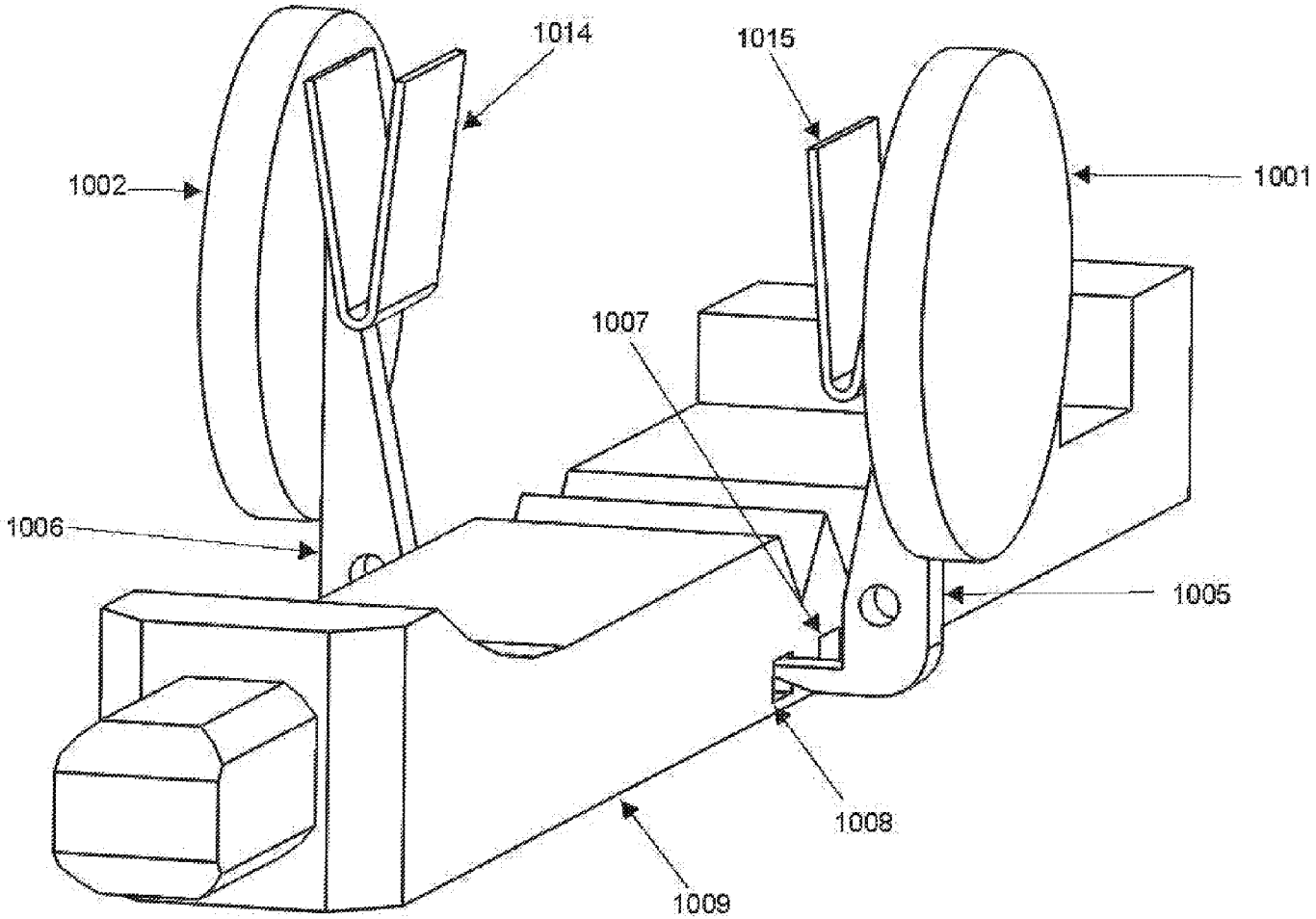
FIG. 10F shows another view of the double lock bar and the buttons engaging with the notches, and the position of the springs relative to the buttons.

From FIG. 10D, buttons 1001 and 1002 may be depressed, compressing springs 1014 and 1015 and moving L shaped pieces 1005 and 1006 out of double lock bar notches 1007 and 1008. When the handcuffs are not in the double lock configuration, L shaped pieces 1005 and 1006 of buttons 1001 and 1002 interface with secondary notch or notches 1007 in double lock bar 1009. As shown in FIG. 10E, these secondary notches 1007 are sculpted to allow movement of the double lock bar 1009 even if the two buttons 1001 and 1002 are not depressed. This will allow an officer to double lock the handcuffs simply by engaging the double lock mechanism 1009 with a universal handcuff key 1017. In such a case, L shaped pieces 1005 and 1006 allow double lock bar 1009 to move into the double lock position. Once the handcuffs are double locked, L shaped pieces 1005 and 1006 automatically enter the primary notches 1008 of double lock bar 1009. FIG. 10F depicts the position of the springs 1014 and 1015 in reference to the buttons 1001 and 1002. Also shown in FIG. 10A are various handcuff components, including ratchet teeth 1010, single strand 1011 and mid plate 1016.

A further embodiment of the present design is shown in FIG. 11 and includes a double lock with slider buttons on both sides (again a Level 2 action). In this embodiment, two buttons 1101 and 1102 are centered on the handcuffs and protrude through two holes 1115 and 1116 located on the outside of double strands 1103 and 1104. Buttons 1101 and 1102 are concave and recessed from the exterior of the handcuffs to prevent inadvertently depressing or moving buttons 1101 and 1102.

Figure 11A:
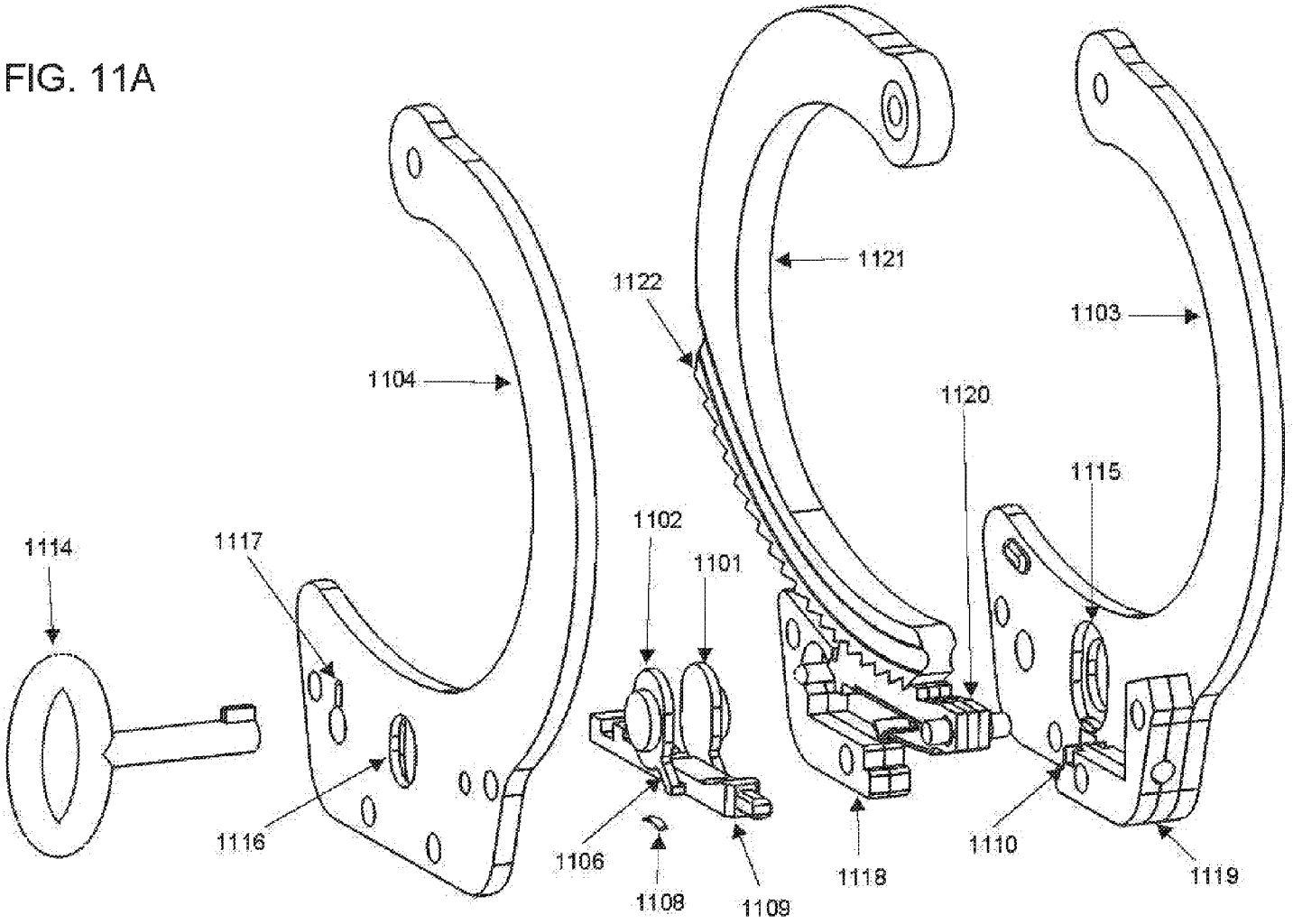
FIG. 11A illustrates an exploded view of an eleventh embodiment.
Figure 11B:
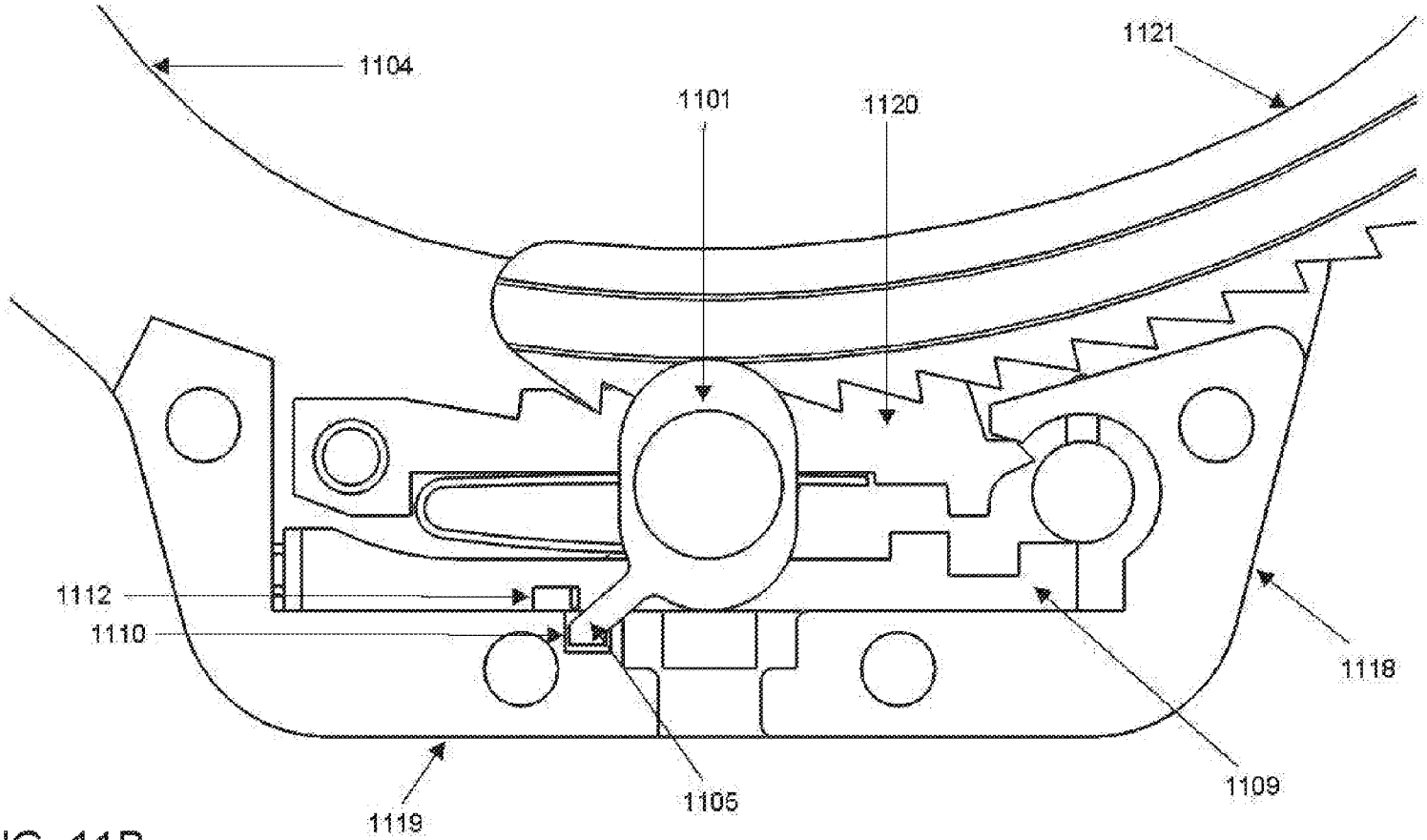
FIG. 11B shows the handcuff according to the eleventh embodiment where the double lock function is not engaged and the button is not interfaced with the notches in the double lock bar.
Figure 11C:
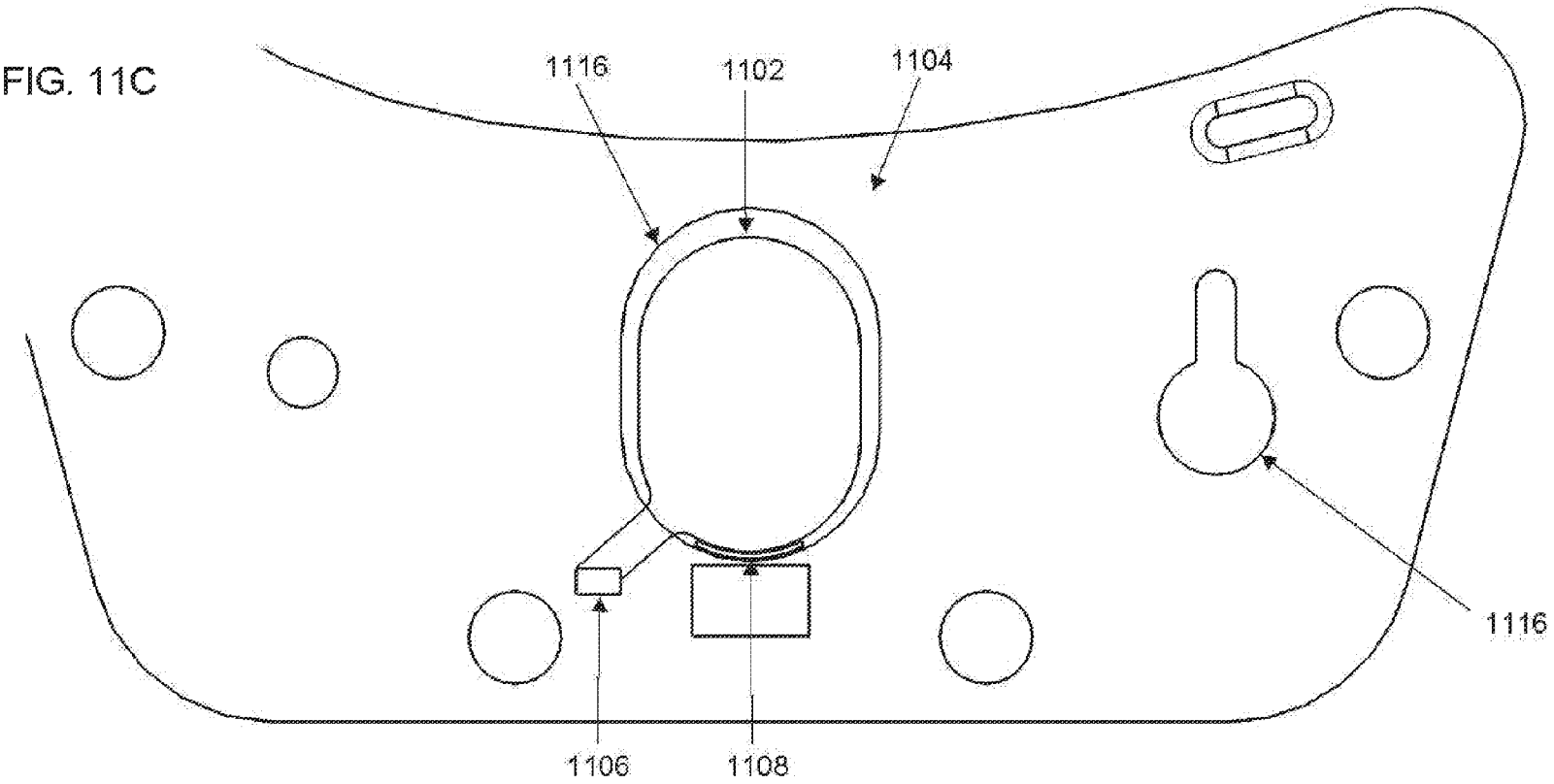
FIG. 11C shows the inside of a double strand plate with the button and spring installed, where the button is not in double lock mode and the spring is compressed.

Buttons 1101 and 1102 have small extensions with L shape components 1105 and 1106 at the end. Small springs 1107 and 1108 sit underneath L shaped components 1105 and 1106 providing positive pressure upwards into double lock bar 1109. When the handcuffs do not have double lock mechanism 1109 activated, L shaped components 1105 and 1106 sit under double lock bar 1109 in channels 1110 and 1111 with small springs 1107 and 1108 under pressure as shown in FIG. 11B. Additionally, FIG. 11C shows the spring 1108 depressed and exerting pressure upwards into double lock bar 1109.

Figure 11D:
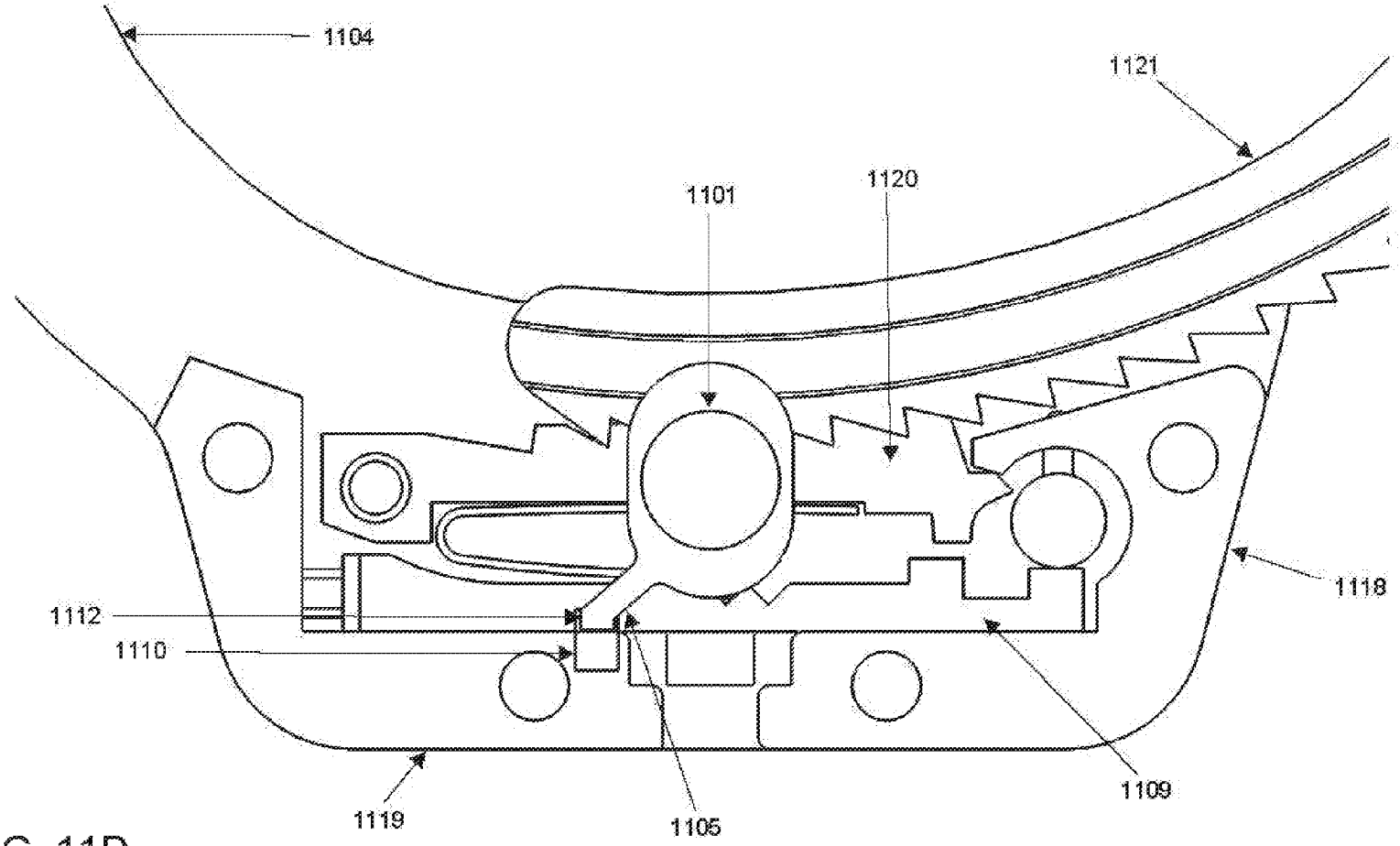
FIG. 11D shows the handcuff according to the eleventh embodiment in double lock mode and the button interfaced with the notches in the double lock bar.
Figure 11E:
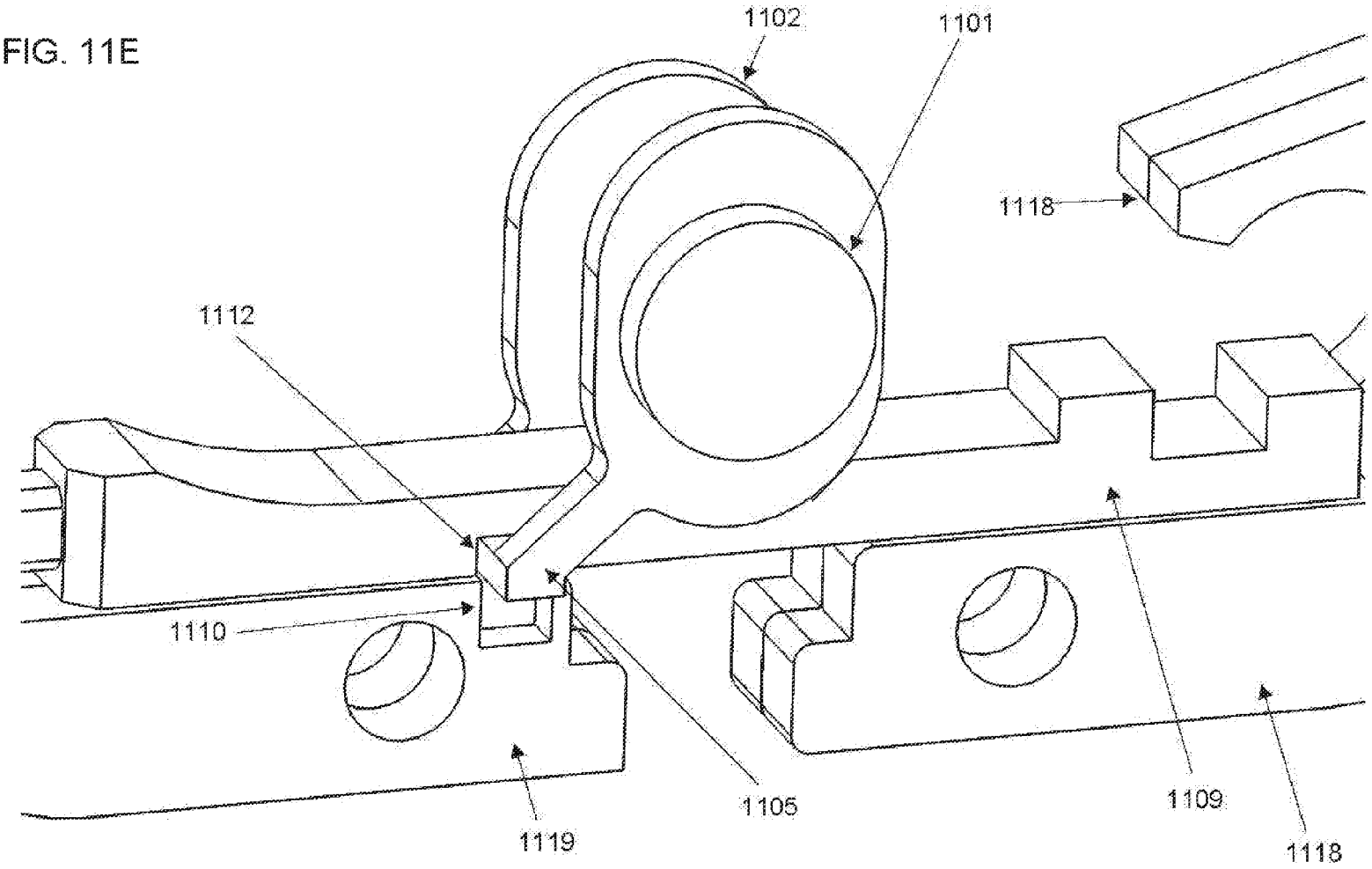
FIG. 11E shows a close up of the double lock bar in the double locked position with the buttons interfaced with the double locked notches according to the eleventh embodiment.
Figure 11F:
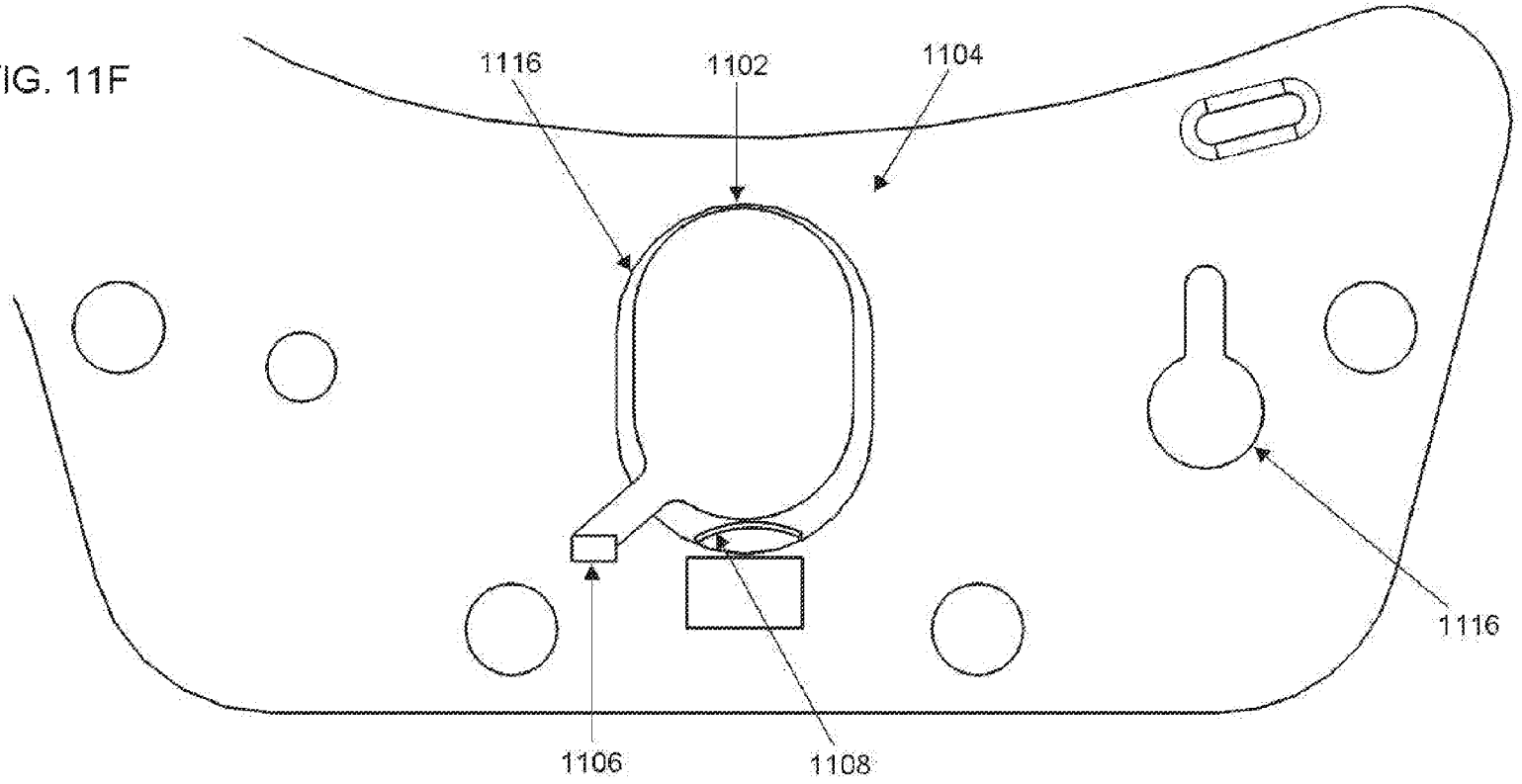
FIG. 11F shows the inside of a double strand plate with the button and spring installed where the button is in double lock mode and the spring is not compressed.

From FIG. 11D, when double lock mechanism 1109 is engaged, L shaped components 1105 and 1106 interface with notches 1112 and 1113 underneath double lock bar 1109. As shown in FIG. 11E, this engagement prevents double lock bar 1109 from moving out of the double lock position unless both buttons 1101 and 1102 are pulled downwards and the handcuff key 1114 is simultaneously used to unlock the double lock mechanism 1109. FIG. 11F shows the rear of double strand 1104 plate with the rear of button 1102, where the spring 1108 has pushed the button 1102 and L shaped component 1106 upwards. Also shown in FIG. 11A are various handcuff components, including the keyhole 1117, first mid plate 1118, second mid plate 1119, pawl(s) 1120, single strand 1121 and ratchet teeth 1122.

Figure 12A:
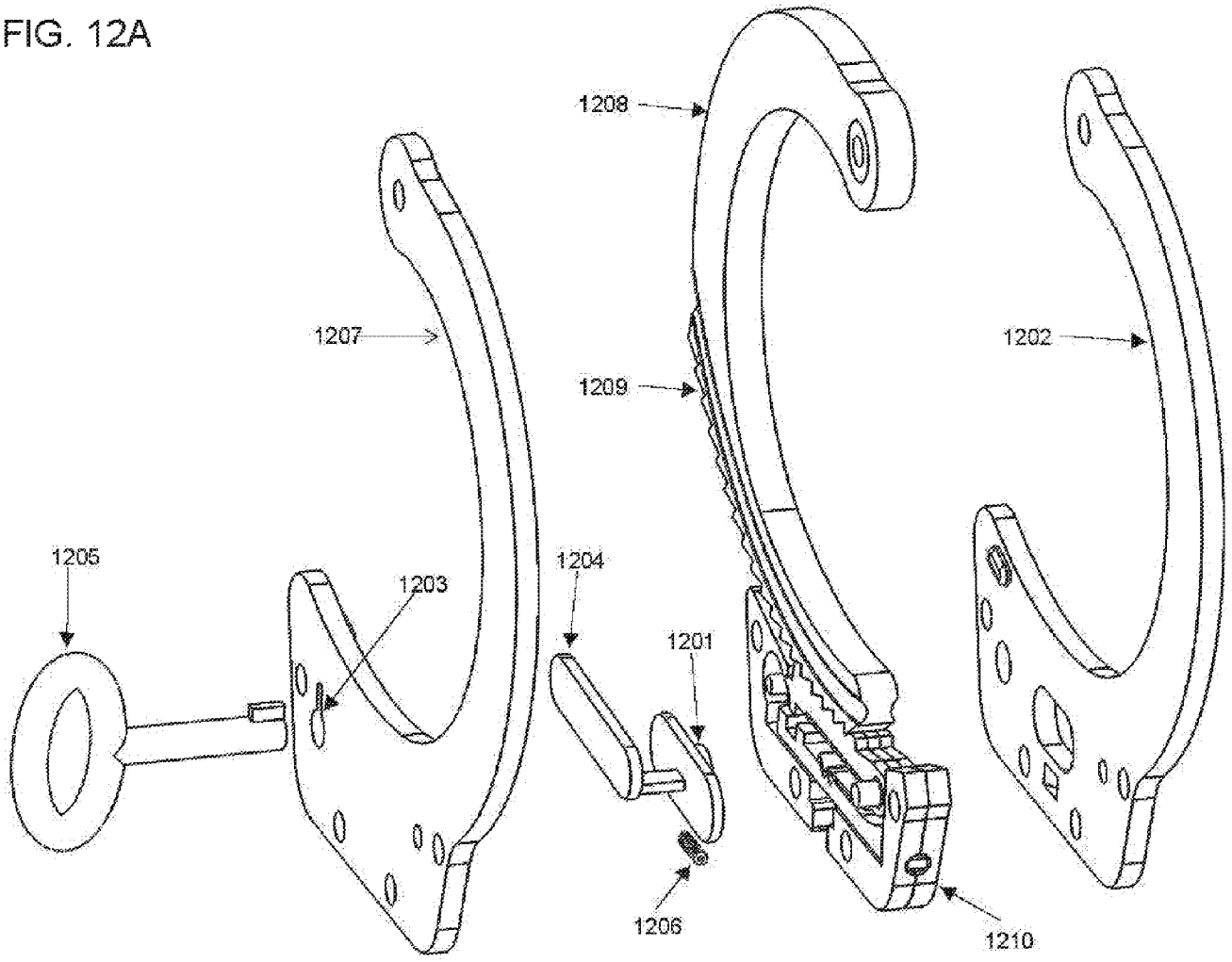
FIG. 12A illustrates an exploded view of a twelfth embodiment.
Figure 12B:
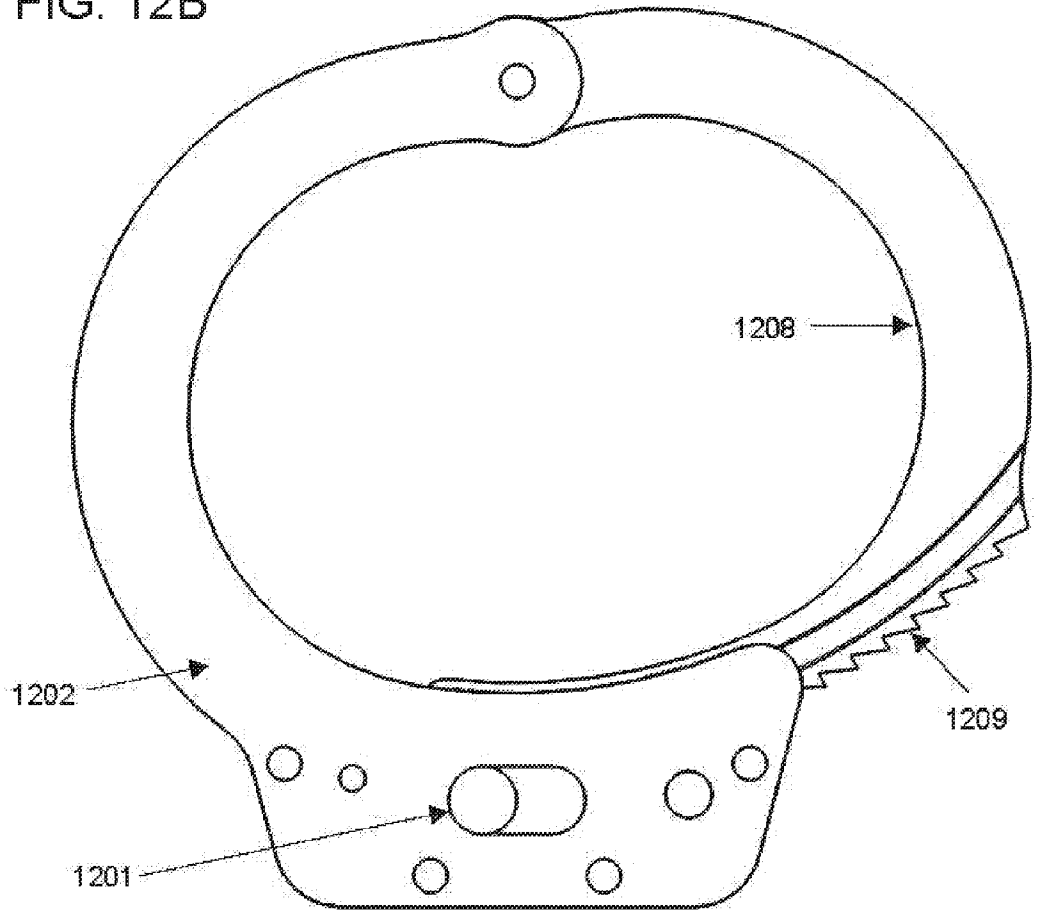
FIG. 12B shows the exterior of the handcuff according to the twelfth embodiment with a sliding button.
Figure 12C:
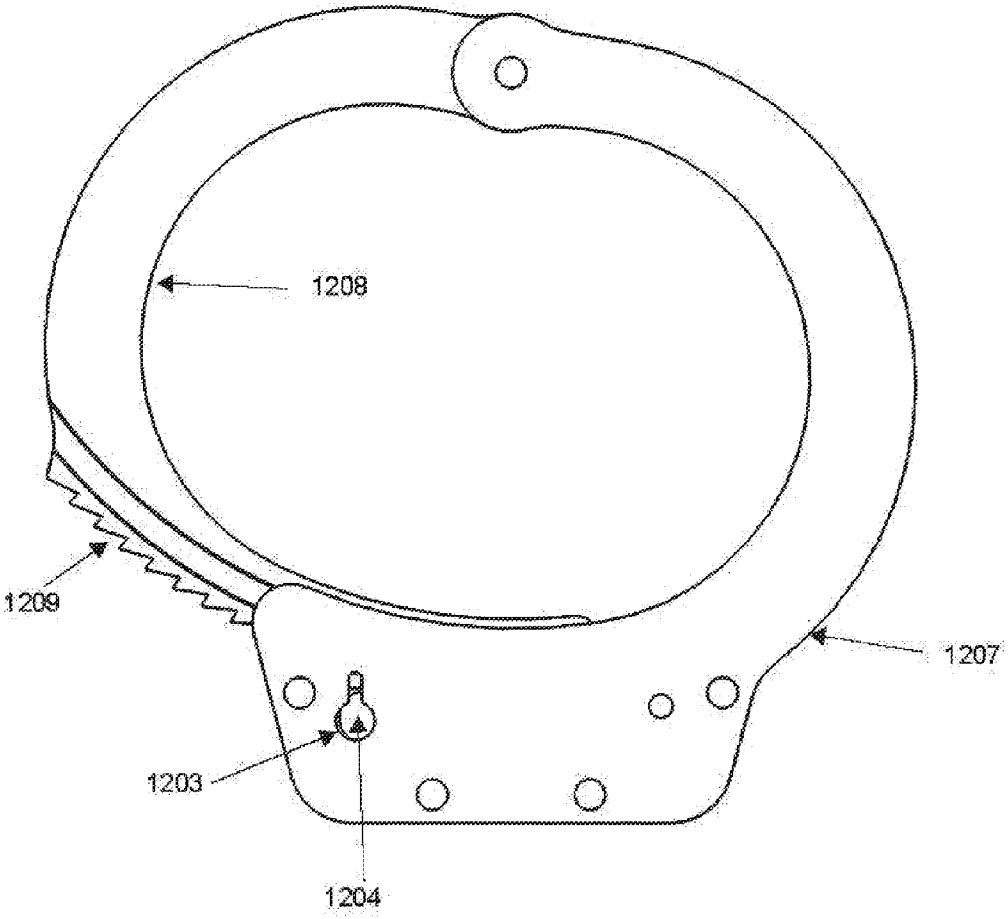
FIG. 12C shows the exterior of the handcuff according to the twelfth embodiment with the keyhole.

A further embodiment of the present design is a sliding keyhole blocking plate embodiment (opposite side of keyhole). Shown in FIG. 12A is a sliding keyhole block button 1201 positioned on double strand 1202 opposite keyhole 1203 on the handcuff. The sliding keyhole block button 1201 is recessed into double strand 1202 with a concave surface to prevent inadvertent activation, where an alternate view is shown in FIG. 12B. The concave button 1201 surface ensures the button cannot be activated by side pressure on the double strand 1202 and 1207 unless the button is physically pushed in a direction away from keyhole 1203. The sliding keyhole block button 1201 is attached to a keyhole block cover 1204. When at rest (no pressure applied), the sliding cover 1204 blocks keyhole 1203 from a handcuff key 1205 being inserted such as is shown in FIG. 12C. In this embodiment, the sliding keyhole block button 1201 on double strand 1202 opposite keyhole 1203 makes it difficult for a person to simultaneously slide keyhole plate button 1201 and manipulate a handcuff key 1205 with the same hand.

Figure 12D:
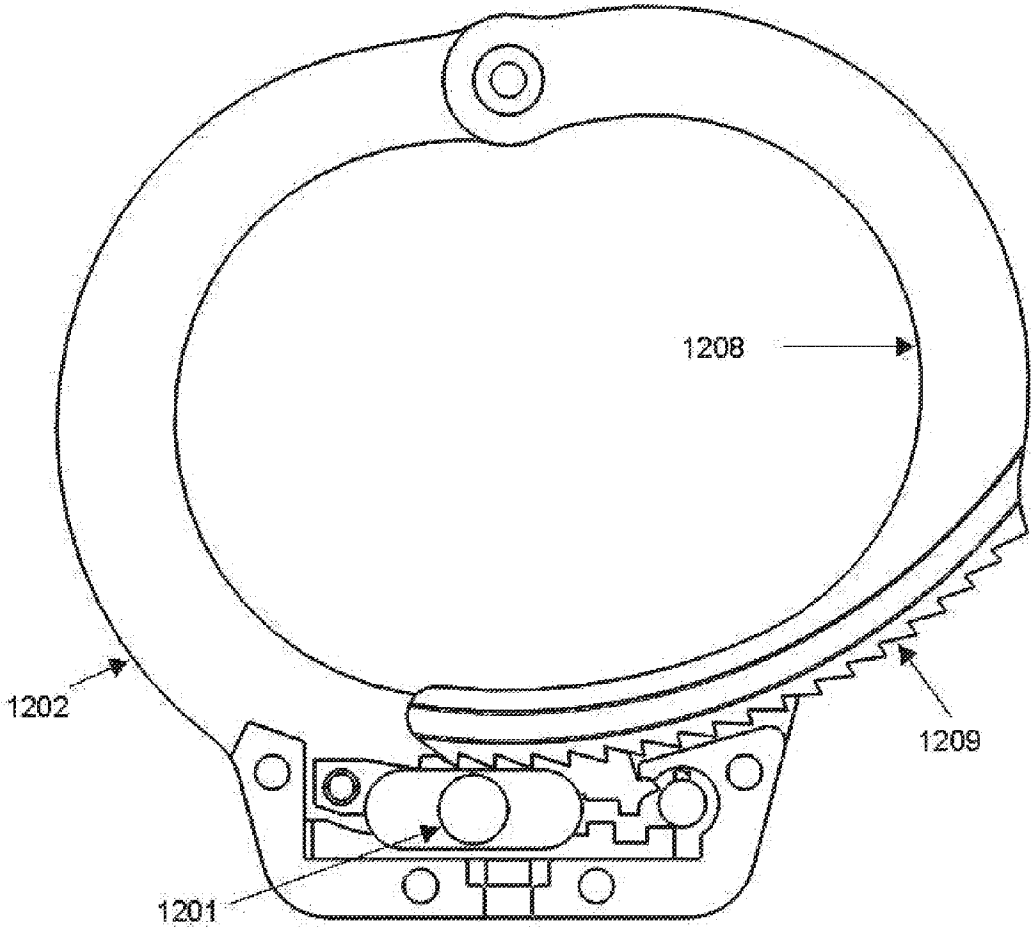
FIG. 12D shows the button in rest mode whereby the sliding cover obstructs the keyhole.
Figure 12E:
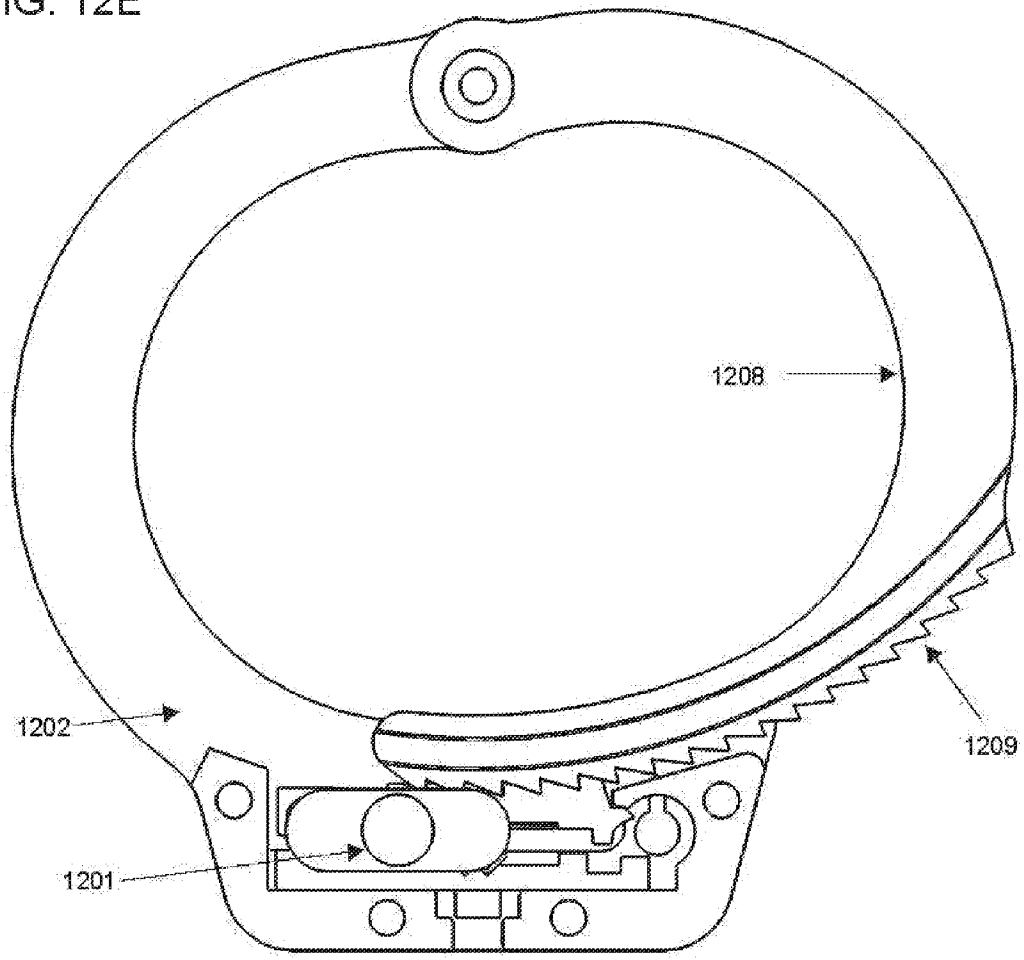
FIG. 12E shows the button retracted whereby the sliding cover no longer obstructs the keyhole.
Figure 12F:
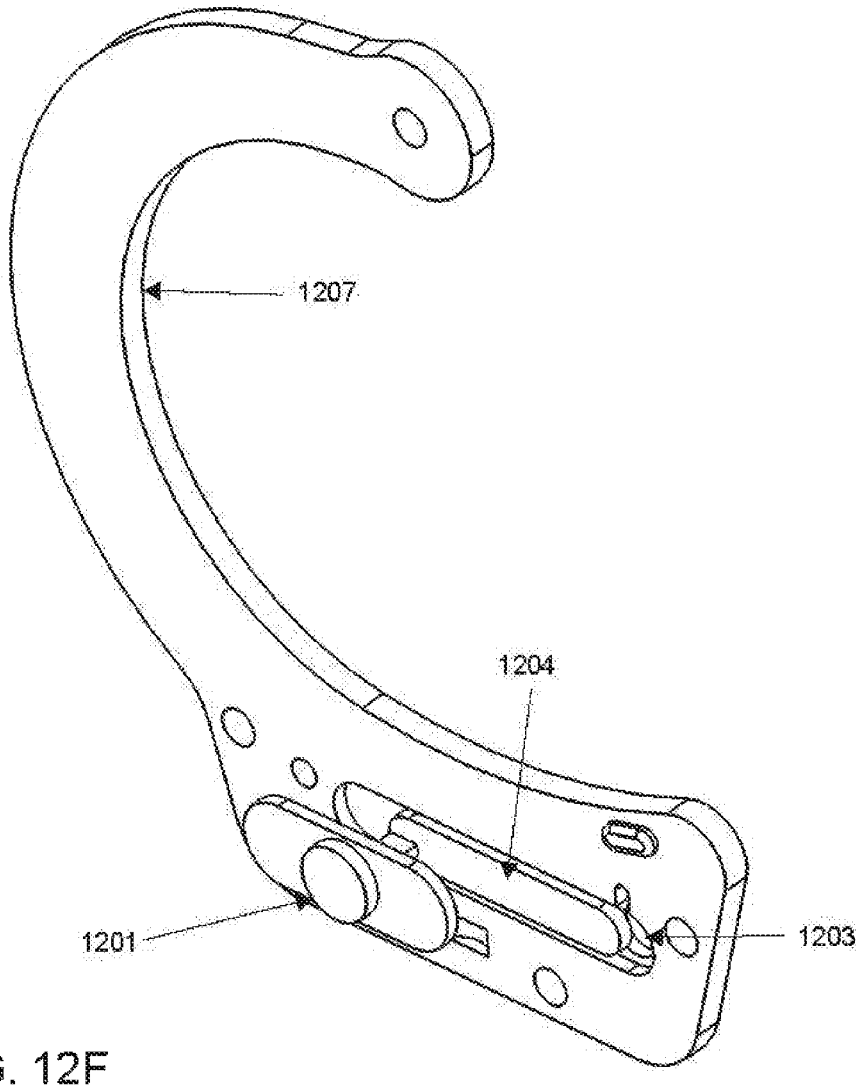
FIG. 12F depicts the button mechanism and its interface with the double strand according to the twelfth embodiment.
Figure 12G:
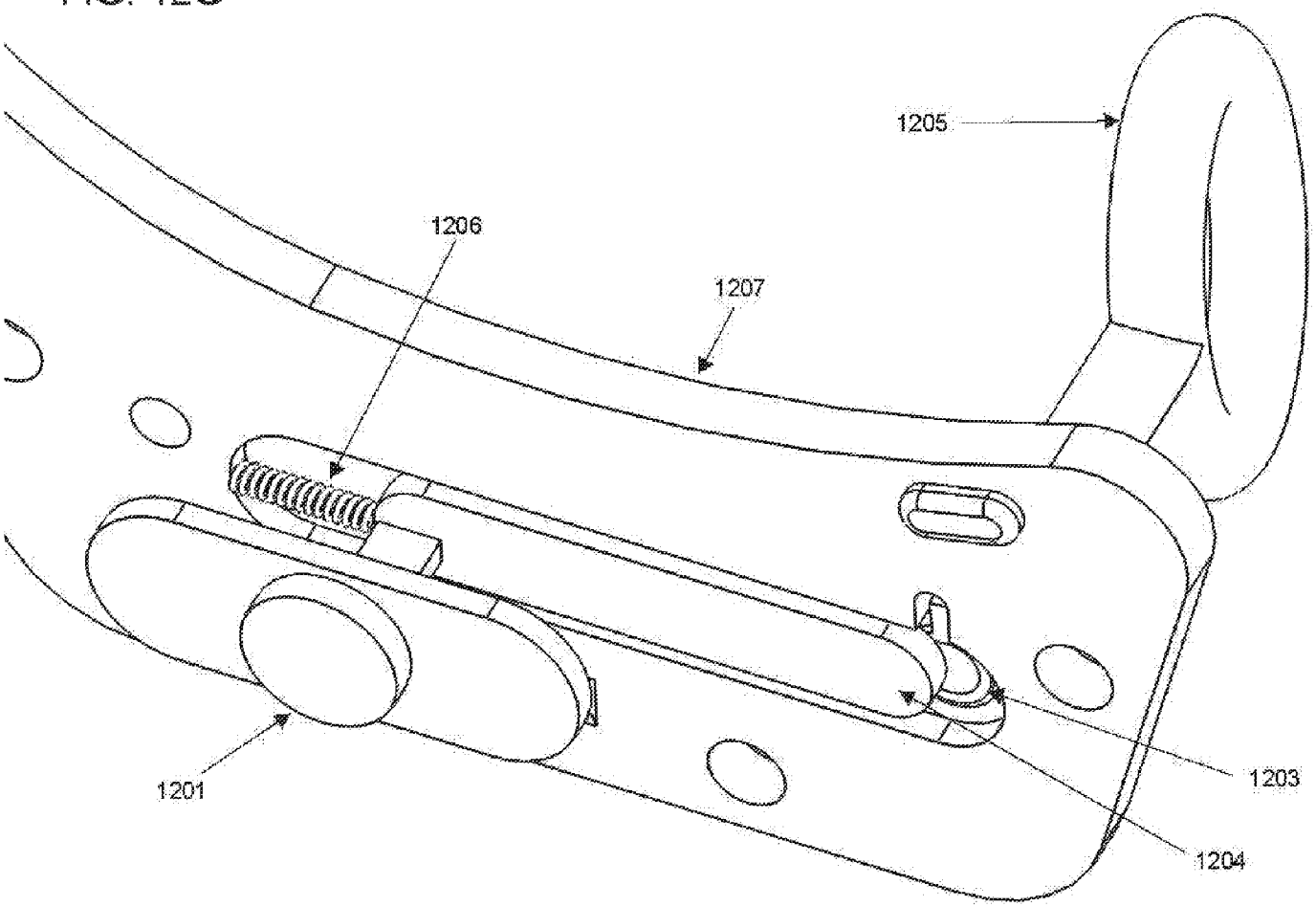
FIG. 12G shows the button mechanism with a spring according to the twelfth embodiment.

FIG. 12D shows the sliding button 1201 in the rest position (with no pressure exerted), where spring 1206 exerts pressure on button cover 1204 to close the cover. In FIG. 12E, button 1201 has been retraced thereby exposing handcuff keyhole 1203 on the opposite of the handcuff. FIG. 12F depicts the shape of the sliding button 1201 and connected keyhole cover plate 1204 and the interface with double strand 1202. FIG. 12G shows keyhole block button 1201 with corresponding spring 1206 in double strand 1202 and spring 1206 exerting pressure on sliding block button 1201. As a result, the handcuff key 1205 has an inability to be fully inserted into the handcuff locking mechanism and therefore cannot be used to unlock the handcuff. Also shown in FIG. 12A are various handcuff components, including the second double strand 1207, single strand 1208, ratchet teeth 1209 and the mid plate 1210.

Figure 13A:
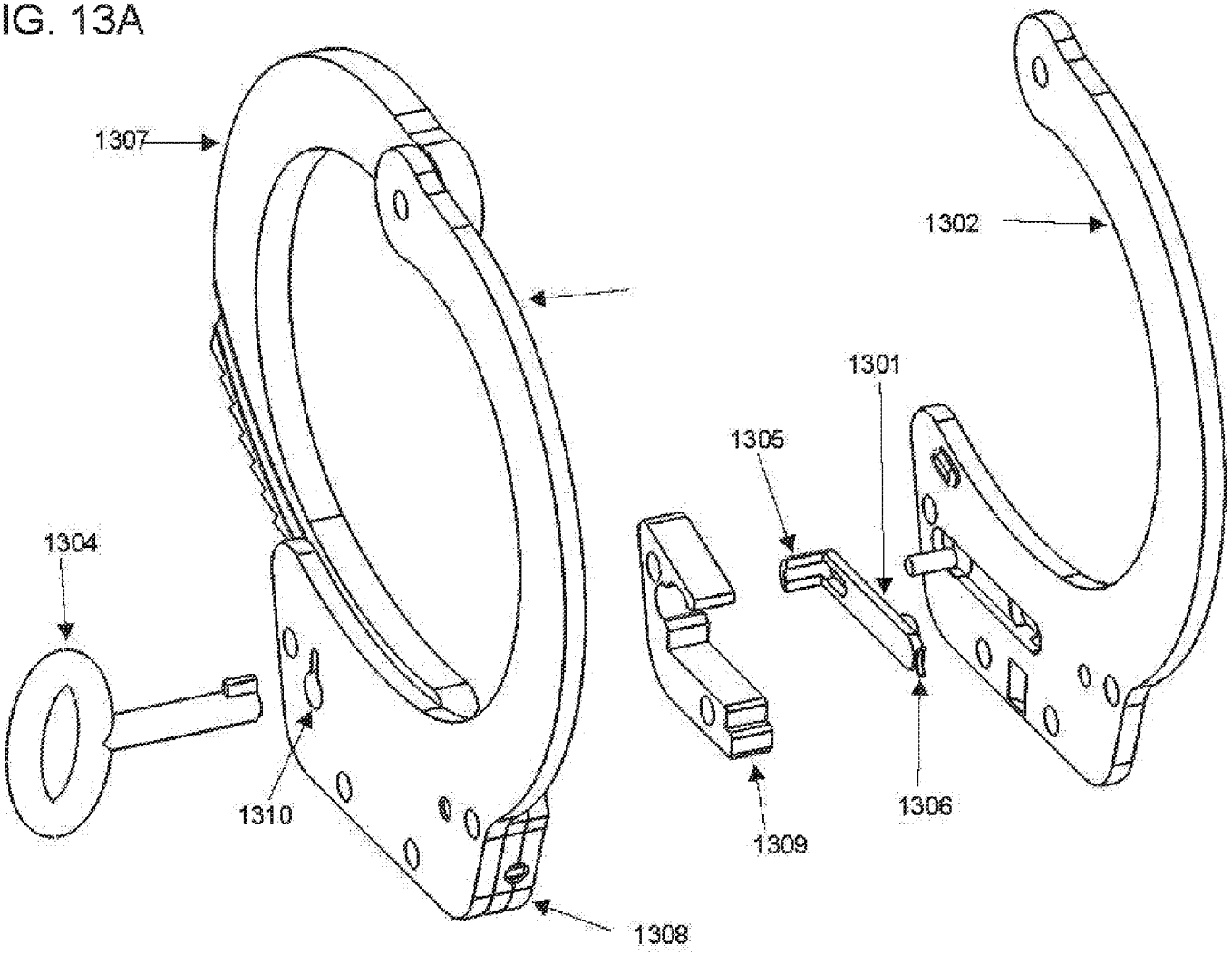
FIG. 13A illustrates an exploded view of a thirteenth embodiment.
Figure 13B:
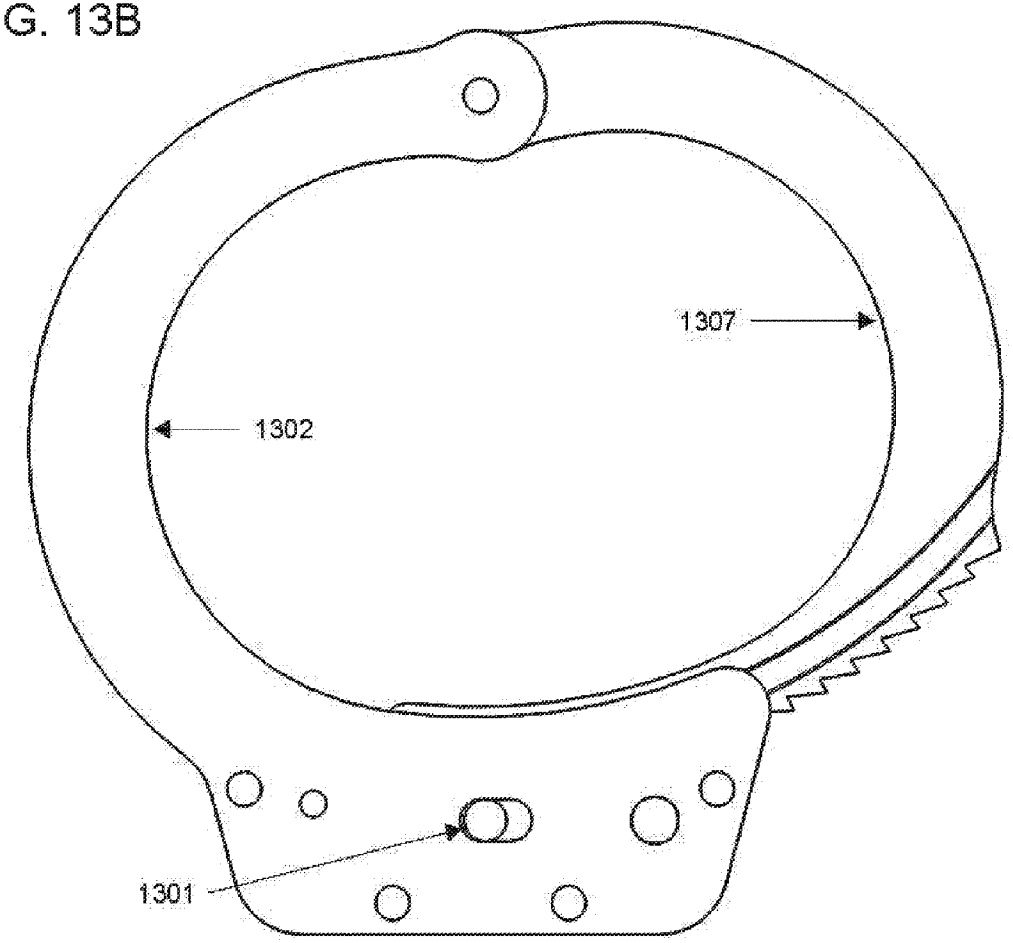
FIG. 13B shows an exterior view of the button according to the thirteenth embodiment.
Figure 13C:
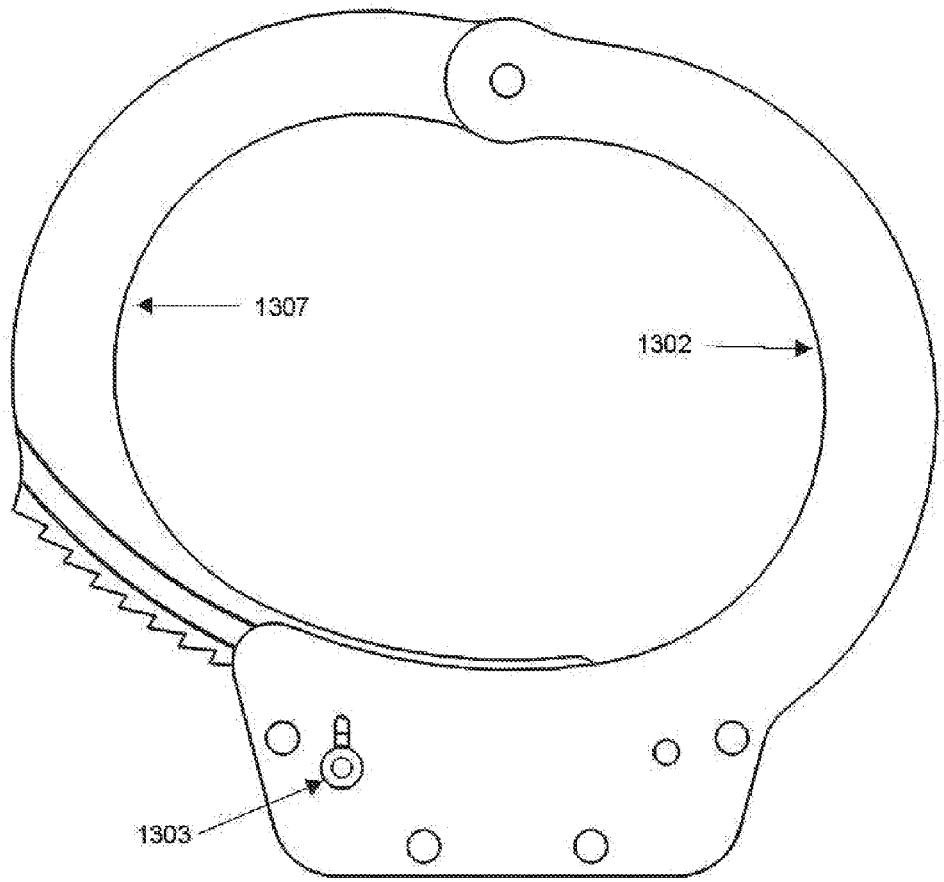
FIG. 13C shows an exterior view of the keyhole according to the thirteenth embodiment.

A further embodiment provides a sliding block system preventing full entry of a handcuff key into a keyhole located on the double strand of a handcuff. From FIG. 13A, a sliding keyhole protrusion button 1301 is connected to an L shaped block mechanism. From FIG. 13B, button 1301 can be retracted in a direction away from keyhole 1303 thereby moving the block 1305 out of keyhole 1303 as shown in FIG. 13C.

Figure 13D:
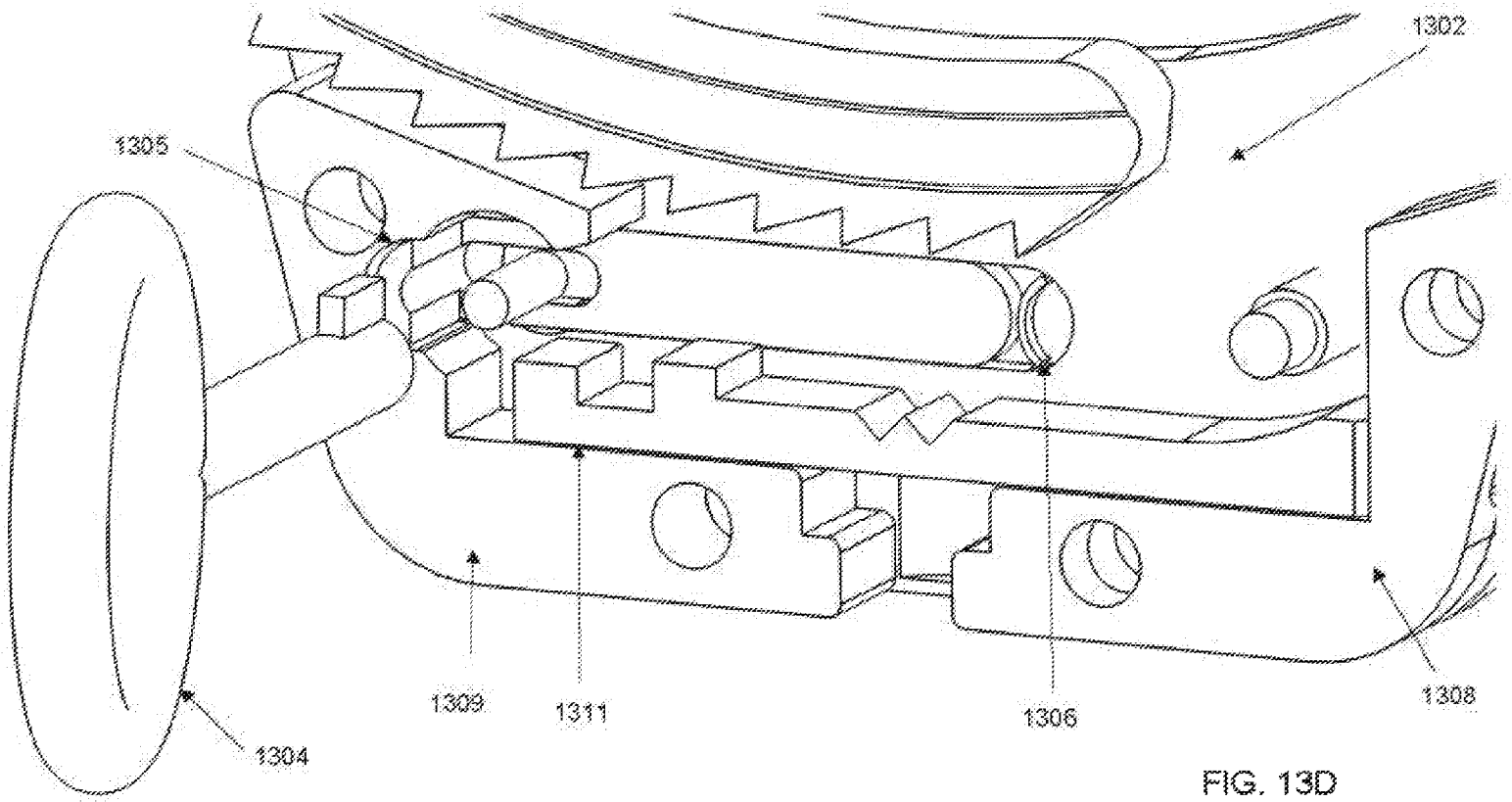
FIG. 13D shows the block moved so that a key may be inserted into the keyhole according to the thirteenth embodiment.

Sliding keyhole block button 1301 is recessed into double strand 1302 with a concave surface. The concave button surface ensures button 1301 cannot be activated by side pressure on the double strand 1302 unless button 1301 is physically pushed away from keyhole 1303. From FIG. 13D, this allows a handcuff key 1304 inserted into the keyhole in order to manipulate the locking mechanism. In this case, the block 1305 has been slid laterally in order to allow a handcuff key 1304 to enter the mechanism. A spring 1306 exerts pressure on the button 1301 from the double strand 1302.

In this embodiment, the sliding keyhole plate button 1301 on double strand 1302 opposite keyhole 1303 makes it difficult for a person to simultaneously slide the keyhole plate button 1301 and manipulate a handcuff key 1304 with the same hand.

Figure 13E:
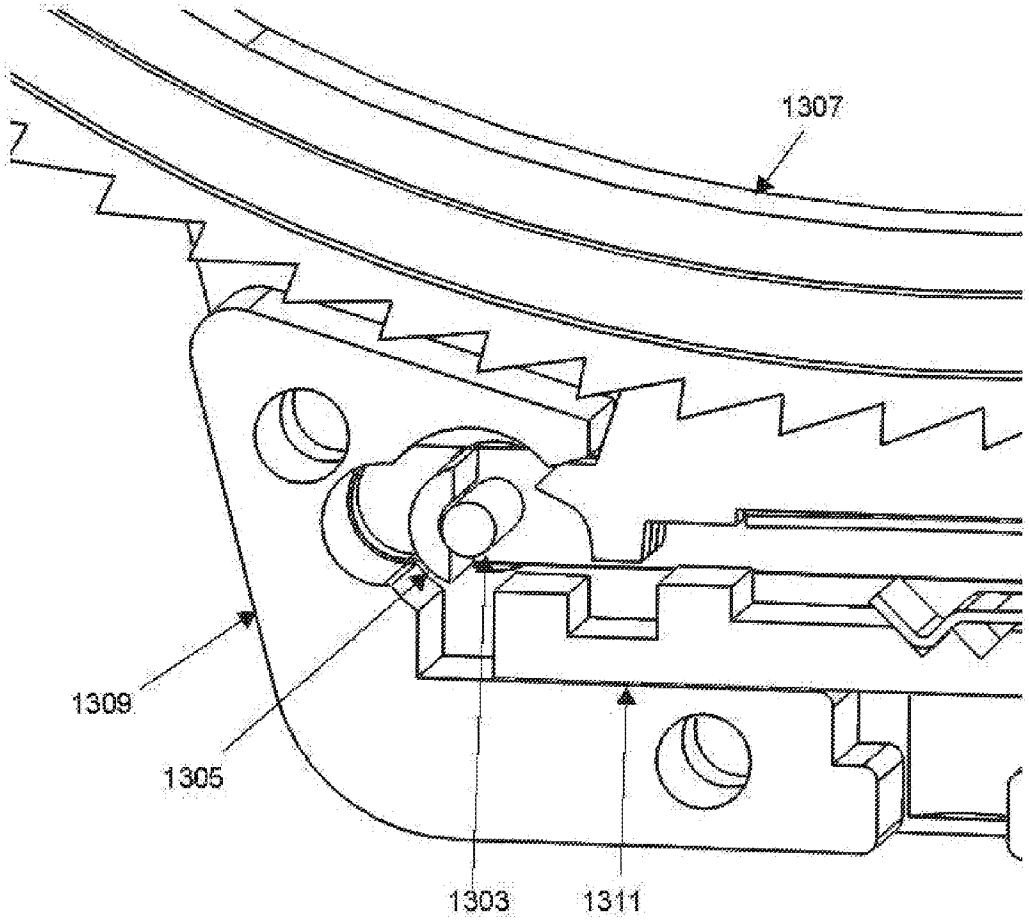
FIG. 13E shows the button not engaged and the block obstructing the keyhole.
Figure 13F:
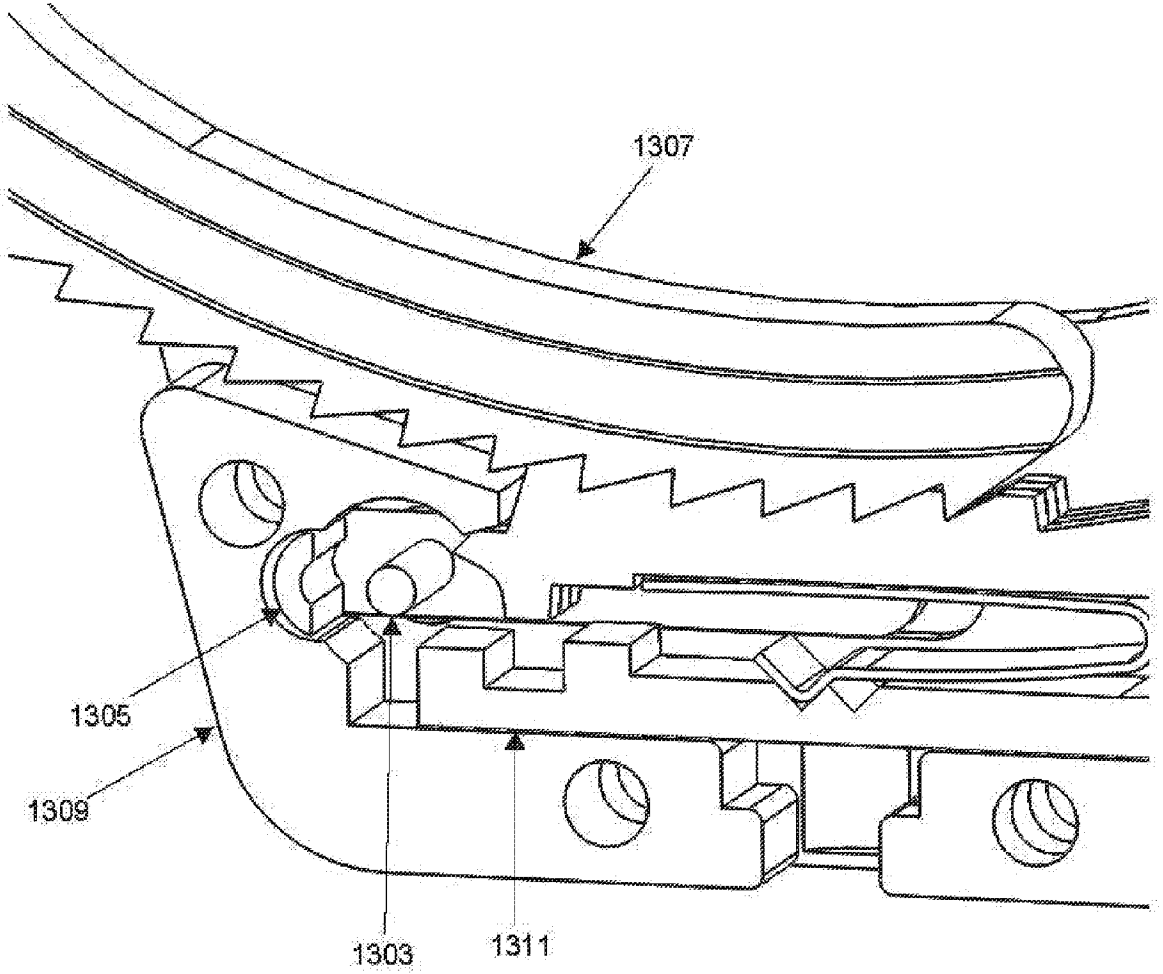
FIG. 13F shows the button engaged and the block moved to no longer obstruct the keyhole.
Figure 13G:
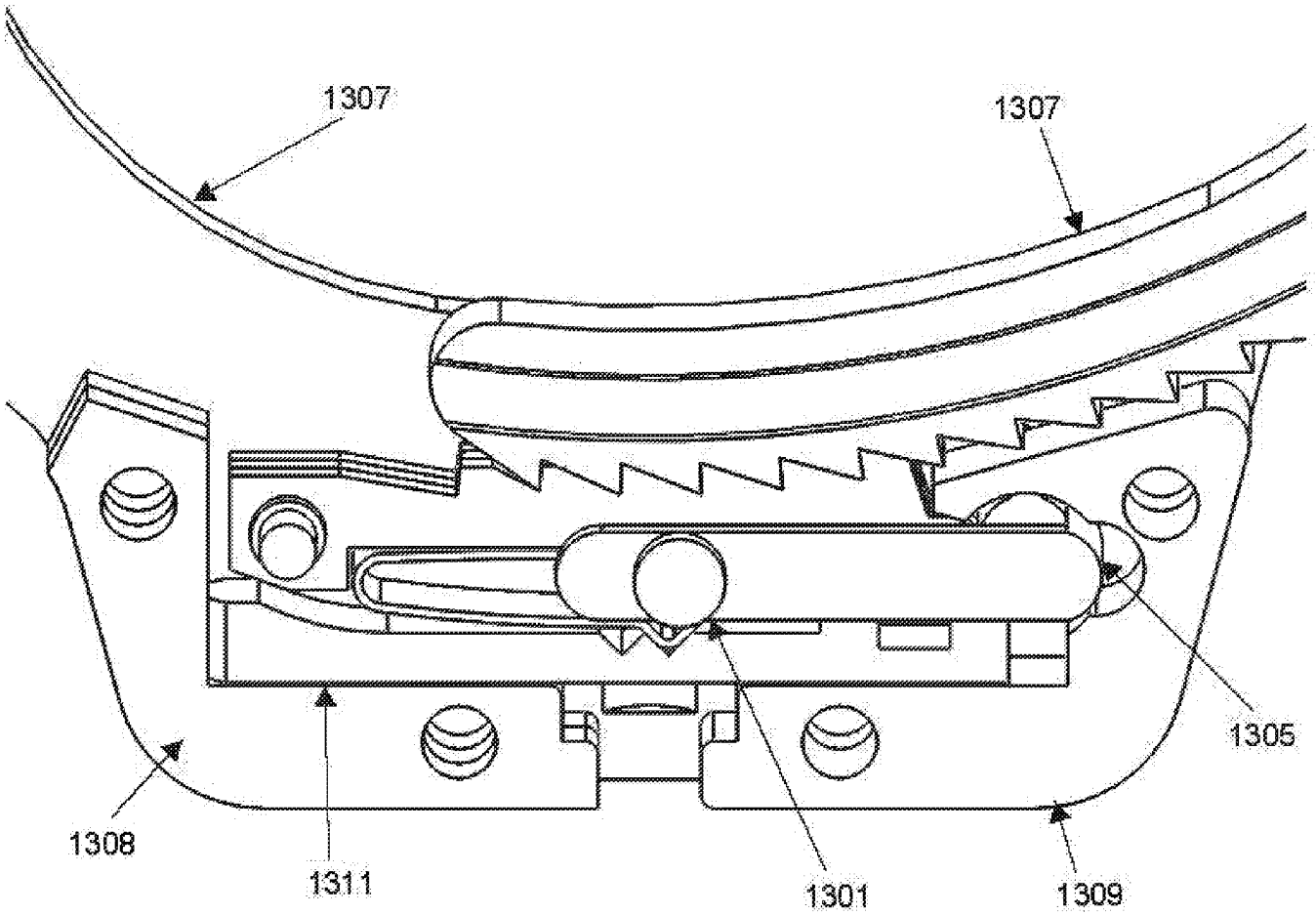
FIG. 13G shows the button not engaged and the block obstructing the keyhole.

From FIG. 13E, sliding block button 1301 is constructed in a manner in which a small metal protrusion 1305 slides into keyhole area 1303. This forms a block inside the keyhole area 1303 to prevent the handcuff key 1304 from being fully inserted into keyhole 1303 unless button 1301 is first retracted. As a result, handcuff key 1304 cannot be turned in order to engage the locking mechanism of the handcuff. FIG. 13F shows button 1301 retraced, opening handcuff keyhole 1303 on the opposite of the handcuff. FIG. 13G shows the shape of sliding button 1301 and connected keyhole block 1304. Also shown in FIG. 13A are various handcuff components, including the single strand 1307, first mid plate 1308, second mid plate 1309, second double strand 1310 and double lock bar 1311

Figure 14A:
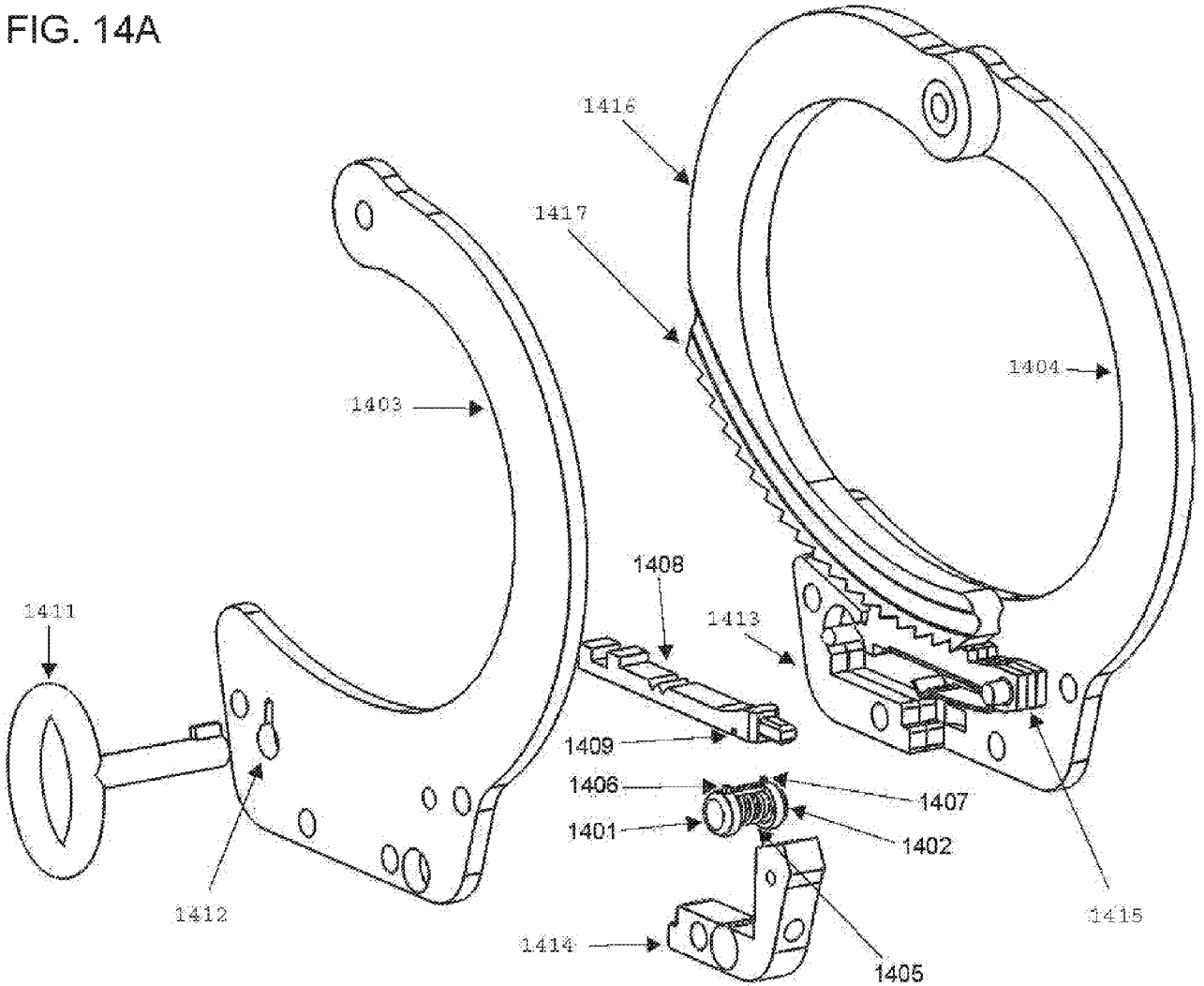
FIG. 14A illustrates an exploded view of a fourteenth embodiment.

A further embodiment includes push button locks for a locking bar and is shown in FIG. 14A. This push button locking arrangement provides for an enhanced double locking capability. Two sets of hands are required to disable the double locking mechanism. Two buttons 1401 and 1402 are positioned on either side of the double strands 1403 and 1404. The buttons are separated by spring 1405. Each of the buttons have L shaped protrusions 1406 and 1407 that interact with the double lock bar 1408 on the opposite side of each button 1401 and 1402.

Figure 14B:
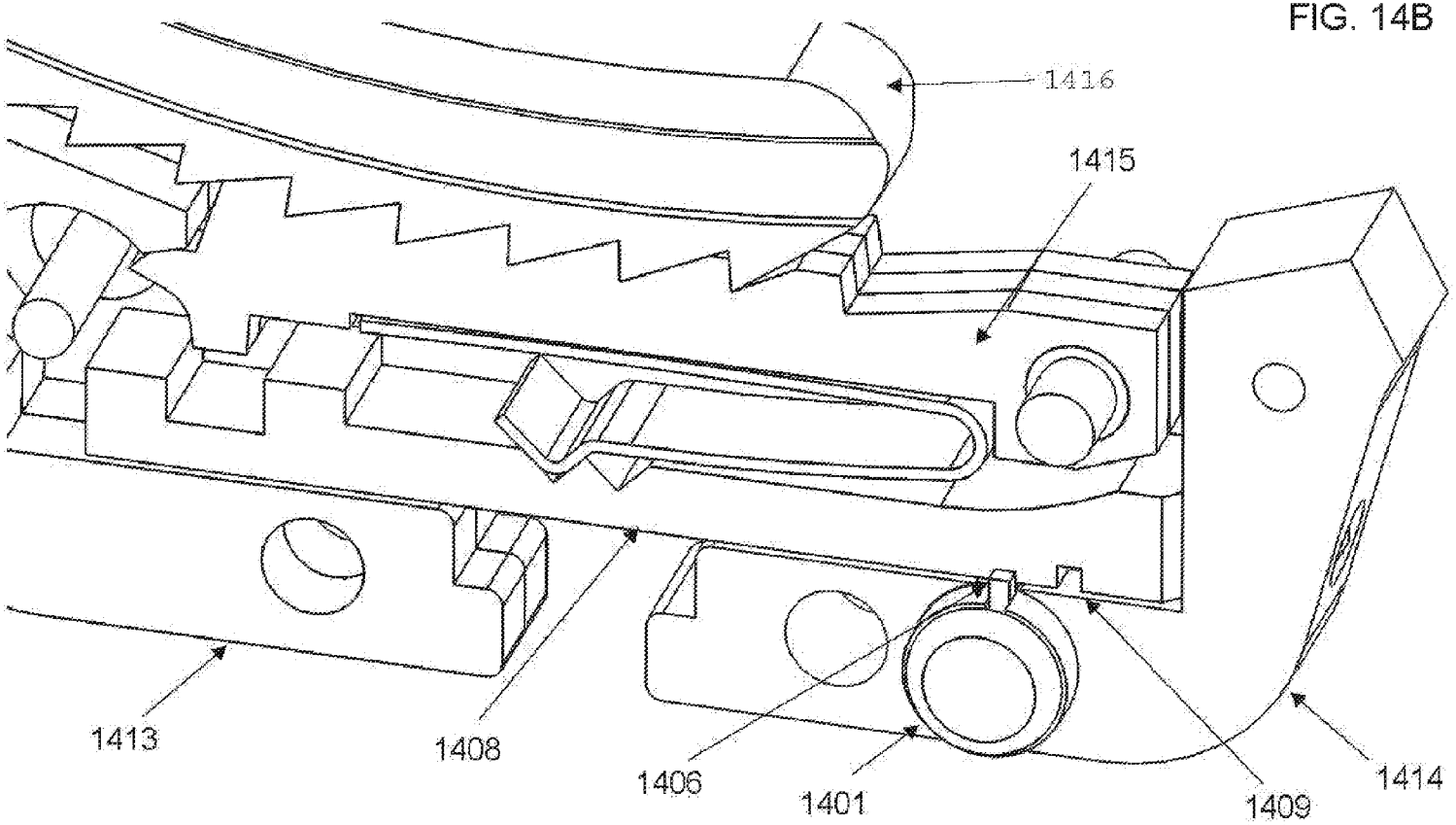
FIG. 14B shows the buttons according to the fourteenth embodiment with L shaped protrusions not engaged with the double lock bar.
Figure 14C:
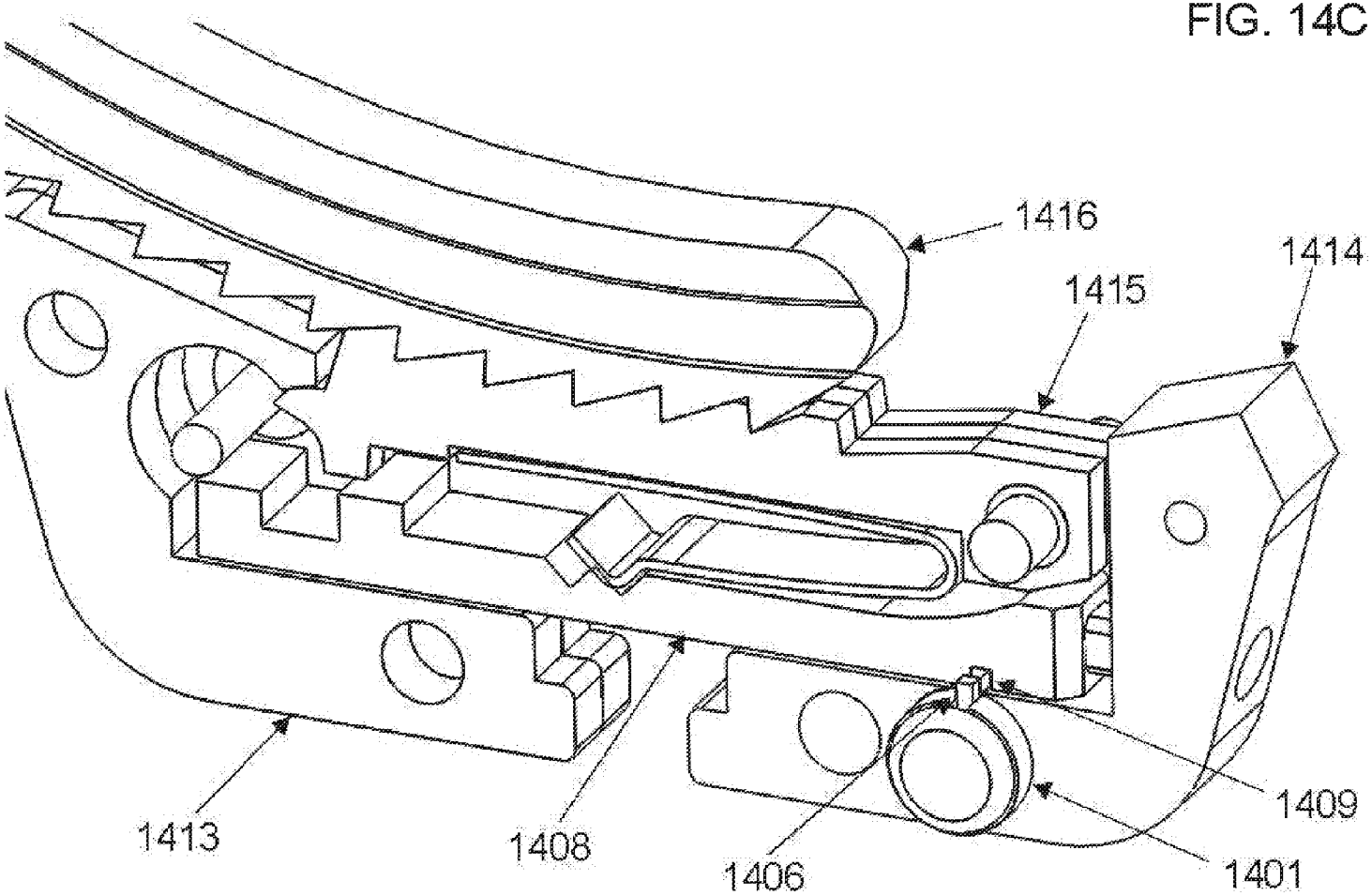
FIG. 14C shows the L shaped protrusions according to the fourteenth embodiment aligned with the notches in the double lock bar.
Figure 14D:
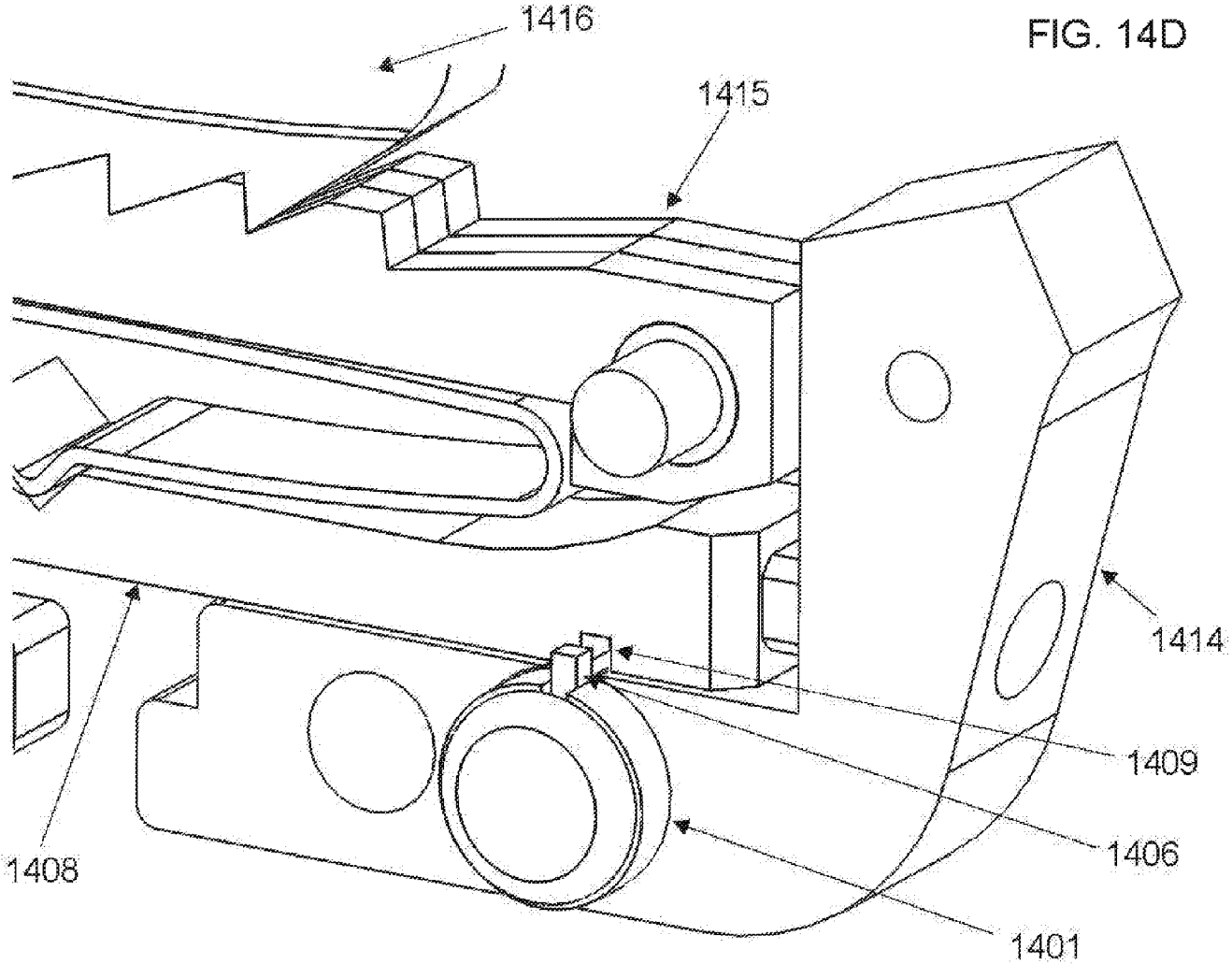
FIG. 14D shows a close up of the L shaped protrusions aligned with the notches in the double lock bar.

FIG. 14B illustrates the double lock bar 1408 in an unlocked position. The buttons 1401 and 1402 have been depressed and the L shaped protrusions 1406 and 1407 are positioned against the sides of the double lock bar 1408. In FIG. 14B, the sides of the double lock bar 1408 has notches 1409 and 1410 which are not employed. FIG. 14C shows the double lock on the handcuffs has been activated and slid forward towards keyhole 1411. Buttons 1401 and 1402 have not been depressed and L shaped protrusions 1406 and 1407 have aligned with the double lock bar notches 1409 and 1410. FIG. 14D represents a close view of this alignment with the double lock bar notches 1409 and 1410.

Figure 14E:
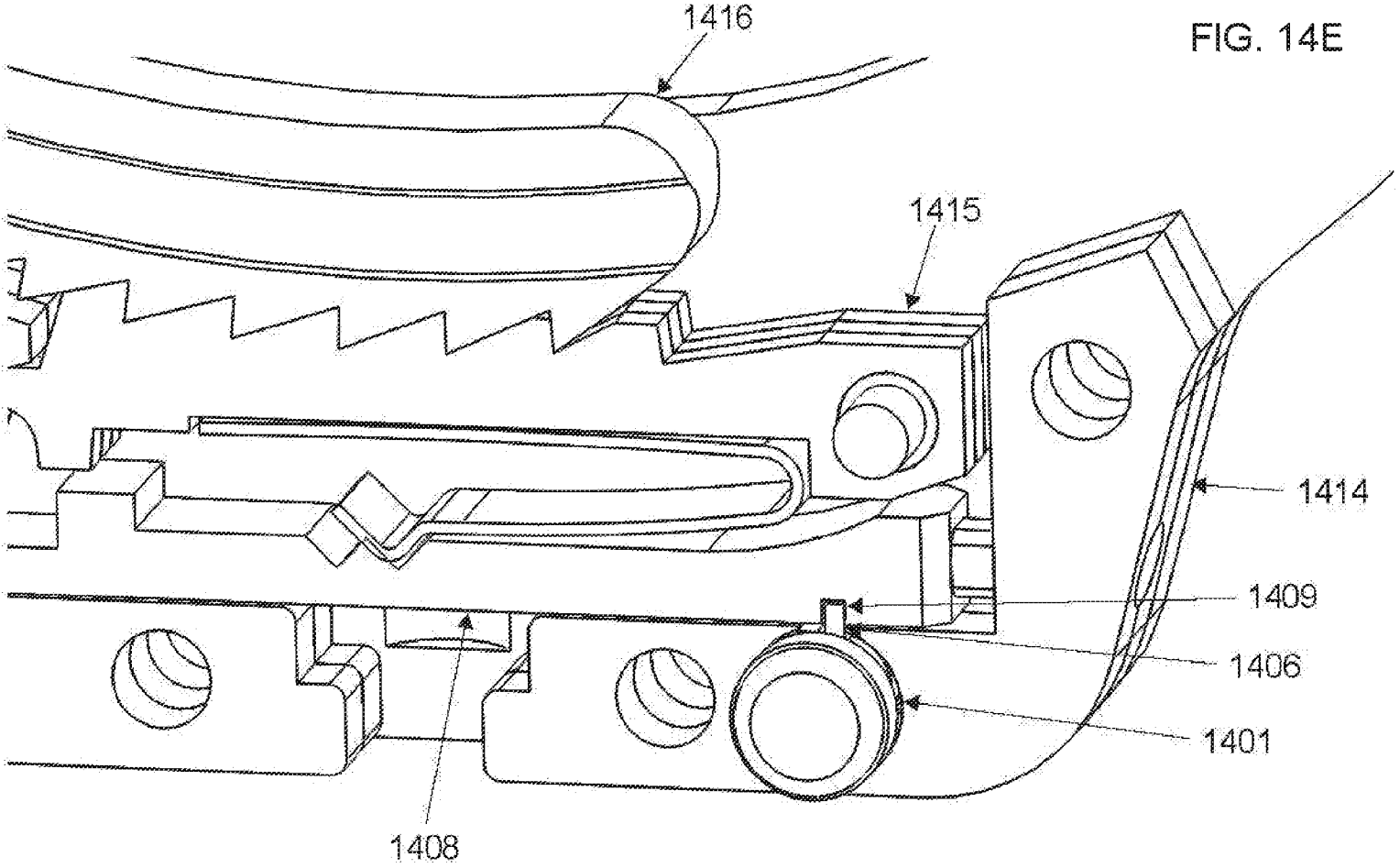
FIG. 14E shows a close up of the L shaped protrusions engaged with the notches in the double lock bar.

FIG. 14E shows the L shaped protrusions 1406 and 1047 in the double lock bar notches 1409 and 1410. The L shaped protrusions 1406 and 1407 are driven into notches 1409 and 1410 due to the pressure exerted by spring 1405. The double lock bar 1408 is firmly locked into place and can no longer be dislodged by force or inertia.

In order for the double locking system to be unlocked, both buttons 1401 and 1402 must simultaneously be depressed to remove L shaped protrusions 1406 and 1407 from the notches 1409 and 1410. Only then can handcuff key 1411 or a similar device be used to unlock double lock mechanism 1408 of the handcuffs. The need to depress buttons 1401 and 1402 and manipulate a handcuff key 1411 simultaneously makes it extremely unlikely that a person wearing the handcuffs will be able to unlock the double lock 1408 without assistance.

Figure 14F:
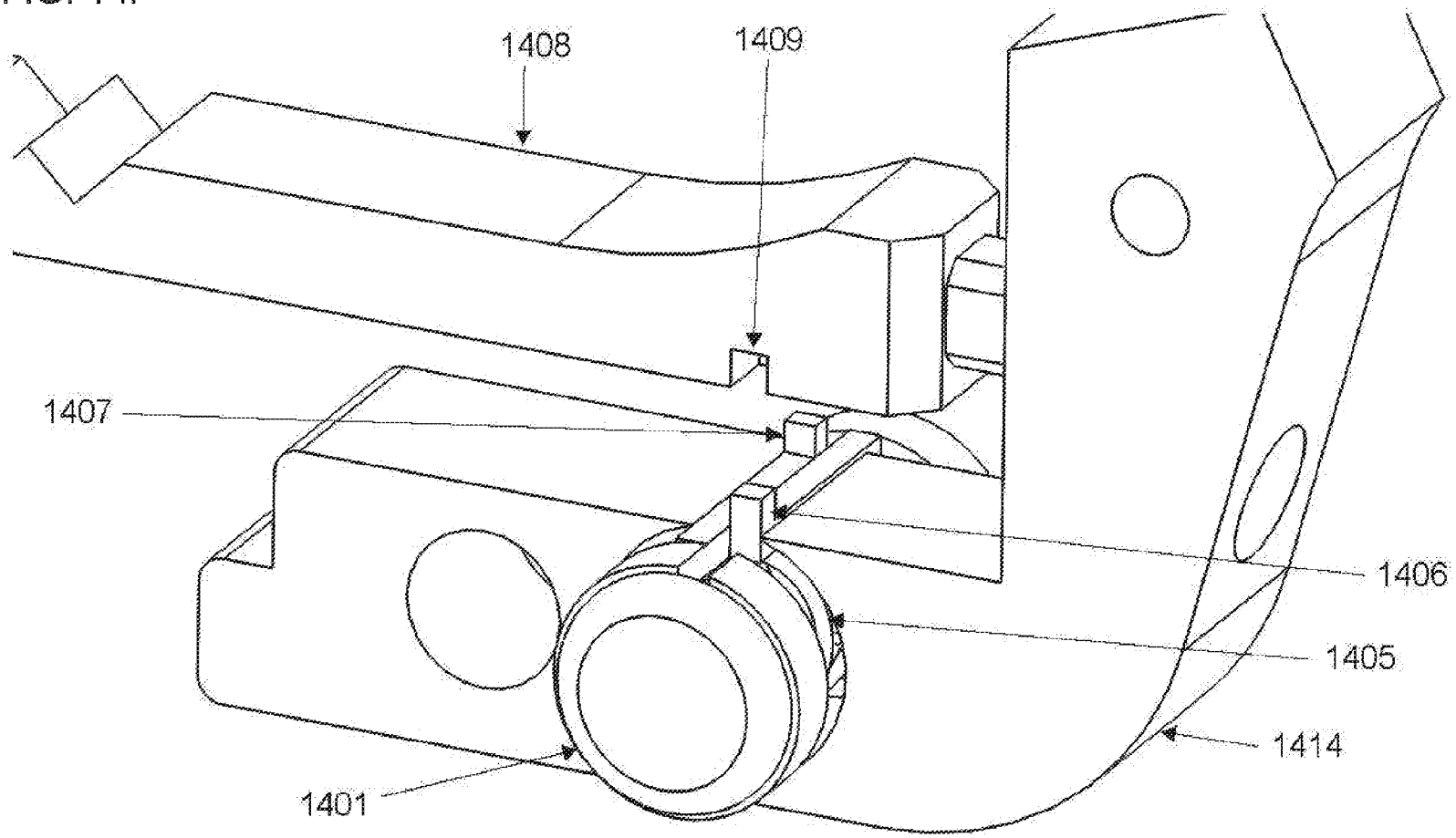
FIG. 14F shows a close up of the two buttons, spring and L shaped protrusions fitting inside the mid plate according to the fourteenth embodiment with the L shaped protrusions engaged and the buttons not depressed.
Figure 14G:
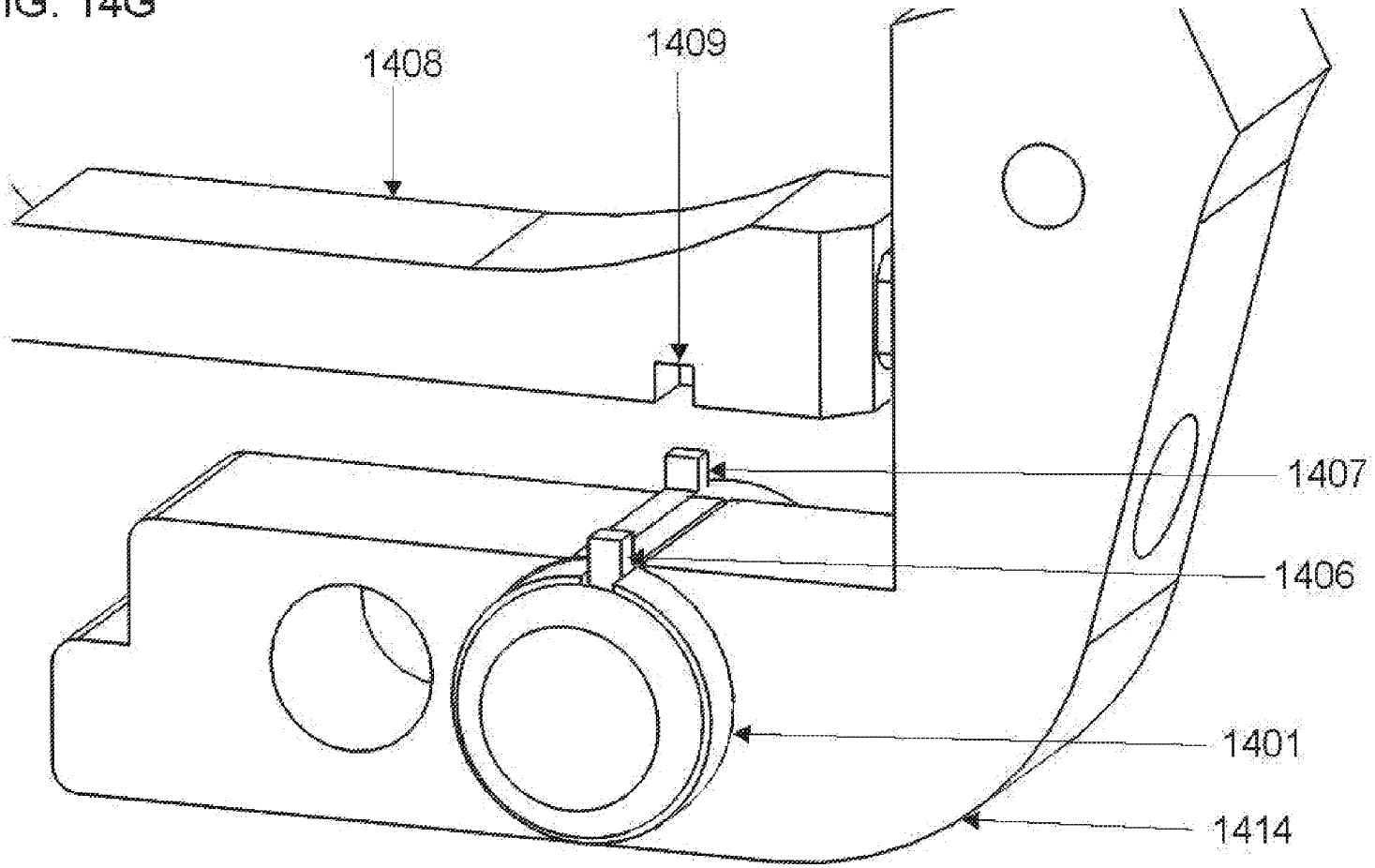
FIG. 14G shows a close up of the buttons according to the fourteenth embodiment being depressed so that the L shaped protrusions are not engaged with the double lock bar.
Figure 14H:
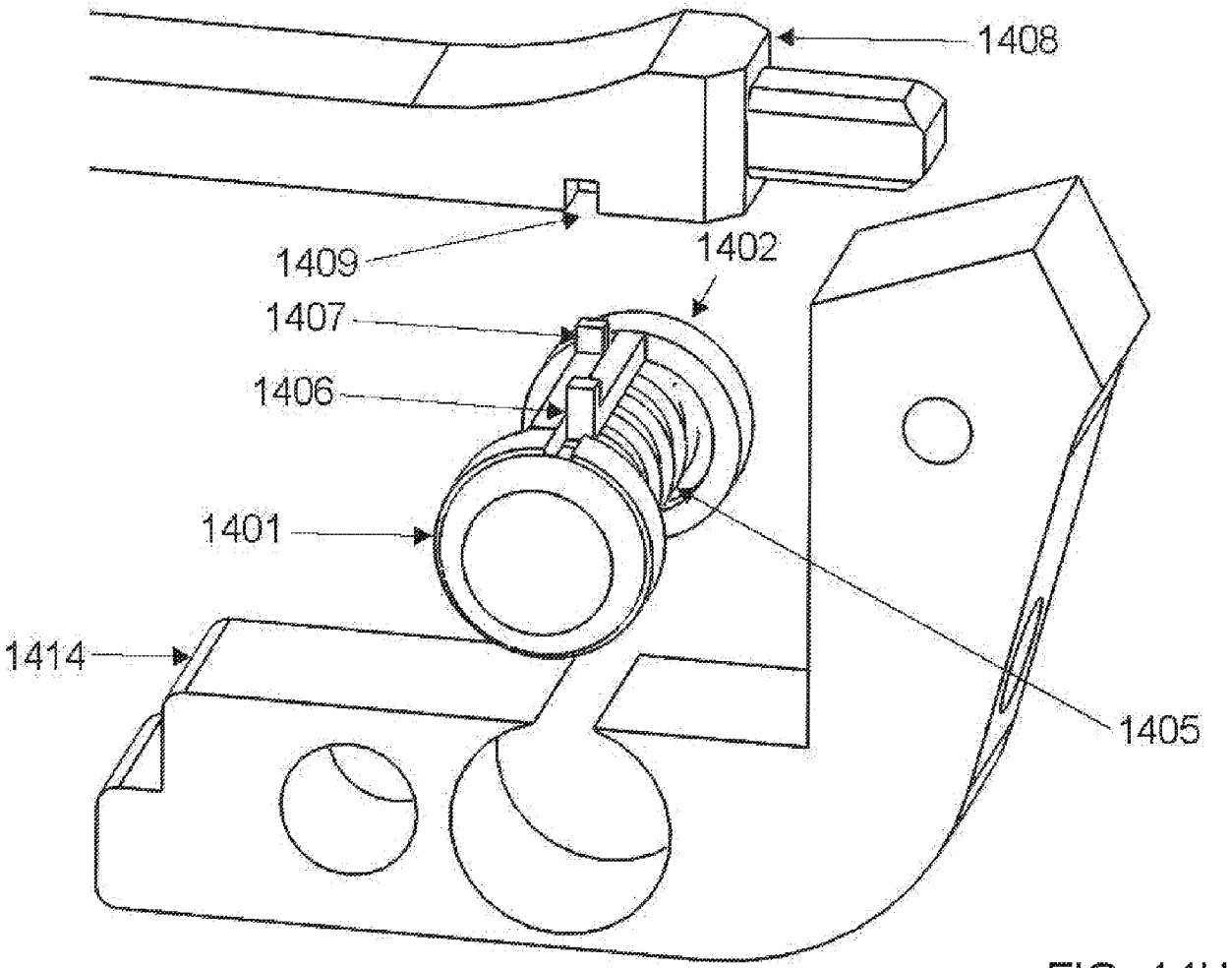
FIG. 14H shows the buttons, L shaped protrusions and spring assembly removed from the mid plate according to the fourteenth embodiment.

FIG. 14F shows buttons 1401 and 1402 in a locked position as if they were seated within notches 1409 and 1410 and buttons 1401 and 1402 had not been depressed. FIG. 14G illustrates buttons 1401 and 1402 as if they have been depressed, compressing spring 1405 and thereby moving the L shaped protrusions 1406 and 1407 out of notches 1409 and 1410. FIG. 14H depicts the buttons 1401 and 1402, spring 1405 and corresponding L shaped protrusions 1406 and 1407. Also shown in FIG. 14A are various handcuff components, including keyhole 1412, first mid plate 1413, second mid plate 1414, pawls 1415, single strand 1416 and ratchet teeth 1417.

Thus the present design comprises a handcuff or restraining system design which may require more than one hand to manipulate an aspect of the handcuffs while simultaneously turning a handcuff key. Alternately, the design may be one where the wearer of the handcuffs will have an inability to utilize two hands to manipulate the handcuffs in conjunction with the use of a handcuff key, or may incorporate two sliding buttons on opposing sides of double strands connected to two of three pawls. Sliding the buttons down independently unlocks two pawls while a third is unlocked with a handcuff key.

The design may alternately incorporate two sliding buttons on opposing edges of the double strand housing. The buttons engage pawls located at the edge, which interface with the single strand ratchet teeth. Sliding the buttons down independently unlocks the pawls while a central pawl is unlocked with a handcuff key. A further alternative comprises a design where a sliding button plate, under spring tension, blocks the keyhole. The button, located on the same side as the keyhole, can be retracted and a key inserted in the keyhole to unlock the handcuffs.

Thus the present arrangement may include a design where ratchet indentations are located on the side edges of the single strand, side pawls engage the side ratchets, and tension is released when two buttons on the double strands are simultaneously depressed.

Designs presented herein include a design whereby the handcuff swivel collar interfaces with one of multiple pawls where the handcuff chain has to be pulled away from the handcuff to disengage the pawl and key simultaneously used to unlock the handcuffs; a design where a roller chain is used to connect the two handcuffs where the double lock bar has two tabs which interface against the flat areas of a collar swivel thereby prevent the handcuffs from turning when double locked; a design where two buttons on the double strands need to be simultaneously depressed in order to allow a handcuff key to open the locking mechanism; a design where a double plunger system is incorporated into the double lock bar and when the handcuffs are double locked, the plunger prevents inertia strikes from unlocking the double lock bar; a design whereby an L shaped component is incorporated to engage into the double lock bar such that when the handcuffs are double locked, the L shape component prevents inertia strikes from unlocking the double lock bar; a design where two buttons on opposite sides of the double strand interface with the double lock bar when activated, wherein the buttons are depressed to allow the double lock bar to move when the key is turned.

Further embodiments of the present design include two buttons in opposite sides of the double strand interface with the double lock bar when activated where the buttons slide up or down to allow the double lock bar to move when a key is turned; a design where a sliding button plate, under spring tension, blocks the keyhole where the button, located on the opposite side as the keyhole, can be retracted and a key inserted in the keyhole to unlock the handcuffs; and a design where a slide plate moves a block into the keyhole, and the sliding plate needs to be retracted before handcuff key can fully seat into the keyhole in order to unlock the handcuffs.

According to one embodiment, there is provided a set of handcuffs comprising a handcuff strand comprising ratchet teeth, a universal handcuff key locking mechanism configured to receive a universal handcuff key to unlock the handcuffs, and locking means provided on one handcuff of the set of handcuffs requiring more than one hand to manipulate in addition to employing the universal handcuff key to release the ratchet teeth and unlock the set of handcuffs. Locking means may comprise a variety of arrangements, including but not limited to a multiple tab spring, a sliding mechanism, a design wherein the handcuff strand comprises a plurality of openings configured to receive teeth engageable by depressing a plurality of buttons, a chain tension lock bar, a multiple element spring and a multiple element key pawl, a double lock chain hinge, a two button arrangement comprising a spring positioned between two buttons, a double lock and spring-plunger arrangement, a hook component configured to engage a key pawl to keep the key pawl from moving, an opposing two button arrangement configured to lock and release a key pawl, a double lock with sliders on both sides of one handcuff or any other embodiments of similar designs.

According to a further embodiment, there is provided a restraining arrangement comprising a releasable strand comprising ratchet teeth, the releasable strand configured to tighten and loosen about a wearer, a universal key locking mechanism configured to receive a universal key to unlock the restraining arrangement, and locking means provided in the restraining arrangement requiring more than one hand to manipulate in addition to employing the universal handcuff key to release the ratchet teeth and unlock the restraining device from the wearer.

According to a third embodiment of the present design, there is provided a set of handcuffs comprising a releasable handcuff strand comprising ratchet teeth, the releasable handcuff strand configured to tighten and loosen about a wearer, a universal key locking mechanism configured to receive a universal key to unlock the set of handcuffs, and locking means provided on a single handcuff of the set of handcuffs, the locking means requiring more than one hand to manipulate in addition to employing the universal key to release the ratchet teeth and releasable handcuff strand and unlock the restraining device from the wearer.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but is to be accorded the widest scope consistent with the principles and novel features disclosed herein.

What is claimed is:

1. A set of handcuffs comprising:

a handcuff strand comprising ratchet teeth;

a universal handcuff key locking mechanism configured to receive a universal handcuff key to unlock one handcuff of the set of handcuffs; and locking means provided on one handcuff of the set of handcuffs requiring more than one hand to manipulate in addition to employing the universal handcuff key to release the ratchet teeth and unlock one handcuff of the set of handcuffs;

wherein the locking means comprise a multiple element pawl, wherein every element of the multiple element pawl rotates about a common axis and at least one element of the multiple element pawl is engaged by the universal handcuff key and each remaining element of the multiple element pawl is engaged by manipulation by a person.

2. The set of handcuffs of claim 1, wherein the locking means further comprise a multiple tab spring.

3. The set of handcuffs of claim 2, wherein the multiple element pawl is further configured to interface with the multiple tab spring.

4. The set of handcuffs of claim 1, wherein the locking means comprises a sliding mechanism.

5. The set of handcuffs of claim 1, wherein the multiple element pawl is further configured to receive the ratchet teeth and is engageable by depressing a plurality of buttons.

6. The set of handcuffs of claim 1, wherein the locking mechanism comprises a chain tension lock bar.

7. The set of handcuffs of claim 6, further comprising a multiple element spring and a multiple element key pawl.

8. The set of handcuffs of claim 1, wherein the locking mechanism comprises a double lock chain hinge.

9. The set of handcuffs of claim 8, further comprising a multiple element spring and a multiple element key pawl.

10. The set of handcuffs of claim 1, wherein the locking means further comprise a two button arrangement comprising a spring positioned between two buttons.

11. The set of handcuffs of claim 1, wherein the locking mechanism comprises a double lock and spring-plunger arrangement.

12. The set of handcuffs of claim 1, wherein the locking mechanism comprises a hook component configured to engage a key pawl to keep the key pawl from moving.

13. The set of handcuffs of claim 1, wherein the locking means further comprise an opposing two button arrangement configured to lock and release elements of the multiple element key pawl.

14. The set of handcuffs of claim 1, wherein the locking means further comprise a double lock with sliders on both sides of one handcuff.

15. A restraining arrangement comprising:

a releasable strand comprising ratchet teeth, the releasable strand configured to tighten and loosen about a wearer;

a universal key locking mechanism configured to receive a universal key to unlock the restraining arrangement; and locking means provided in the restraining arrangement requiring more than one hand to manipulate in addition to employing the universal key to release the ratchet teeth and unlock the restraining device from the wearer;

wherein the locking means comprise a multiple element pawl, wherein every element of the multiple element pawl rotates about a common axis and at least one element of the multiple element pawl is engaged by the universal key and each remaining element of the multiple element pawl is engaged by manipulation by a person.

16. The restraining arrangement of claim 15, wherein the locking means further comprise a multiple tab spring.

17. The restraining arrangement of claim 16, wherein the multiple element pawl is further configured to interface with the multiple tab spring.

18. The restraining arrangement of claim 15, wherein the locking means comprises a sliding mechanism.

19. The restraining arrangement of claim 15, wherein the strand comprises a multiple element pawl is further configured to receive the ratchet teeth and is engageable by depressing a plurality of buttons.

20. The restraining arrangement of claim 15, wherein the locking mechanism comprises a chain tension lock bar.

21. The restraining arrangement of claim 15, further comprising a multiple element spring and a multiple element key pawl.

22. The restraining arrangement of claim 15, wherein the locking mechanism comprises a double lock chain hinge.

23. The restraining arrangement of claim 22, further comprising a multiple element spring and a multiple element key pawl.

24. The restraining arrangement of claim 15, wherein the locking means further comprise a two button arrangement comprising a spring positioned between two buttons.

25. The restraining arrangement of claim 15, wherein the locking mechanism comprises a double lock and spring-plunger arrangement.

26. The restraining arrangement of claim 15, wherein the locking mechanism comprises a hook component configured to engage a key pawl to keep the key pawl from moving.

27. The restraining arrangement of claim 15, wherein the locking means further comprise an opposing two button arrangement configured to lock and release elements of the multiple element key pawl.

28. The restraining arrangement of claim 15, wherein the locking means further comprise a double lock with sliders on both sides of one handcuff.

29. A set of handcuffs comprising:

a releasable handcuff strand comprising ratchet teeth, the releasable handcuff strand configured to tighten and loosen about a wearer;

a universal key locking mechanism configured to receive a universal key to unlock a single handcuff of the set of handcuffs; and locking means provided on the single handcuff of the set of handcuffs, the locking means requiring more than one hand to manipulate in addition to employing the universal key to release the ratchet teeth and releasable handcuff strand and unlock the single handcuff of the set of handcuffs from the wearer;

wherein the locking means comprise a multiple element pawl, wherein every element of the multiple element pawl rotates about a common axis and at least one element of the multiple element pawl is engaged by the universal key and each remaining element of the multiple element pawl is engaged by manipulation by a person.

30. The restraining arrangement of claim 29, wherein the locking means further comprise a multiple tab spring.

* * * * *